US011731013B2

(12) United States Patent
Parsons et al.

(10) Patent No.: US 11,731,013 B2
(45) **Date of Patent: *Aug. 22, 2023**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Michael R. Nicolette, Scottsdale, AZ (US); Bradley D. Schweigert, Cave Creek, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 9 days.

This patent is subject to a terminal disclaimer.

(21) Appl. No.: 17/505,813

(22) Filed: Oct. 20, 2021

(65) Prior Publication Data

US 2022/0032138 A1 Feb. 3, 2022

Related U.S. Application Data

(63) Continuation of application No. 17/161,987, filed on Jan. 29, 2021, now Pat. No. 11,167,187, which is a (Continued)

(51) Int. Cl.
*A63B 53/04* (2015.01)
*A63B 60/02* (2015.01)

(Continued)

(52) U.S. Cl.
CPC ..... *A63B 53/0466* (2013.01); *A63B 53/04* (2013.01); *A63B 60/02* (2015.10);

(Continued)

(58) Field of Classification Search
CPC ..... A63B 53/0466; A63B 53/04; A63B 60/02; A63B 2053/0491; A63B 60/54;

(Continued)

(56) References Cited

U.S. PATENT DOCUMENTS 723,258 A 3/1903 Felton
1,133,129 A 3/1915 Govan (Continued)

FOREIGN PATENT DOCUMENTS

CN 1572343 A 2/2005
CN 1608696 A 4/2005

(Continued)

OTHER PUBLICATIONS

"3M Scotch-Weld Structural Adhesives, Bonding Composite Parts to Multiple Materials", 3M Company, retrived from the Internet at www.3M.com/compositebonding (Year: 2016).

(Continued)

*Primary Examiner* — Sebastiano Passaniti

(57) ABSTRACT

Embodiments of golf club heads, golf clubs, and methods to manufacture golf club heads and golf clubs are generally described herein. In one example, a golf club head includes a body portion comprising a material having a first density and an interior cavity having a filler material therein comprising a material having a second density. The golf club head also includes a first mass portion coupled to the body portion and a second mass portion coupled to the hosel portion. The first mass portion and the second mass portion comprise a material having a third density. A port on the body portion is configured to receive the first mass portion. At least a portion of the first mass portion is below a horizontal midplane of the body portion. The first density is greater than the second density. The third density is greater than the first density. A distance between a portion of the first mass portion and the hosel portion is substantially greater than a distance between the portion of the first mass portion and the toe portion edge. The first mass portion and the second mass portion have at least one different physical (Continued)

property. Other examples and embodiments may be described and claimed.

20 Claims, 37 Drawing Sheets

Related U.S. Application Data continuation-in-part of application No. 17/155,486, filed on Jan. 22, 2021, which is a continuation of application No. 16/774,449, filed on Jan. 28, 2020, now Pat. No. 10,926,142, which is a continuation of application No. 16/179,406, filed on Nov. 2, 2018, now Pat. No. 10,583,336, said application No. 17/161,897 is a continuation-in-part of application No. 17/038,195, filed on Sep. 30, 2020, now Pat. No. 11,173,359, which is a continuation of application No. 16/365,343, filed on Mar. 26, 2019, now Pat. No. 10,821,340, which is a continuation of application No. 15/841,022, filed on Dec. 13, 2017, now Pat. No. 10,265,590, which is a continuation of application No. 15/701,131, filed on Sep. 11, 2017, now abandoned, which is a continuation-in-part of application No. 15/685,986, filed on Aug. 24, 2017, now Pat. No. 10,279,233, which is a continuation of application No. 15/628,251, filed on Jun. 20, 2017, now abandoned, which is a continuation of application No. 15/209,364, filed on Jul. 13, 2016, now Pat. No. 10,293,229, which is a continuation of application No. PCT/US2015/016666, filed on Feb. 19, 2015, and a continuation of application No. 14/618,501, filed on Feb. 10, 2015, now Pat. No. 9,427,634, which is a continuation of application No. 14/589,277, filed on Jan. 5, 2015, now Pat. No. 9,421,437, which is a continuation of application No. 14/513,073, filed on Oct. 13, 2014, now Pat. No. 8,961,336, which is a continuation of application No. 14/498,603, filed on Sep. 26, 2014, now Pat. No. 9,199,143, said application No. 17/161,987 is a continuation-in-part of application No. 16/376,868, filed on Apr. 5, 2019, now abandoned, which is a continuation of application No. 15/478,542, filed on Apr. 4, 2017, now Pat. No. 10,286,267, which is a continuation of application No. 14/709,195, filed on May 11, 2015, now Pat. No. 9,649,542, said application No. 17/161,987 is a continuation-in-part of application No. 16/929,552, filed on Jul. 15, 2020, now Pat. No. 11,117,030, which is a continuation of application No. 15/683,564, filed on Aug. 22, 2017, now Pat. No. 10,716,978, which is a continuation of application No. 15/598,949, filed on May 18, 2017, now Pat. No. 10,159,876, which is a continuation of application No. 14/711,596, filed on May 13, 2015, now Pat. No. 9,675,853, said application No. 17/161,987 is a continuation-in-part of application No. 16/997,091, filed on Aug. 19, 2020, now Pat. No. 11,154,755, which is a continuation of application No. 16/052,254, filed on Aug. 1, 2018, now abandoned, and a continuation-in-part of application No. 16/388,645, filed on Apr. 18, 2019, now abandoned, which is a continuation of application No. 15/890,961, filed on Feb. 7, 2018, now abandoned, which is a continuation-in-part of application No. 15/876,877, filed on Jan. 22, 2018, now abandoned, said application No. 17/161,987 is a continuation-in-part of application No. 16/785,340, filed on Feb. 7, 2020, now Pat. No. 10,940,375, which is a continuation of application No. 16/246,165, filed on Jan. 11, 2019, now Pat. No. 10,596,425, said application No. 17/161,987 is a continuation-in-part of application No. 17/099,362, filed on Nov. 16, 2020, now Pat. No. 11,291,890, which is a continuation of application No. 16/820,136, filed on Mar. 16, 2020, now Pat. No. 10,874,919, which is a continuation of application No. 16/590,105, filed on Oct. 1, 2019, now Pat. No. 10,632,349, said application No. 17/161,987 is a continuation-in-part of application No. 16/789,167, filed on Feb. 12, 2020, now Pat. No. 10,933,286.

(60) Provisional application No. 62/581,456, filed on Nov. 3, 2017, provisional application No. 61/942,515, filed on Feb. 20, 2014, provisional application No. 61/945,560, filed on Feb. 27, 2014, provisional application No. 61/948,839, filed on Mar. 6, 2014, provisional application No. 61/952,470, filed on Mar. 13, 2014, provisional application No. 61/992,555, filed on May 13, 2014, provisional application No. 62/010,836, filed on Jun. 11, 2014, provisional application No. 62/011,859, filed on Jun. 13, 2014, provisional application No. 62/032,770, filed on Aug. 4, 2014, provisional application No. 62/041,538, filed on Aug. 25, 2014, provisional application No. 62/021,415, filed on Jul. 7, 2014, provisional application No. 62/058,858, filed on Oct. 2, 2014, provisional application No. 62/137,494, filed on Mar. 24, 2015, provisional application No. 62/118,403, filed on Feb. 19, 2015, provisional application No. 62/159,856, filed on May 11, 2015, provisional application No. 62/543,786, filed on Aug. 10, 2017, provisional application No. 62/548,263, filed on Aug. 21, 2017, provisional application No. 62/549,142, filed on Aug. 23, 2017, provisional application No. 62/596,312, filed on Dec. 8, 2017, provisional application No. 62/611,768, filed on Dec. 29, 2017, provisional application No. 62/615,603, filed on Jan. 10, 2018, provisional application No. 62/616,896, filed on Jan. 12, 2018, provisional application No. 62/617,986, filed on Jan. 16, 2018, provisional application No. 62/630,642, filed on Feb. 14, 2018, provisional application No. 62/635,398, filed on Feb. 26, 2018, provisional application No. 62/642,537, filed on Mar. 13, 2018, provisional application No. 62/645,068, filed on Mar. 19, 2018, provisional application No. 62/652,241, filed on Apr. 3, 2018, provisional application No. 62/908,467, filed on Sep. 30, 2019, provisional application No. 62/903,467, filed on Sep. 20, 2019, provisional application No. 62/877,934, filed on Jul. 24, 2019, provisional application No. 62/877,915, filed on Jul. 24, 2019, provisional application No. 62/865,532, filed on Jun. 24, 2019, provisional application No. 62/826,310, filed on Mar. 29, 2019, provisional application No. 62/814,959, filed on Mar. 7, 2019.

(51) Int. Cl.
*A63B 60/54* (2015.01)
*A63B 53/06* (2015.01)

(52) U.S. Cl.
CPC ..... *A63B 53/047* (2013.01); *A63B 53/0408* (2020.08); *A63B 53/0412* (2020.08); *A63B 53/0433* (2020.08); *A63B 53/0475* (2013.01); *A63B 53/06* (2013.01); *A63B 60/54* (2015.10);

*A63B 2053/0479* (2013.01); *A63B 2053/0491* (2013.01); *A63B 2209/00* (2013.01)

(58) Field of Classification Search
CPC ..... A63B 53/0412; A63B 53/0433; A63B 53/0475; A63B 53/0408; A63B 53/06; A63B 2209/00; A63B 2053/0479; A63B 53/047
USPC ..... 473/324–350, 287–292
See application file for complete search history.

(56) References Cited

U.S. PATENT DOCUMENTS 1,306,029 A 6/1919 Robertson
1,534,600 A 4/1925 Mattern
1,538,312 A 5/1925 Neish
3,064,980 A * 11/1962 Steiner ..... A63B 53/0466 473/335
3,429,576 A * 2/1969 Ikeda ..... A63B 53/02 473/241
3,466,047 A 9/1969 Rodia et al.
3,556,533 A 1/1971 Hollis
3,625,513 A * 12/1971 Ballmer ..... A63B 53/02 473/310
3,843,122 A 10/1974 Florian
3,845,960 A 11/1974 Thompson
3,970,236 A 7/1976 Rogers
3,979,122 A 9/1976 Belmont
3,985,363 A 10/1976 Jepson et al.
3,995,865 A 12/1976 Cochran et al.
4,043,563 A 8/1977 Churchward
4,085,934 A 4/1978 Churchward
4,145,052 A 3/1979 Janssen et al.
4,220,336 A * 9/1980 Kochevar ..... A63B 60/02 473/312
4,313,607 A 2/1982 Thompson
4,319,752 A 3/1982 Thompson
4,340,230 A 7/1982 Churchward
4,489,945 A 12/1984 Kobayashi
4,502,687 A 3/1985 Kochevar
4,511,145 A 4/1985 Schmidt
4,523,759 A 6/1985 Igarashi
4,545,580 A 10/1985 Tomita et al.
4,553,755 A 11/1985 Yamada
4,591,160 A 5/1986 Piragino
4,607,846 A 8/1986 Perkins
4,614,627 A 9/1986 Curtis et al.
D294,617 S 3/1988 Perkins
4,754,977 A 7/1988 Sahm
4,803,023 A 2/1989 Enomoto et al.
4,824,116 A 4/1989 Nagamoto et al.
4,854,583 A * 8/1989 Kobayashi ..... A63B 53/02 403/292
4,867,458 A 9/1989 Sumikawa et al.
4,869,507 A 9/1989 Sahm
4,928,972 A 5/1990 Nakanishi et al.
4,962,932 A 10/1990 Anderson
4,988,104 A 1/1991 Shiotani et al.
5,028,049 A 7/1991 McKeighen
5,050,879 A 9/1991 Sun et al.
5,090,702 A 2/1992 Viste
5,094,383 A 3/1992 Anderson et al.
5,106,094 A 4/1992 Desbiolles et al.
5,158,296 A 10/1992 Lee
5,176,384 A 1/1993 Sata et al.
5,178,392 A 1/1993 Santioni
5,184,823 A 2/1993 Desboilles et al.
5,209,473 A 5/1993 Fisher
5,213,328 A 5/1993 Long et al.
5,219,408 A 6/1993 Sun
5,244,211 A 9/1993 Lukasiewicz
5,255,918 A 10/1993 Anderson et al.
5,261,669 A * 11/1993 Kochevar ..... A63B 60/00 473/312
5,282,624 A 2/1994 Viste
5,282,625 A 2/1994 Schmidt et al.
5,290,036 A 3/1994 Fenton et al.
5,306,450 A 4/1994 Okumoto et al.
5,335,914 A * 8/1994 Long ..... A63B 60/00 D21/748
5,348,302 A 9/1994 Sasamoto et al.
5,351,958 A 10/1994 Helmstetter
5,374,062 A * 12/1994 Kochevar ..... A63B 60/02 473/316
5,385,348 A 1/1995 Wargo
5,419,559 A 5/1995 Melanson et al.
5,419,560 A 5/1995 Bamber
5,421,577 A 6/1995 Kobayashi
5,425,535 A 6/1995 Gee
D361,358 S 8/1995 Simmons
5,447,309 A 9/1995 Vincent
5,447,311 A 9/1995 Viollaz et al.
5,451,056 A 9/1995 Manning
D362,885 S 10/1995 Blough et al.
5,467,983 A 11/1995 Chen
5,485,998 A 1/1996 Kobayashi
5,499,819 A 3/1996 Nagamoto
5,505,453 A 4/1996 Mack
5,509,659 A 4/1996 Igarashi
5,518,243 A 5/1996 Redman
5,533,729 A 7/1996 Leu
5,540,437 A 7/1996 Bamber
5,582,553 A 12/1996 Ashcraft et al.
5,593,356 A 1/1997 Takeda
5,595,548 A 1/1997 Beck
D378,111 S 2/1997 Parente et al.
5,607,363 A 3/1997 Chou
5,637,045 A 6/1997 Igarashi
5,647,808 A 7/1997 Hosokawa
5,649,873 A 7/1997 Fuller
5,669,830 A 9/1997 Bamber
5,711,722 A 1/1998 Miyajima et al.
5,718,641 A 2/1998 Lin
5,766,091 A 6/1998 Humphrey et al.
5,766,092 A 6/1998 Mimeur et al.
5,769,735 A 6/1998 Hosokawa
5,772,527 A 6/1998 Liu
5,788,584 A 8/1998 Parente et al.
5,797,807 A 8/1998 Moore
5,827,132 A 10/1998 Bamber
D408,485 S 4/1999 Takahashi et al.
5,899,821 A 5/1999 Hsu et al.
5,908,357 A 6/1999 Hsieh
5,913,735 A 6/1999 Kenmi
5,935,016 A 8/1999 Antonious
6,012,990 A 1/2000 Nishizawa
6,015,354 A 1/2000 Ahn et al.
D421,080 S 2/2000 Chen
D426,276 S 6/2000 Besnard et al.
6,077,171 A 6/2000 Yoneyama
6,080,069 A * 6/2000 Long ..... A63B 53/04 473/332
6,089,991 A * 7/2000 Yeh ..... A63B 60/00 473/305
6,093,116 A 7/2000 Hettinger et al.
6,162,133 A 12/2000 Peterson
6,165,081 A 12/2000 Chou
6,203,449 B1 3/2001 Kenmi
6,231,458 B1 5/2001 Cameron et al.
6,238,302 B1 5/2001 Helmstetter et al.
D445,862 S 7/2001 Ford
6,287,214 B1 * 9/2001 Satoh ..... A63B 53/02 473/305
6,290,607 B1 9/2001 Gilbert et al.
6,290,609 B1 9/2001 Takeda
6,306,048 B1 10/2001 McCabe et al.
6,352,483 B1 * 3/2002 Okoshi ..... A63B 53/04 473/305
6,379,262 B1 4/2002 Boone
6,386,990 B1 5/2002 Reyes et al.
6,443,857 B1 9/2002 Chuang
6,458,045 B1 10/2002 Chen
6,475,427 B1 11/2002 Deshmukh et al.
6,506,129 B2 1/2003 Chen
D469,833 S 2/2003 Roberts et al.

(56) References Cited

U.S. PATENT DOCUMENTS 6,533,679 B1 3/2003 McCabe et al.
D478,140 S 8/2003 Burrows
6,604,568 B2 8/2003 Bliss et al.
6,607,451 B2 8/2003 Kosmatka et al.
6,616,547 B2 9/2003 Vincent et al.
6,638,182 B2 10/2003 Kosmatka
6,638,183 B2 10/2003 Takeda
6,695,714 B1 2/2004 Bliss et al.
6,702,693 B2 3/2004 Bamber
6,780,123 B2 8/2004 Hasebe
6,811,496 B2 11/2004 Wahl et al.
6,830,519 B2 12/2004 Reed et al.
6,855,067 B2 2/2005 Solheim et al.
D502,975 S 3/2005 Schweigert et al.
6,916,253 B2 7/2005 Takeda
D508,545 S 8/2005 Roberts et al.
D508,969 S 8/2005 Hasebe
6,923,733 B2 8/2005 Chen
6,949,031 B2 9/2005 Imamoto et al.
6,971,961 B2 12/2005 Chen
D514,183 S 1/2006 Schweigert et al.
6,984,180 B2 1/2006 Hasebe
7,029,403 B2 4/2006 Rice et al.
7,037,213 B2 5/2006 Otoguro
7,048,647 B2 5/2006 Burrows
7,121,956 B2 10/2006 Lo
7,121,958 B2 10/2006 Cheng et al.
7,128,663 B2 10/2006 Bamber
7,153,222 B2 12/2006 Gilbert et al.
D534,595 S 1/2007 Hasebe
7,156,751 B2 1/2007 Wahl et al.
7,169,057 B2 1/2007 Wood et al.
7,182,698 B2 2/2007 Tseng
7,207,900 B2 4/2007 Nicolette et al.
D543,601 S 5/2007 Kawami
7,232,380 B2 6/2007 Nakahara
7,281,991 B2 10/2007 Gilbert et al.
D555,219 S 11/2007 Lin
7,303,485 B2 12/2007 Tseng
7,303,486 B2 12/2007 Imamoto
7,309,297 B1 12/2007 Solari
7,326,127 B2 2/2008 Hou et al.
7,351,164 B2 4/2008 Schweigert et al.
7,396,299 B2 7/2008 Nicolette et al.
7,448,961 B2 11/2008 Lin
7,553,241 B2 6/2009 Park et al.
7,559,854 B2 7/2009 Harvell et al.
7,575,523 B2 8/2009 Yokota
7,582,024 B2 9/2009 Shear
7,588,502 B2 9/2009 Nishino
7,594,862 B2 9/2009 Gilbert
7,611,424 B2 11/2009 Nagai et al.
7,658,686 B2 2/2010 Soracco
D618,293 S 6/2010 Foster et al.
7,744,484 B1 6/2010 Chao
7,744,486 B2 6/2010 Hou et al.
7,744,487 B2 6/2010 Tavares et al.
7,749,100 B2 7/2010 Tavares et al.
7,749,101 B2 7/2010 Imamoto et al.
7,785,212 B2 8/2010 Lukasiewicz et al.
7,794,333 B2 9/2010 Wallans et al.
7,798,917 B2 9/2010 Nguyen et al.
7,803,068 B2 9/2010 Clausen et al.
7,815,521 B2 10/2010 Ban et al.
7,846,040 B2 12/2010 Ban
7,909,706 B2 * 3/2011 Cole ..... A63B 53/02 473/308
7,922,600 B1 * 4/2011 Ambrose ..... A63B 60/00 473/338
7,938,736 B2 5/2011 Park et al.
7,938,738 B2 5/2011 Roach
8,012,040 B2 9/2011 Takechi
8,062,150 B2 11/2011 Gilbert et al.
8,088,025 B2 1/2012 Wahl et al.
8,092,319 B1 1/2012 Cackett et al.
8,105,180 B1 1/2012 Cackett et al.
8,147,353 B2 4/2012 Gilbert et al.
8,187,116 B2 5/2012 Boyd et al.
8,192,303 B2 6/2012 Ban
8,221,262 B1 7/2012 Cackett et al.
8,246,487 B1 8/2012 Cackett et al.
8,257,196 B1 9/2012 Abbott et al.
8,262,495 B2 9/2012 Stites
8,262,506 B2 9/2012 Watson et al.
8,277,337 B2 10/2012 Shimazaki
8,328,662 B2 12/2012 Nakamura et al.
8,328,663 B2 12/2012 Wahl et al.
8,342,985 B2 1/2013 Hirano
8,376,878 B2 2/2013 Bennett et al.
8,393,976 B2 3/2013 Soracco et al.
D681,142 S 4/2013 Fossum et al.
8,414,422 B2 4/2013 Peralta et al.
8,449,406 B1 5/2013 Frame et al.
8,475,293 B2 7/2013 Morin et al.
8,506,420 B2 8/2013 Hocknell et al.
8,535,176 B2 9/2013 Bazzel et al.
8,545,343 B2 10/2013 Boyd et al.
8,574,094 B2 11/2013 Nicolette et al.
8,657,700 B2 2/2014 Nicolette et al.
8,663,026 B2 3/2014 Blowers et al.
8,690,710 B2 4/2014 Nicolette et al.
8,753,230 B2 6/2014 Stokke et al.
8,790,196 B2 7/2014 Solheim et al.
8,827,832 B2 9/2014 Breier et al.
8,827,833 B2 9/2014 Amano et al.
8,845,455 B2 9/2014 Ban et al.
8,858,362 B1 10/2014 Leposky et al.
8,936,518 B2 1/2015 Takechi
D722,352 S 2/2015 Nicolette et al.
D723,120 S 2/2015 Nicolette
8,961,336 B1 2/2015 Parsons et al.
D724,164 S 3/2015 Schweigert et al.
D726,265 S 4/2015 Nicolette
D726,846 S 4/2015 Schweigert
9,005,056 B2 4/2015 Pegnatori
9,011,270 B2 * 4/2015 Nakano ..... A63B 60/54 473/349
D729,892 S 5/2015 Nicolette et al.
D733,234 S 6/2015 Nicolette
9,044,653 B2 6/2015 Wahl et al.
9,061,186 B2 6/2015 Larson
9,079,081 B2 7/2015 Shimazaki
9,079,082 B2 7/2015 Hatton et al.
D738,449 S 9/2015 Schweigert
D739,487 S 9/2015 Schweigert
9,155,945 B2 10/2015 Demkowski et al.
9,186,560 B2 * 11/2015 Harbert ..... A63B 53/0466
9,192,830 B2 11/2015 Parsons et al.
9,192,832 B2 11/2015 Parsons et al.
9,199,143 B1 12/2015 Parsons et al.
D746,927 S 1/2016 Parsons et al.
D748,214 S 1/2016 Nicolette et al.
D748,215 S 1/2016 Parsons et al.
D748,749 S 2/2016 Nicolette et al.
D753,251 S 4/2016 Schweigert et al.
D753,252 S 4/2016 Schweigert
D755,319 S 5/2016 Nicolette et al.
D756,471 S 5/2016 Nicolette et al.
9,345,938 B2 5/2016 Parsons et al.
9,346,203 B2 5/2016 Parsons et al.
9,352,197 B2 5/2016 Parsons et al.
D759,178 S 6/2016 Nicolette
D760,334 S 6/2016 Schweigert et al.
9,364,727 B2 6/2016 Parsons et al.
9,399,158 B2 7/2016 Parsons et al.
9,421,437 B2 8/2016 Parsons et al.
9,427,634 B2 8/2016 Parsons et al.
9,440,124 B2 9/2016 Parsons et al.
9,468,821 B2 10/2016 Parsons et al.
9,517,393 B2 12/2016 Cardani et al.
9,533,201 B2 1/2017 Parsons et al.
9,550,096 B2 1/2017 Parsons et al.
9,573,027 B2 2/2017 Nivanh et al.
9,610,481 B2 4/2017 Parsons et al.

(56) References Cited

U.S. PATENT DOCUMENTS

| | | | |
|---|---|---|---|
| 9,630,070 | B2 | 4/2017 | Parsons et al. |
| 9,636,554 | B2 | 5/2017 | Parsons et al. |
| 9,649,540 | B2 | 5/2017 | Parsons et al. |
| 9,649,542 | B2 | 5/2017 | Nicolette |
| 9,662,547 | B2 | 5/2017 | Parsons et al. |
| 9,662,549 | B2 | 5/2017 | Vrska, Jr. et al. |
| 9,675,853 | B2 | 6/2017 | Parsons et al. |
| 9,750,993 | B2 | 9/2017 | Ritchie et al. |
| 9,764,194 | B2 | 9/2017 | Parsons et al. |
| 9,764,208 | B1 | 9/2017 | Parsons et al. |
| 9,782,643 | B2 | 10/2017 | Parsons et al. |
| 9,795,842 | B1 | 10/2017 | Parsons et al. |
| 9,795,843 | B2 | 10/2017 | Parsons et al. |
| 9,796,131 | B2 | 10/2017 | Parsons et al. |
| 9,814,952 | B2 | 11/2017 | Parsons et al. |
| 9,878,218 | B2 | 1/2018 | Parsons et al. |
| 9,878,220 | B2 | 1/2018 | Parsons et al. |
| 10,029,158 | B2 | 7/2018 | Parsons et al. |
| 10,029,159 | B2 | 7/2018 | Parsons et al. |
| 10,159,876 | B2 | 12/2018 | Parsons et al. |
| 10,232,235 | B2 | 3/2019 | Parsons et al. |
| 10,265,590 | B2 | 4/2019 | Parsons et al. |
| 10,279,233 | B2 | 5/2019 | Parsons et al. |
| 10,286,267 | B2 | 5/2019 | Nicolette |
| 10,293,221 | B2 | 5/2019 | Parsons et al. |
| 10,293,229 | B2 | 5/2019 | Parsons et al. |
| 10,376,754 | B2 | 8/2019 | Parsons et al. |
| D863,478 | S | 10/2019 | Parsons et al. |
| 10,449,428 | B2 | 10/2019 | Parsons et al. |
| 10,478,684 | B2 | 11/2019 | Parsons et al. |
| 10,512,829 | B2 | 12/2019 | Parsons et al. |
| 10,596,424 | B2 | 3/2020 | Parsons et al. |
| 10,596,425 | B2 | 3/2020 | Parsons et al. |
| 10,632,349 | B2 | 4/2020 | Parsons et al. |
| 10,716,978 | B2 | 7/2020 | Parsons et al. |
| 10,729,948 | B2 | 8/2020 | Parsons et al. |
| 10,729,949 | B2 | 8/2020 | Parsons et al. |
| 10,814,193 | B2 | 10/2020 | Parsons et al. |
| 10,821,339 | B2 | 11/2020 | Parsons et al. |
| 10,821,340 | B2 | 11/2020 | Parsons et al. |
| 10,828,538 | B2 | 11/2020 | Parsons et al. |
| 10,864,414 | B2 | 12/2020 | Parsons et al. |
| 10,874,919 | B2 | 12/2020 | Parsons et al. |
| 10,874,921 | B2 | 12/2020 | Parsons et al. |
| 2001/0055996 | A1 | 12/2001 | Iwata et al. |
| 2002/0004427 | A1 | 1/2002 | Cheng et al. |
| 2002/0037775 | A1 | 3/2002 | Keelan |
| 2002/0042307 | A1 | 4/2002 | Deshmukh |
| 2002/0094884 | A1 | 7/2002 | Hocknell et al. |
| 2002/0107087 | A1 | 8/2002 | Fagot |
| 2003/0087709 | A1 | 5/2003 | McCabe |
| 2003/0139226 | A1 | 7/2003 | Cheng et al. |
| 2004/0043830 | A1 | 3/2004 | Imamoto |
| 2004/0082401 | A1 | 4/2004 | Takeda |
| 2004/0092331 | A1 | 5/2004 | Best |
| 2004/0110575 | A1 | 6/2004 | Stites et al. |
| 2004/0204263 | A1 | 10/2004 | Fagot et al. |
| 2004/0209704 | A1 | 10/2004 | Mahaffey |
| 2004/0224785 | A1 | 11/2004 | Hasebe |
| 2004/0242339 | A1 | 12/2004 | Gilbert et al. |
| 2004/0266550 | A1 | 12/2004 | Gilbert et al. |
| 2005/0009632 | A1 | 1/2005 | Schweigert et al. |
| 2005/0014573 | A1 | 1/2005 | Lee |
| 2005/0026716 | A1 | 2/2005 | Wahl et al. |
| 2005/0043117 | A1 | 2/2005 | Gilbert et al. |
| 2005/0054462 | A1 | 3/2005 | Breier et al. |
| 2005/0107183 | A1 | 5/2005 | Takeda et al. |
| 2005/0119066 | A1 | 6/2005 | Stites et al. |
| 2005/0192116 | A1 | 9/2005 | Imamoto |
| 2005/0197208 | A1 | 9/2005 | Imamoto |
| 2005/0215349 | A1 | 9/2005 | Huang et al. |
| 2005/0239569 | A1 | 10/2005 | Best et al. |
| 2005/0239570 | A1 | 10/2005 | Best et al. |
| 2005/0255936 | A1 | 11/2005 | Huang |
| 2005/0266931 | A1 | 12/2005 | Hou et al. |
| 2005/0277485 | A1 | 12/2005 | Hou et al. |
| 2005/0278931 | A1 | 12/2005 | Deshmukh et al. |
| 2006/0052185 | A1 | 3/2006 | Kawaguchi et al. |
| 2006/0105856 | A1 | 5/2006 | Lo |
| 2006/0111200 | A1 | 5/2006 | Poynor |
| 2006/0122004 | A1 | 6/2006 | Chen et al. |
| 2006/0199666 | A1 | 9/2006 | Cruz |
| 2006/0229141 | A1 | 10/2006 | Galloway |
| 2006/0240909 | A1 | 10/2006 | Breier et al. |
| 2006/0258482 | A1 | 11/2006 | Cackett et al. |
| 2007/0032308 | A1 | 2/2007 | Fagot et al. |
| 2007/0129166 | A1 | 6/2007 | Shimazaki et al. |
| 2007/0225084 | A1 | 9/2007 | Schweigert et al. |
| 2007/0249431 | A1 | 10/2007 | Lin |
| 2008/0022502 | A1 | 1/2008 | Tseng |
| 2008/0058113 | A1 | 3/2008 | Nicolette et al. |
| 2008/0188322 | A1 | 8/2008 | Anderson et al. |
| 2008/0194355 | A1 | 8/2008 | Liu |
| 2008/0300065 | A1 | 12/2008 | Schweigert |
| 2008/0305888 | A1 | 12/2008 | Tseng |
| 2008/0308212 | A1 | 12/2008 | Sheasley et al. |
| 2008/0318705 | A1 | 12/2008 | Clausen et al. |
| 2009/0011858 | A1 | 1/2009 | Binette et al. |
| 2009/0029790 | A1 | 1/2009 | Nicolette et al. |
| 2009/0042665 | A1 | 2/2009 | Morales et al. |
| 2009/0048370 | A1 | 2/2009 | Lutz et al. |
| 2009/0069908 | A1 | 3/2009 | Butler, Jr. et al. |
| 2009/0163295 | A1 | 6/2009 | Tseng |
| 2009/0280923 | A1 | 11/2009 | Park et al. |
| 2010/0130306 | A1 | 5/2010 | Schweigert |
| 2010/0178999 | A1 | 7/2010 | Nicolette et al. |
| 2011/0070970 | A1 | 3/2011 | Wan |
| 2011/0111883 | A1 | 5/2011 | Cackett |
| 2011/0165963 | A1 | 7/2011 | Cackett et al. |
| 2011/0207551 | A1 | 8/2011 | Breier et al. |
| 2011/0269567 | A1 | 11/2011 | Ban et al. |
| 2011/0281665 | A1 | 11/2011 | Kawaguchi et al. |
| 2011/0294596 | A1 | 12/2011 | Ban |
| 2012/0071270 | A1 | 3/2012 | Nakano |
| 2012/0211161 | A1 | 8/2012 | Lutz et al. |
| 2012/0277027 | A1 | 11/2012 | Rice et al. |
| 2013/0137532 | A1 | 5/2013 | Deshmukh et al. |
| 2013/0225319 | A1 | 8/2013 | Kato |
| 2013/0266813 | A1 | 10/2013 | Faulkner |
| 2013/0281226 | A1 | 10/2013 | Ban |
| 2013/0288823 | A1 | 10/2013 | Hebreo |
| 2013/0303303 | A1 | 11/2013 | Ban |
| 2013/0310192 | A1 | 11/2013 | Wahl et al. |
| 2013/0324294 | A1 | 12/2013 | Oldknow |
| 2013/0344976 | A1 | 12/2013 | Stites |
| 2014/0038737 | A1 | 2/2014 | Roach et al. |
| 2014/0045605 | A1 | 2/2014 | Fujiwara et al. |
| 2014/0080621 | A1 | 3/2014 | Nicolette et al. |
| 2014/0113983 | A1 | 4/2014 | Czaplicki et al. |
| 2014/0128175 | A1 | 5/2014 | Jertson et al. |
| 2014/0274441 | A1 | 9/2014 | Greer |
| 2014/0274442 | A1 | 9/2014 | Honea et al. |
| 2014/0274451 | A1 | 9/2014 | Knight et al. |
| 2014/0274454 | A1 | 9/2014 | Snyder |
| 2014/0364248 | A1 | 12/2014 | Wahl et al. |
| 2015/0045141 | A1 | 2/2015 | Myrhum et al. |
| 2015/0126305 | A1 | 5/2015 | Stokke et al. |
| 2016/0038799 | A1 | 2/2016 | Cruz et al. |
| 2016/0045793 | A1 | 2/2016 | Cardani et al. |
| 2016/0160092 | A1 | 6/2016 | Awkal et al. |
| 2017/0239533 | A1 | 8/2017 | Cole et al. |
| 2017/0282026 | A1 | 10/2017 | Parsons et al. |
| 2017/0282027 | A1 | 10/2017 | Parsons et al. |
| 2017/0368429 | A1 | 12/2017 | Parsons et al. |
| 2018/0028882 | A1 | 2/2018 | Hebreo et al. |
| 2018/0028883 | A1 | 2/2018 | Morin et al. |
| 2018/0050243 | A1 | 2/2018 | Parsons et al. |
| 2018/0050244 | A1 | 2/2018 | Parsons et al. |
| 2018/0133567 | A1 | 5/2018 | Parsons et al. |
| 2018/0140910 | A1 | 5/2018 | Parsons et al. |
| 2018/0169488 | A1 | 6/2018 | Parsons et al. |
| 2018/0221727 | A1 | 8/2018 | Parsons et al. |
| 2018/0236325 | A1 | 8/2018 | Parsons et al. |
| 2018/0296885 | A1 | 10/2018 | Nakamura |

(56) References Cited

U.S. PATENT DOCUMENTS

| | | | |
|---|---|---|---|
| 2018/0296887 | A1 | 10/2018 | Motokawa |
| 2019/0232125 | A1 | 8/2019 | Parsons et al. |
| 2019/0232126 | A1 | 8/2019 | Nicolette |
| 2019/0240549 | A1 | 8/2019 | Parsons et al. |
| 2019/0247727 | A1 | 8/2019 | Parsons et al. |
| 2020/0171360 | A1 | 6/2020 | Parsons et al. |
| 2020/0171363 | A1 | 6/2020 | Parsons et al. |
| 2020/0179773 | A1 | 6/2020 | Parsons et al. |
| 2020/0246666 | A1 | 8/2020 | Parsons et al. |
| 2020/0346082 | A1 | 11/2020 | Parsons et al. |
| 2020/0353326 | A1 | 11/2020 | Parsons et al. |
| 2021/0008420 | A1 | 1/2021 | Parsons et al. |

FOREIGN PATENT DOCUMENTS

| | | | |
|---|---|---|---|
| CN | 1762514 | A | 4/2006 |
| CN | 1302216 | C | 2/2007 |
| CN | 201658798 | U | 12/2010 |
| CN | 202087021 | U | 12/2011 |
| CN | 101031342 | B | 1/2013 |
| CN | 203108126 | U | 8/2013 |
| CN | 101754786 | B | 10/2013 |
| CN | 102143783 | B | 2/2014 |
| DE | 29715997 | U1 | 2/1998 |
| EP | 1955740 | A1 | 8/2008 |
| GB | 2249031 | A | 4/1992 |
| JP | S51140374 | A | 12/1976 |
| JP | S62200359 | U | 12/1987 |
| JP | H0241003 | U | 3/1990 |
| JP | H0284972 | U | 7/1990 |
| JP | H08257181 | A | 10/1996 |
| JP | H10127832 | A | 5/1998 |
| JP | H10277187 | A | 10/1998 |
| JP | H119742 | A | 1/1999 |
| JP | 2001346924 | A | 12/2001 |
| JP | 2002143356 | A | 5/2002 |
| JP | 2002535056 | A | 10/2002 |
| JP | 2004313777 | A | 11/2004 |
| JP | 2005218510 | A | 8/2005 |
| JP | 2005287679 | A | 10/2005 |
| JP | 2006223331 | A | 8/2006 |
| JP | 2007044445 | A | 2/2007 |
| JP | 2007136068 | A | 6/2007 |
| JP | 2008173314 | A | 7/2008 |
| JP | 3158662 | U | 4/2010 |
| JP | 2010069106 | A | 4/2010 |
| JP | 2010530782 | A | 9/2010 |
| JP | 2013027587 | A | 2/2013 |
| JP | 2013043091 | A | 3/2013 |
| WO | 9215374 | A1 | 9/1992 |

OTHER PUBLICATIONS

Calsac Corporation—Thermoplastic Polyurethane (Year: 2019).

International Search Report and Written Opinion Issued in Connection with Corresponding Application No. PCT/US2019/026099, dated May 7, 2019 (7 pages).

International Search Report and Written Opinion received in connection with corresponding application No. PCT/US16/16626, dated Oct. 23, 2016 (12 pages).

International Search Report and Written Opinion received in connection with corresponding application No. PCT/US2015/016666, dated May 14, 2015 (8 pages).

International Search Report and Written Opinion Received in Connection With Corresponding Application No. PCT/US2020/021869, dated May 14, 2020 (12 Pages).

International Search Report and Written Opinion Received in Connection With Corresponding PCT Application Serial No. PCT/US16/42075 dated Sep. 22, 2016 (13 Pages).

International Search Report and Written Opinion Received in Connection With Corresponding PCT Application Serial No. PCT/US18/23617 dated May 31, 2018 (19 Pages).

International Search Report and Written Opinion Received in Connection With Corresponding PCT Application Serial No. PCT/US19/54104 dated Dec. 30, 2019 (10 Pages).

International Search Report and Written Opinion Received in Connection With Corresponding PCT Application Serial No. PCT/US2019/017464 dated Apr. 29, 2019 (9 Pages).

International Search Report and Written Opinion Received in Connection With the Corresponding Application No. PCT/US14/71250, dated Mar. 12, 2015 (6 Pages).

Kozuchowski, Zak, "Callaway Mack Daddy 2 PM Grind Wedges" (http://www.golfwrz.com/276203/callaway-mack-daddy-2-pm-grind-wedges/),www.golfwrx.com, GolfWRX Holdings, LLC, published Jan. 21, 2015.

Rocketbladez Press Release, "Golfballed", http://golfballed.com/index.php?option=com_content&view=article&id=724:taylormade- . . . Oct. 13, 2017, Published Jan. 3, 2013.

Taylor Made Golf Company, Inc., https://taylormadegolf.com/on/demandware.static/-/sites-tmag-library/default/v1459859109590/docs/productspecs/tm_s2013_catalog18.pdf., Published Jan. 2013.

U.S. Appl. No. 29/512,313, Nicolette, "Golf Club Head," filed Dec. 18, 2014.

Wall, Jonathan, "Details: Phil's Prototype Mack Daddy PM-Grind Wedge," (http:/www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation of application Ser. No. 17/161,987, filed Jan. 29, 2021, which is a continuation-in-part of application Ser. No. 17/155,486, filed Jan. 22, 2021, which is a continuation of application Ser. No. 16/774,449, filed Jan. 28, 2020, now U.S. Pat. No. 10,926,142, which is a continuation of application Ser. No. 16/179,406, filed Nov. 2, 2018, now U.S. Pat. No. 10,583,336, which claims the benefit of U.S. Provisional Application No. 62/581,456, filed Nov. 3, 2017.

U.S. application Ser. No. 17/161,987, filed Jan. 29, 2021, is a continuation-in-part of application Ser. No. 17/038,195 filed Sep. 30, 2020, which is a continuation of application Ser. No. 16/365,343, filed Mar. 26, 2019, now U.S. Pat. No. 10,821,340, which is a continuation of application Ser. No. 15/841,022, filed Dec. 13, 2017, now U.S. Pat. No. 10,265, 590, which is a continuation of application Ser. No. 15/701, 131, filed Sep. 11, 2017, now abandoned, which is a continuation-in-part of application Ser. No. 15/685,986, filed Aug. 24, 2017, now U.S. Pat. No. 10,279,233, which is a continuation of application Ser. No. 15/628,251, filed Jun. 20, 2017, now abandoned, which is a continuation of application Ser. No. 15/209,364, filed on Jul. 13, 2016, now U.S. Pat. No. 10,293,229, which is a continuation of International Application No. PCT/US15/16666, filed Feb. 19, 2015, which claims the benefit of U.S. Provisional Application No. 61/942,515, filed Feb. 20, 2014, U.S. Provisional Application No. 61/945,560, filed Feb. 27, 2014, U.S. Provisional Application No. 61/948,839, filed Mar. 6, 2014, U.S. Provisional Application No. 61/952,470, filed Mar. 13, 2014, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, and U.S. Provisional Application No. 62/032,770, filed Aug. 4, 2014.

U.S. application Ser. No. 15/209,364, filed on Jul. 13, 2016, now U.S. Pat. No. 10,293,229, is also a continuation of application Ser. No. 14/618,501, filed Feb. 10, 2015, now U.S. Pat. No. 9,427,634, which is a continuation of application Ser. No. 14/589,277, filed Jan. 5, 2015, now U.S. Pat. No. 9,421,437, which is a continuation of application Ser. No. 14/513,073, filed Oct. 13, 2014, now U.S. Pat. No. 8,961,336, which is a continuation of application Ser. No. 14/498,603, filed Sep. 26, 2014, now U.S. Pat. No. 9,199, 143, which claims the benefits of U.S. Provisional Application No. 62/041,538, filed Aug. 25, 2014.

U.S. application Ser. No. 17/161,987, filed Jan. 29, 2021, is a continuation-in-part of application Ser. No. 16/376,868, filed Apr. 5, 2019, now abandoned, which is a continuation of application Ser. No. 15/478,542, filed Apr. 4, 2017, now U.S. Pat. No. 10,286,267, which is a continuation of application Ser. No. 14/709,195, filed May 11, 2015, now U.S. Pat. No. 9,649,542, which claims the benefit of U.S. Provisional Application No. 62/021,415, filed Jul. 7, 2014, U.S. Provisional Application No. 62/058,858, filed Oct. 2, 2014, and U.S. Provisional Application No. 62/137,494, filed Mar. 24, 2015.

U.S. application Ser. No. 17/161,987, filed Jan. 29, 2021, is a continuation-in-part of application Ser. No. 16/929,552, filed Jul. 15, 2020, now U.S. Pat. No. 11,117,030, which is a continuation of application Ser. No. 15/683,564, filed Aug. 22, 2017, now U.S. Pat. No. 10,716,978, which is a continuation of application Ser. No. 15/598,949, filed May 18, 2017, now U.S. Pat. No. 10,159,876, which is a continuation of application Ser. No. 14/711,596, filed May 13, 2015, now U.S. Pat. No. 9,675,853, which claims the benefit of U.S. Provisional Application No. 62/118,403, filed Feb. 19, 2015, U.S. Provisional Application No. 62/159,856, filed May 11, 2015, U.S. Provisional Application No. 61/992,555, filed May 13, 2014, U.S. Provisional Application No. 62/010,836, filed Jun. 11, 2014, U.S. Provisional Application No. 62/011, 859, filed Jun. 13, 2014, U.S. Provisional Application No. 62/032,770, filed Aug. 4, 2014, and U.S. Provisional Application No. 62/041,538, filed Aug. 25, 2014.

U.S. application Ser. No. 17/161,987, filed Jan. 29, 2021, is a continuation-in-part of application Ser. No. 16/997,091, filed Aug. 19, 2020, which is a continuation of application Ser. No. 16/052,254, filed Aug. 1, 2018, now abandoned, which claims the benefit of U.S. Provisional Application No. 62/543,786, filed Aug. 10, 2017, U.S. Provisional Application No. 62/548,263, filed Aug. 21, 2017, U.S. Provisional Application No. 62/549,142, filed Aug. 23, 2017, U.S. Provisional Application No. 62/596,312, filed Dec. 8, 2017, U.S. Provisional Application No. 62/611,768, filed Dec. 29, 2017, U.S. Provisional Application No. 62/615,603, filed Jan. 10, 2018, U.S. Provisional Application No. 62/616,896, filed Jan. 12, 2018, U.S. Provisional Application No. 62/617, 986, filed Jan. 16, 2018, U.S. Provisional Application No. 62/630,642, filed Feb. 14, 2018, U.S. Provisional Application No. 62/635,398, filed Feb. 26, 2018, U.S. Provisional Application No. 62/642,537, filed Mar. 13, 2018, U.S. Provisional Application No. 62/645,068, filed Mar. 19, 2018, and U.S. Provisional Application No. 62/645,689, filed Mar. 20, 2018.

U.S. application Ser. No. 16/997,091, filed Aug. 18, 2020, is a continuation-in-part of application Ser. No. 16/388,645, filed Apr. 18, 2019, now abandoned, which is a continuation-in-part of application Ser. No. 15/890,961, filed Feb. 7, 2018, now abandoned, which is a continuation-in-part of application Ser. No. 15/876,877, filed Jan. 22, 2018, now abandoned.

U.S. application Ser. No. 17/161,987, filed Jan. 29, 2021, is a continuation-in-part of application Ser. No. 16/785,340, filed Feb. 7, 2020, now U.S. Pat. No. 10,940,375, which is a continuation of application Ser. No. 16/246,165, filed Jan. 11, 2019, now U.S. Pat. No. 10,596,425, which claims the benefit of U.S. Provisional Application No. 62/630,642, filed Feb. 14, 2018, U.S. Provisional Application No. 62/635,398, filed Feb. 26, 2018, U.S. Provisional Application No. 62/642,537, filed Mar. 13, 2018, U.S. Provisional Application No. 62/645,068, filed Mar. 19, 2018, U.S. Provisional Application No. 62/645,689, filed Mar. 20, 2018, and U.S. Provisional Application No. 62/652,241, filed Apr. 3, 2018.

U.S. application Ser. No. 17/161,987, filed Jan. 29, 2021, is a continuation-in-part of application Ser. No. 17/099,362, filed Nov. 16, 2020, which is a continuation of application Ser. No. 16/820,136, filed Mar. 16, 2020, now U.S. Pat. No. 10,874,919, which is a continuation of application Ser. No. 16/590,105, filed Oct. 1, 2019, now U.S. Pat. No. 10,632, 349, which claims the benefit of U.S. Provisional Application No. 62/908,467, filed Sep. 30, 2019, U.S. Provisional Application No. 62/903,467, filed Sep. 20, 2019, U.S. Provisional Application No. 62/877,934, filed Jul. 24, 2019, U.S. Provisional Application No. 62/877,915, filed Jul. 24, 2019, U.S. Provisional Application No. 62/865,532, filed Jun. 24, 2019, U.S. Provisional Application No. 62/826,310, filed Mar. 29, 2019, and U.S. Provisional Application No. 62/814,959, filed Mar. 7, 2019.

U.S. application Ser. No. 17/161,987, filed Jan. 29, 2021, is a continuation-in-part of application Ser. No. 16/789,167, filed Feb. 12, 2020, now U.S. Pat. No. 10,933,286.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
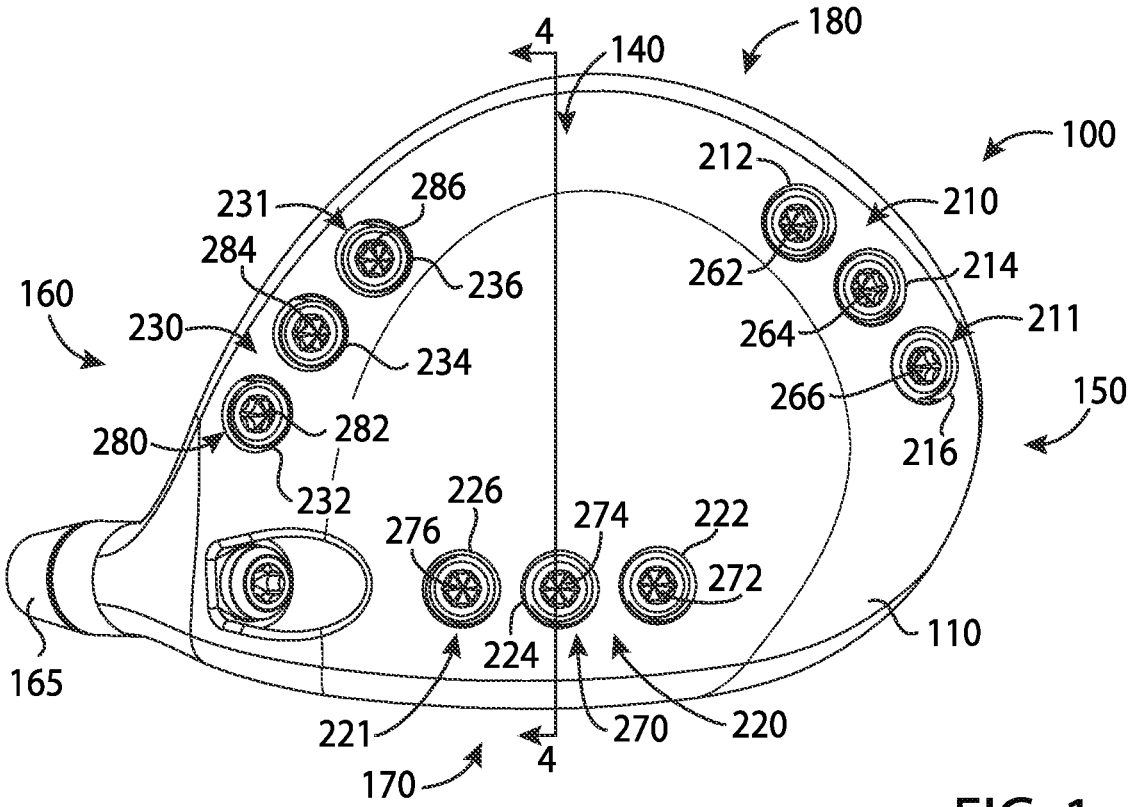
FIGS. 1, 2, 3, and 4 depict a bottom perspective view, a toe-side perspective view, a heel-side perspective view, and a cross-sectional perspective view (along line 4-4 of FIG. 1), respectively, of a golf club head according to an embodiment of the apparatus, methods, and articles of manufacture described herein.
Figure 2:
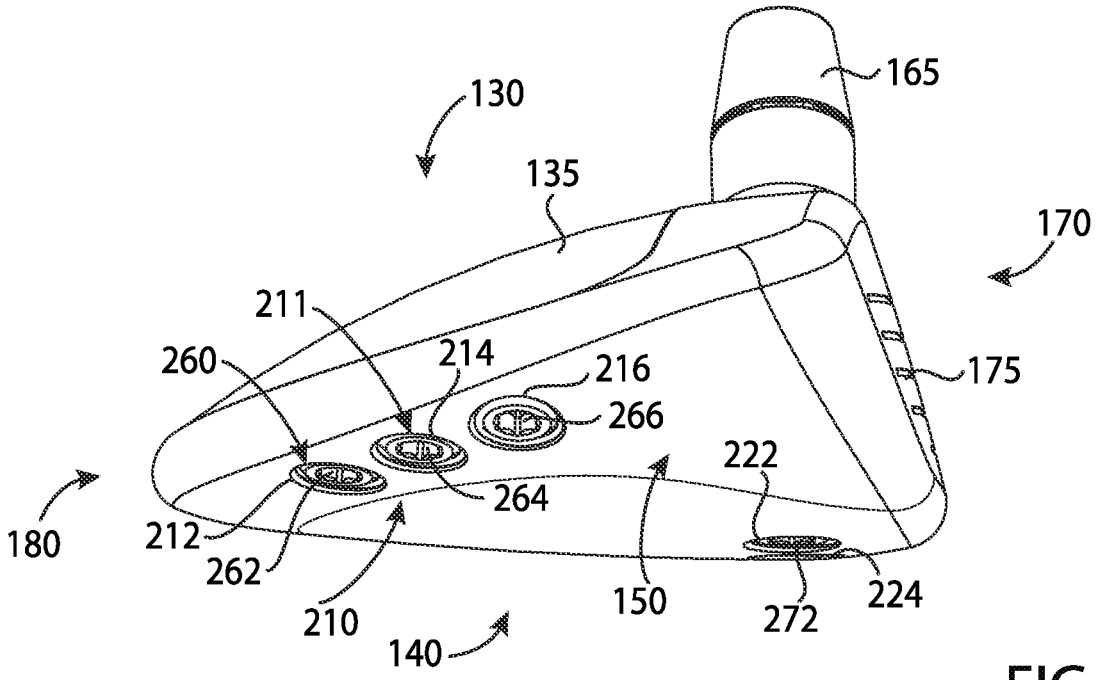
Figure 3:
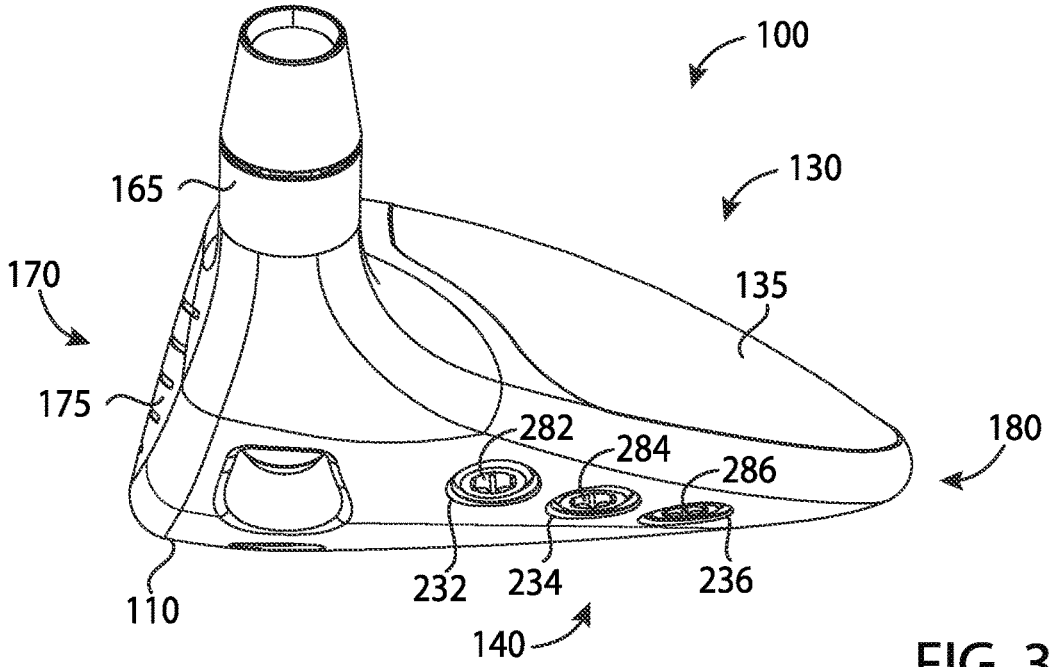

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads, golf clubs, and methods to manufacture golf club heads and golf clubs are described herein. The apparatus, methods, and articles of manufacture described herein are not limited in this regard.

In the example of FIGS. 1-4, a golf club head 100 may include a body portion 110 with a top portion 130 having a crown portion 135, a bottom portion 140, a toe portion 150, a heel portion 160, a front portion 170, and a rear portion 180. The crown portion 135 may be a separate piece that may be attached to the top portion 130 and constructed from a composite material. The bottom portion 140 may include a skirt portion (not shown) defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The front portion 170 may include a face portion 175 to engage a golf ball (not shown). The golf club head 100 may have a neutral axis 401. The neutral axis 401 may be perpendicular to the face portion 175 and may intersect a center of the face portion 175. The body portion 110 may also include a hosel portion 165 for receiving a shaft (not shown). Alternatively, the body portion 110 may include a bore instead of the hosel portion 165. The body portion 110 may be made from any one or a combination of materials described herein or described in any of the incorporated by reference applications. A maximum front-to-rear distance of the golf club head 100 may be greater than a maximum heel-to-toe distance of the golf club head 100. Although FIGS. 1-4 may depict a particular type of golf club head (e.g., driver-type club head), the apparatus methods, and articles of manufacture described herein may be applicable to other types of club heads (e.g., a fairway wood-type club head, a hybrid-type club head, an iron-type club head, a putter-type club head). The apparatus, methods, and articles of manufacture described herein are not limited in this regard.

The bottom portion 140 may include a plurality of port regions, which are shown for example as a first port region 210 with a first set of ports 211 (generally shown as ports 212, 214, and 216) near the toe portion 150, a second port region 220 with a second set of ports 220 (generally shown as ports 222, 224, and 226) near the front portion 170, and a third port region 230 with a third set of ports 231 (generally shown as ports 232, 234, and 236) near the heel portion 160. Although FIGS. 1-4 show a certain configuration of port regions and ports, the number of port regions, the number and configuration of ports in each region, and the location of the ports may be similar to any of the golf club heads described herein on in any of the incorporated by reference applications. The body portion 110 may also include a plurality of mass portions, shown as a first set of mass portions 260 (generally shown as mass portions 262, 264, and 266), a second set of mass portions 270 (generally shown as mass portions 272, 274, and 276), and a third set of mass portions 280 (generally shown as mass portions 282, 284 and 286). Each port may interchangeably receive any of the mass portions. The masses of the first set of mass portion 260, the second set of mass portions 270 and/or the third set of mass portions 280 may be similar or different. Accordingly, by using mass portions having similar or different masses in each of the ports of the port regions 210, 220 and/or 230, the overall mass in each port region and/or the mass distribution in each port region may be adjusted as described herein and in any of the incorporated by reference applications to generally optimize and/or adjust the swing weight, center of gravity, moment of inertia, and/or an overall feel of the golf club head for an individual using the golf club head 100. The apparatus, methods, and articles of manufacture described herein are not limited in this regard.

Figure 4:
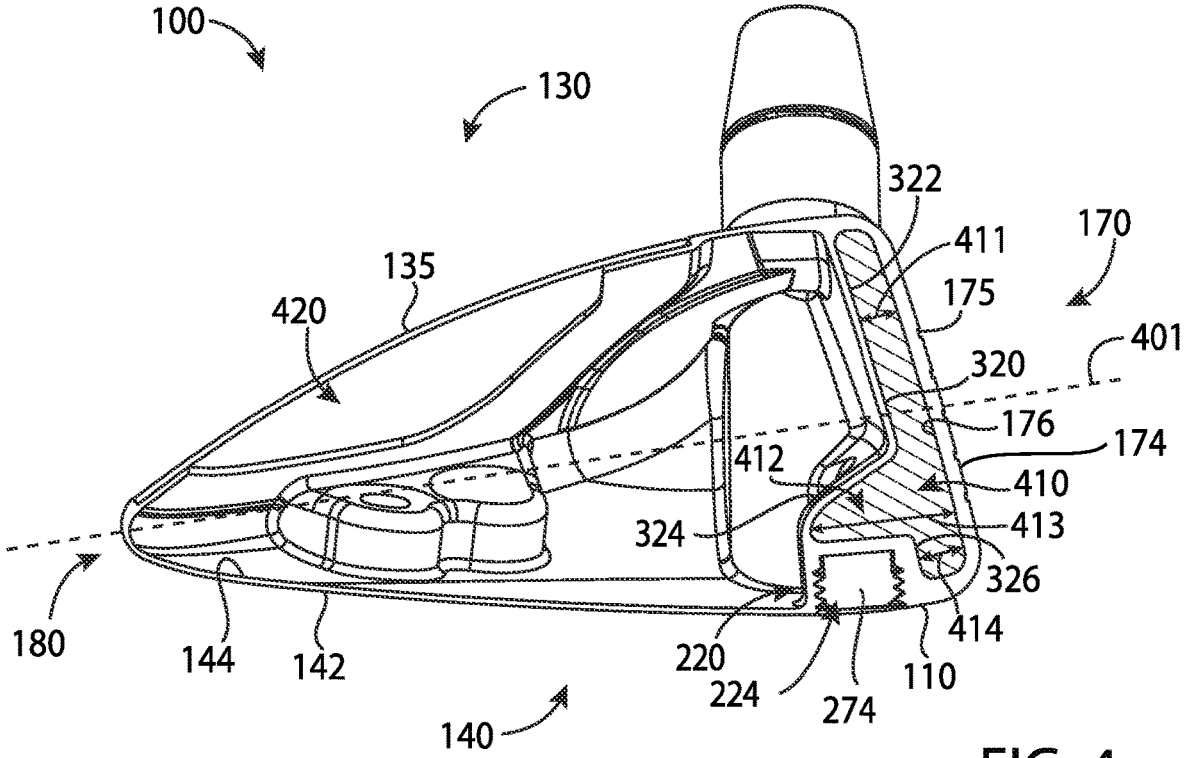

Certain regions of the interior of the body portion 110 may include a polymer material, which may also be referred to herein as the filler material, similar to any of the polymer materials described herein or described in any of the incorporated by reference applications. The filler material may dampen vibration, dampen noise, lower the center of gravity and/or provide a better feel and sound for the golf club head 100 when striking a golf ball (not shown). The golf club head 100, may have one or more interior regions and/or cavities that may include a filler material similar to any of the golf club heads described herein or described in any of the incorporated by reference applications. In one example, as shown in FIG. 4, the body portion 110 may include a cavity wall portion 320. The cavity wall portion 320 may form a first interior cavity portion 410 and a second interior cavity portion 420 within the body portion 110. The first interior cavity portion 410 and the second interior cavity portion 420 may be separated by the cavity wall portion 320. Alternatively, the first interior cavity portion 410 and the second interior cavity portion 420 may be connected through one or more openings in the cavity wall portion 320. The apparatus, methods, and articles of manufacture described herein are not limited in this regard.

As illustrated in FIG. 4, the cavity wall portion 320 may include a first portion 322 extending from a location at or proximate to the top portion 130 toward the bottom portion 140. The first portion 322 may extend toward the bottom portion 140 at a certain angle or orientation relative to the face portion 175. In one example, the first portion 322 may extend toward the bottom portion 140 and away from the face portion 175. Accordingly, a first width 411 ($W_{C1}$) of the first interior cavity portion 410 may increase in a direction from the top portion 130 to the bottom portion 140. In another example, the first portion 322 may extend toward the bottom portion 140 and toward the face portion 175. Accordingly, the first width 411 of the first interior cavity portion 410 may decrease in a direction from the top portion 130 to the bottom portion 140. In the illustrated example of FIG. 4, the first portion 322 of the of the cavity wall portion 320 may extend from a location at or proximate to the top portion 130 generally parallel or substantially parallel with the face portion 175. Accordingly, the first width 411 of the first interior cavity portion 410 may be constant or substantially constant. The apparatus, methods, and articles of manufacture described herein are not limited in this regard.

The first interior cavity portion 410 may include an enlarged cavity portion 412 between the top portion 130 and the bottom portion 140. As shown in the illustrated example of FIG. 4, the enlarged cavity portion 412 extends partially or fully over the second port region 220. Accordingly, the enlarged cavity portion 412 may have a second width 413 ($W_{C2}$) of the first interior cavity portion 410 that may be greater than the first width 411 of the first interior cavity portion 410. The second width 413 may be about two times greater than the first width 411. The second width 413 may be at least two times greater than the first width 411. The enlarged cavity portion 412 may be located at least partially below the neutral axis 401 of the golf club head 100. The enlarged cavity portion 412 may be located wholly below a neutral axis 401 of the golf club head 100. The first width 411 may be located above the neutral axis 401. The second width 413 may be located below the neutral axis 401. The enlarged cavity portion 412 may be defined by a second wall portion 324 that may extend from the first wall portion 322 toward the rear portion 180 and the bottom portion 140, and traverse back over the second port region 220. The first interior cavity portion 410 may include a third wall portion 326 that extends from the second wall portion 324 to a location at or proximate to the bottom portion 140. The first interior cavity portion 410 may have a third width 414 ($W_{C3}$) extending from the third wall portion 326 to the back surface 176 of the face portion 175. The third width 414 may be located below the enlarged cavity portion 412. The third width 414 may be located below the second width 413. The third width 414 may be less than the second width 413. The third width 414 may be substantially equal to the first width 411. As shown in the illustrated example of FIG. 4, the third width 414 may be located between the second port region 220 and the face portion 175. The third width 414 may be located proximate to the bottom portion. In another example, the first width 411 may be similar to the second width 413 of the first interior cavity portion 410 (not shown). Accordingly, the first wall portion 322 of the cavity wall portion 320 may located farther back toward the rear portion 180 than the location of the first wall portion 322 shown in FIG. 4 such that the portion of the first interior cavity portion 410 above the second port region 220 extends over the one or more ports of the second port region 220. In other examples, the first interior cavity portion 410 may be configured similar any of the interior cavities described herein and shown in FIGS. 5-13. The apparatus, methods, and articles of manufacture described herein are not limited in this regard.

In one example, the first interior cavity portion 410 may be unfilled (i.e., empty space). Alternatively, the first interior cavity portion 410 may be partially (i.e., less than 100% filled) or entirely filled with a filler material (i.e., a cavity filling portion) to absorb shock, isolate vibration, dampen noised, and/or provide structural support for the face portion. For example, at least 50% of the first interior cavity portion 410 may be filled with a TPE material to absorb shock, isolate vibration, and/or dampen noise when the golf club head 100 strikes a golf ball via the face portion 175. In one example, the first interior cavity portion 410 may be partially or entirely filled with a filler material through a port (e.g. port 224) located in the bottom portion 140. In one example, as shown in FIG. 4, the port 224 may include an opening that accesses the first interior cavity portion 410. The opening may provide a fluid pathway for filler material to be introduced to the first interior cavity portion 410. The apparatus, methods, and articles of manufacture described herein are not limited in this regard.

When the face portion 175 of the golf club head 100 strikes a golf ball, the face portion 175 and the filler material may deform and/or compress. The kinetic energy of the impact may be transferred to the face portion 175 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 100. The apparatus, methods, and articles of manufacture described herein are not limited in this regard.

With the support of the cavity wall portion 320 to form the first interior cavity portion 410 and filling at least a portion of the first interior cavity portion 410 with a filler material, the face portion 175 may be relatively thin without degrading the structural integrity, sound, and/or feel of the golf club head 100. In one example, the face portion 175 may have a thickness of less than or equal to 0.075 inch (e.g., a distance between a front surface 174 and the back surface 176). In another example, the face portion 175 may have a thickness of less than or equal to 0.2 inch. In another example, the face portion 175 may have a thickness of less than or equal to 0.06 inch. In yet another example, the face portion 175 may have a thickness of less than or equal to 0.05 inch. Further, the face portion 175 may have a thickness of less than or equal to 0.03 inch. In yet another example, a thickness of the face portion 175 may be greater than or equal to 0.03 inch and less than or equal to 0.2 inch. The apparatus, methods, and articles of manufacture described herein are not limited in this regard.

In the illustrated example of FIGS. 1-4, the second interior cavity portion 420 may be unfilled (i.e., empty space). Alternatively (not shown), the second interior cavity portion 420 may be partially or entirely filled with a filler material (i.e., a cavity filling portion), which may include one or more similar or different types of materials described herein and may be different or similar to the filler material used to fill the first interior cavity portion 410. The apparatus, methods, and articles of manufacture described herein are not limited in this regard.

Figure 5:
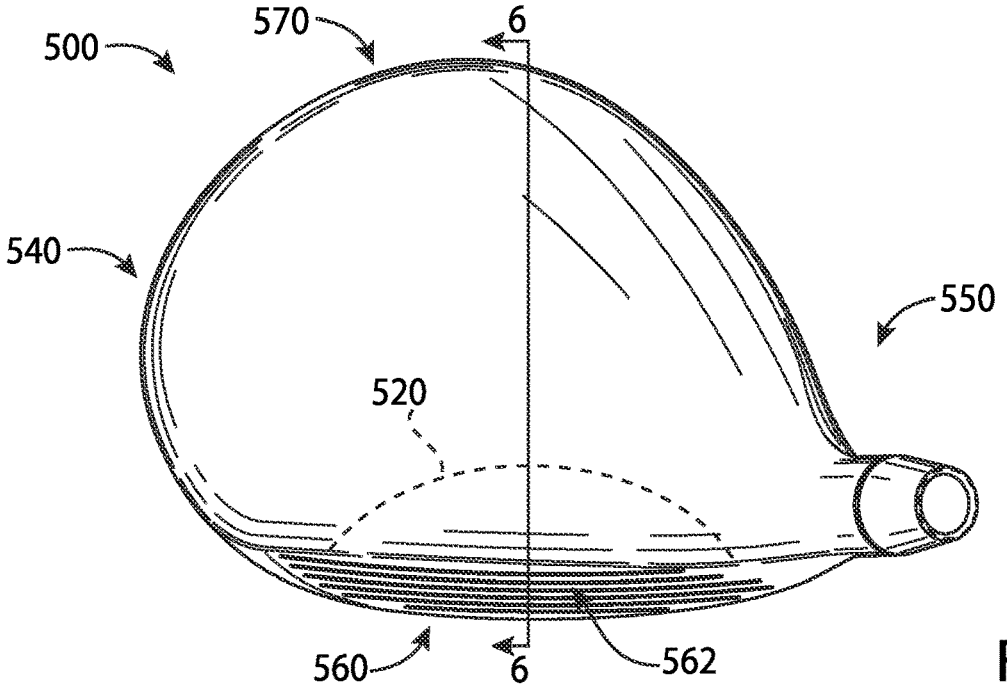
FIGS. 5, 6, and 7 depict a top view, a schematic cross-sectional view (along line 6-6 of FIG. 5), and a front view, respectively, of a golf club head according to an embodiment of the apparatus, methods, and articles of manufacture described herein.
Figure 6:
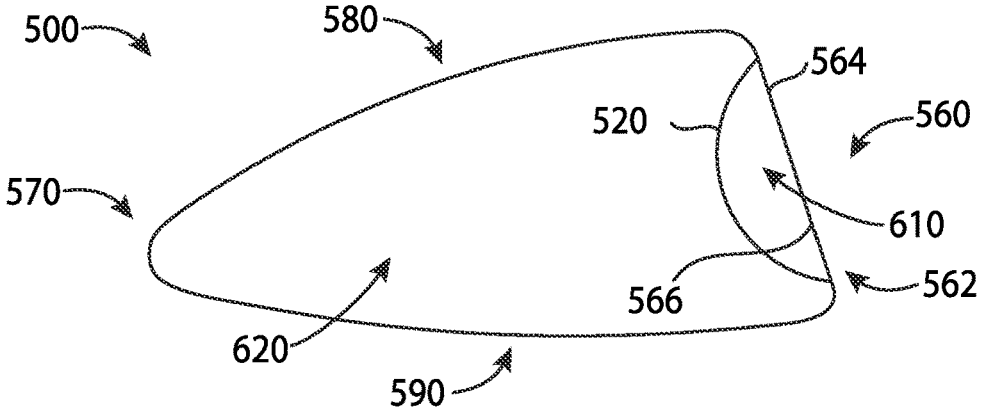
Figure 7:
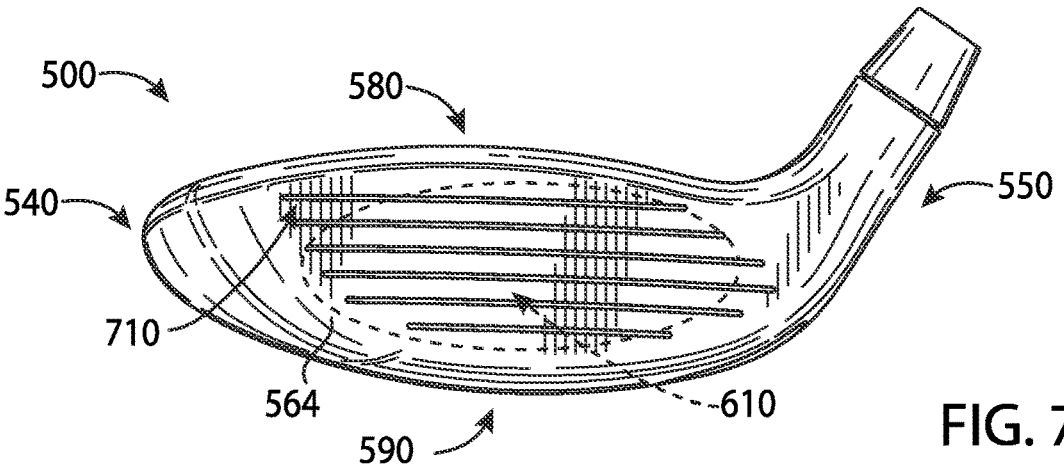

While each of the examples herein may describe a certain type of golf club head, the apparatus, methods, and articles of manufacture described herein may be applicable to other types of golf club heads. Referring to FIGS. 5-7, for example, a golf club head 500 may include a body portion 510 and a cavity wall portion 520. Although FIGS. 5-7 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 510 may include a toe portion 540, a heel portion 550, a front portion 560, a rear portion 570, a top portion 580 (e.g., a crown portion), and a bottom portion 590 (e.g., a sole portion). The front portion 560 may include a face portion 562 (e.g., a strike face). The face portion 562 may include a front surface 564 and a back surface 566. The front surface 564 may include a plurality of grooves, generally shown as 710 in FIG. 7. The cavity wall portion 520 may form a first interior cavity portion 610 and a second interior cavity portion 620 within the body portion 510. As illustrated in FIG. 6, for example, the cavity wall portion 520 may extend from the back surface 566 of the face portion 562. The cavity wall portion 520 may be a single curved wall section. In particular, the cavity wall portion 520 may have a convex arc profile relative to the back surface 566 (e.g., C shape) to form a dome-like structure with an elliptical base (e.g., FIG. 7) or a circular base on the back surface 566. In another example, the cavity wall portion 520 may form a cone-like structure or a cylinder-like structure with the body portion 510. Alternatively, the cavity wall portion 520 may be a concave arc profile relative to the back surface 566. The apparatus, methods, and articles of manufacture described herein are not limited in this regard.

The first interior cavity portion 610 may be partially or entirely filled with a suitable filler material such as any of the filler materials described herein or described in any of the incorporated by reference applications to absorb shock, isolate vibration, dampen noise, and/or provide structural support. The elastic polymer material may be injected into the first interior cavity portion 610 via an injection molding process via a port on the face portion 562. With the support of the cavity wall portion 520 to form the first interior cavity portion 610 and filling at least a portion of the first interior cavity portion 610 with an elastic polymer material, the face portion 562 may be relatively thin without degrading the structural integrity, sound, and/or feel of the golf club head 500. The apparatus, methods, and articles of manufacture described herein are not limited in this regard.

Figure 8:
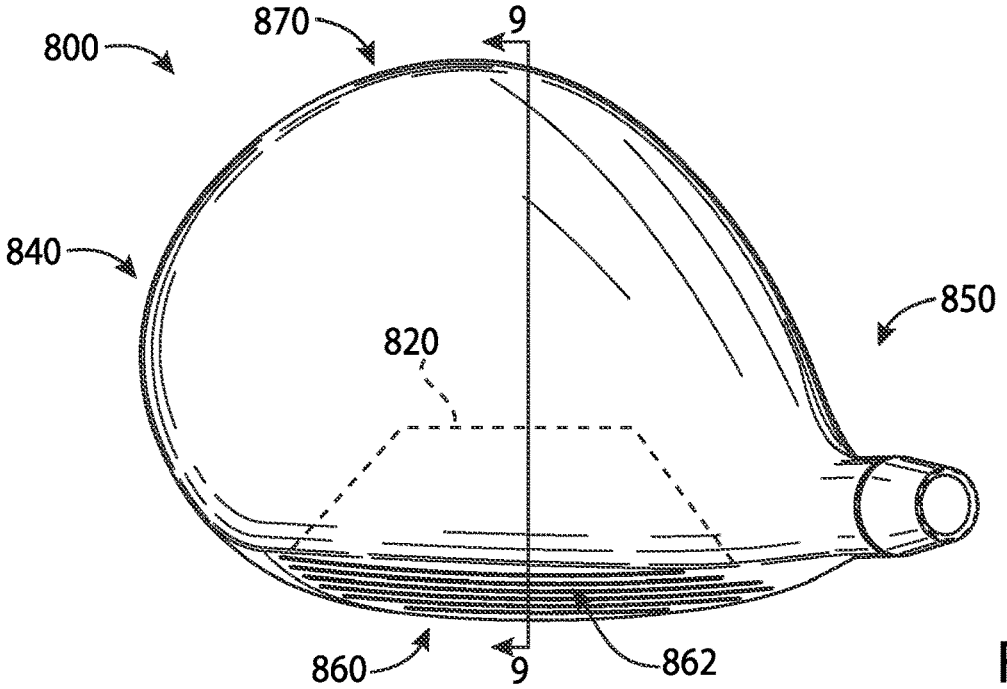
FIGS. 8, 9, and 10 depict a top view, a schematic cross-sectional view (along line 9-9 of FIG. 8), and a front view, respectively, of a golf club head according to an embodiment of the apparatus, methods, and articles of manufacture described herein.
Figure 9:
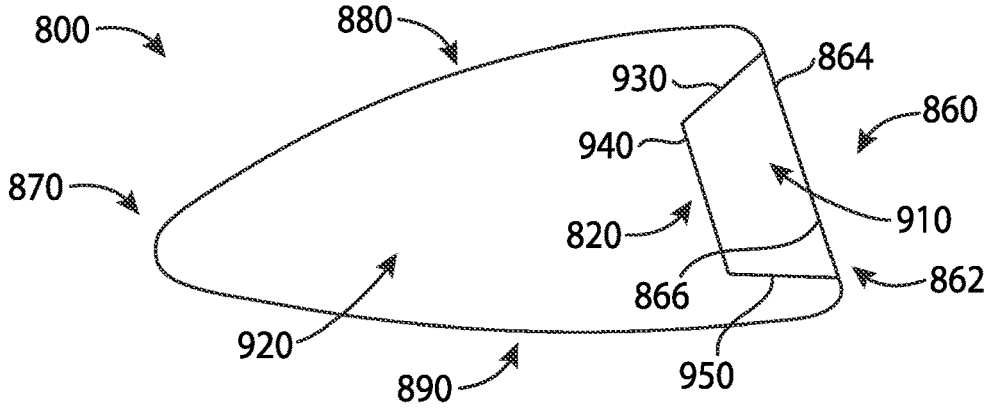
Figure 10:
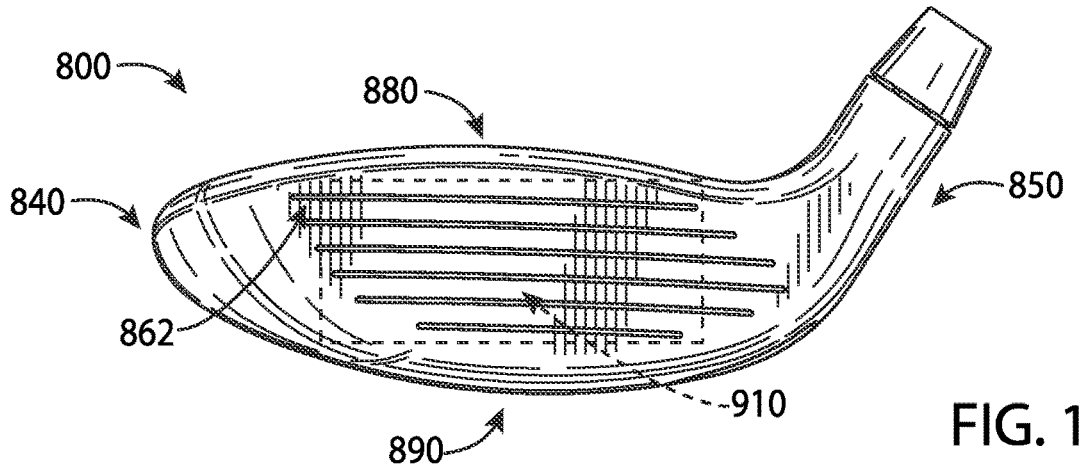

The cavity wall portion 520 may include multiple sections. Turning to FIGS. 8-10, for example, a golf club head 800 may include a body portion 810 and a cavity wall portion 820. The body portion 810 may include a toe portion 840, a heel portion 850, a front portion 860, a rear portion 870, a top portion 880 (e.g., a crown portion), and a bottom portion 890 (e.g., a sole portion). The front portion 860 may include a face portion 862 (e.g., a strike face) with a front surface 864 and a back surface 866. The cavity wall portion 820 may extend from the back surface 866 to form a first interior cavity portion 910 and a second interior cavity portion 920 within the body portion 810. The cavity wall portion 820 may include two or more wall sections, generally shown as 930, 940, and 950 in FIG. 9. Similar to the first interior cavity portion 610 (FIGS. 5-7), the first interior cavity portion 910 may be partially or entirely filled with a filler material. The filler material may be injected into the first interior cavity portion 910 via an injection molding process via a port on the face portion 862. The apparatus, methods, and articles of manufacture described herein are not limited in this regard.

Figure 11:
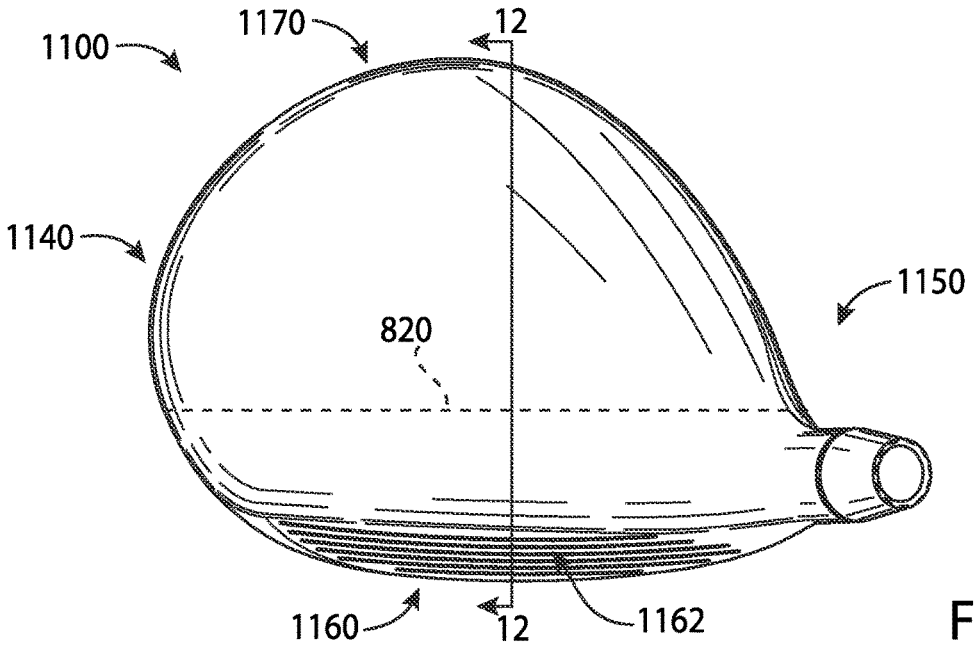
FIGS. 11, 12, and 13 depict a top view, a schematic cross-sectional view (along line 12-12 of FIG. 11), and another schematic cross-sectional view (along line 12-12 of FIG. 11), respectively, of a golf club head according to an embodiment of the apparatus, methods, and articles of manufacture described herein.
Figure 12:
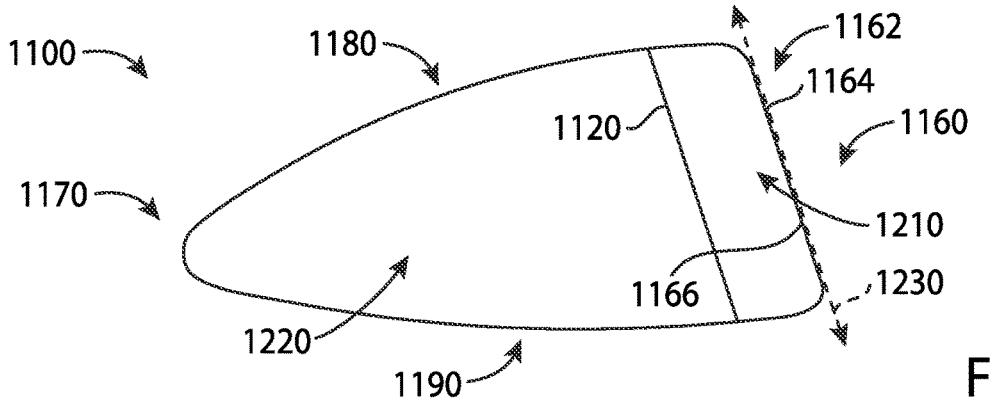
Figure 13:
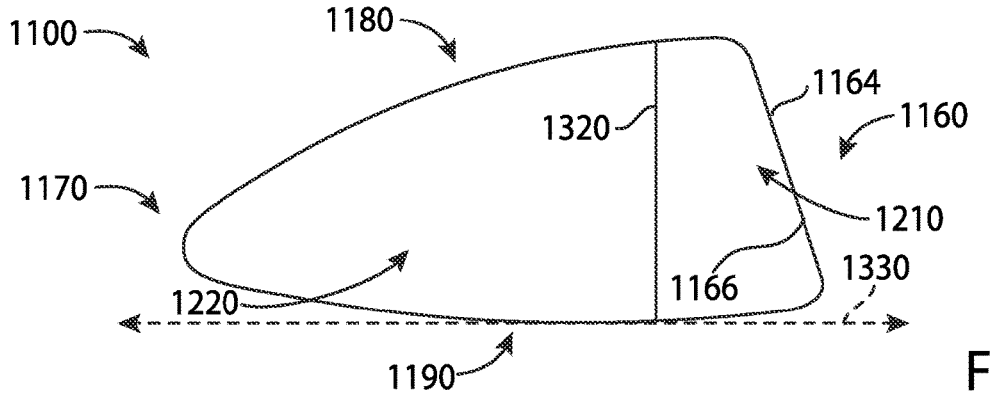
Figure 14:
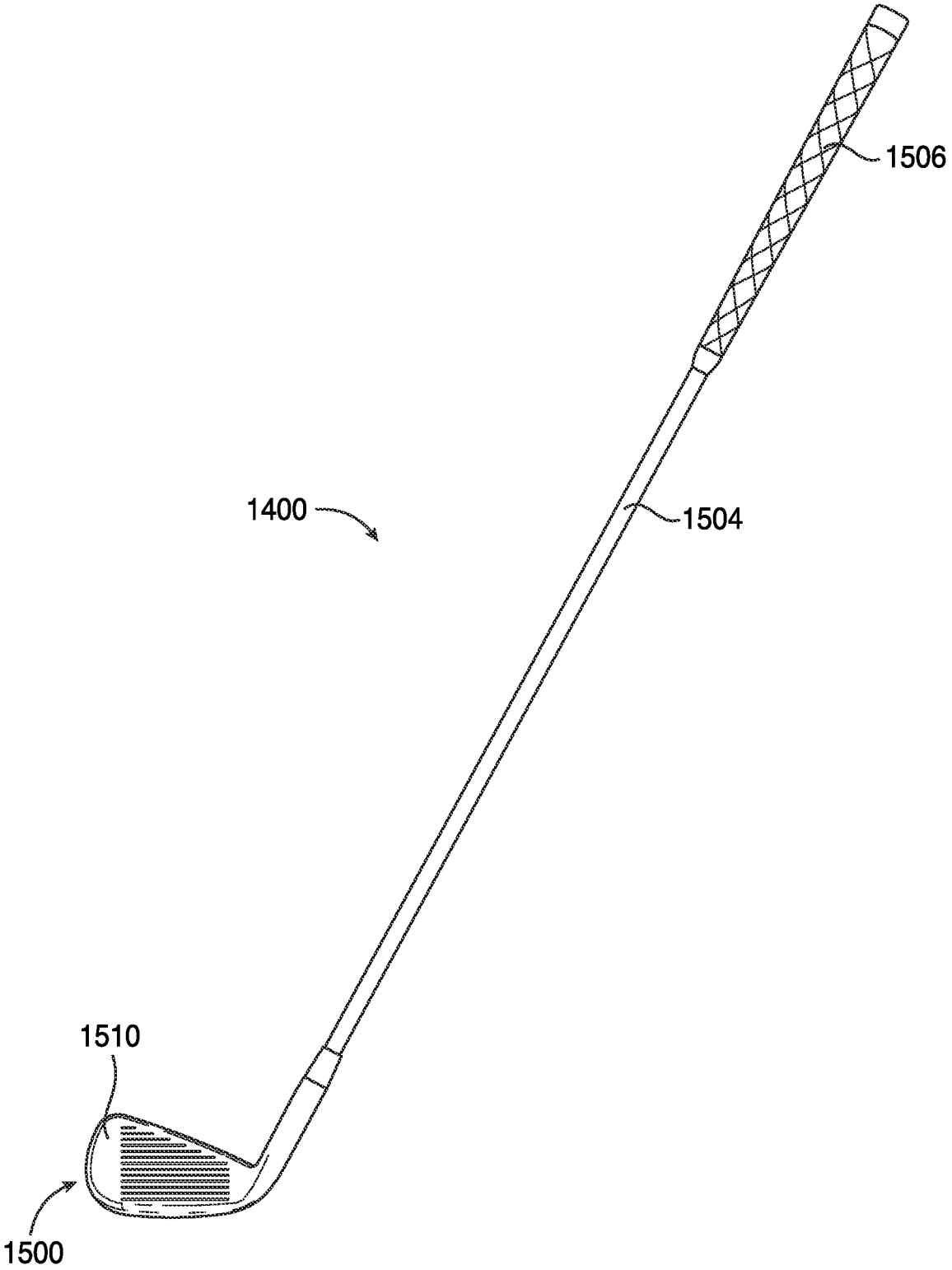
FIG. 14 depicts a front view of a golf club according to an embodiment of the apparatus, methods, and articles of manufacture described herein.

As illustrated in FIGS. 11 and 12, for example, a golf club head 1100 may include a body portion 1110 and a cavity wall portion 1120. The body portion 1110 may include a toe portion 1140, a heel portion 1150, a front portion 1160, a rear portion 1170, a top portion 1180 (e.g., a crown portion), and a bottom portion 1190 (e.g., a sole portion). The front portion 1160 may include a face portion 1162 (e.g., a strike face) with a front surface 1164 and a back surface 1166. The face portion 1162 may be associated with a loft plane 1230 that defines the loft angle of the golf club head 1100. The cavity wall portion 1120 may be a single flat wall section. In particular, the cavity wall portion 1120 may extend between the toe portion 1140 and the heel portion 1150 and between the top portion 1180 and the bottom portion 1190 to form a first interior cavity portion 1210 and a second interior cavity portion 1220 within the body portion 1110. The cavity wall portion 1120 may be parallel or substantially parallel to the loft plane 1230. Alternatively, as shown in FIG. 13, a cavity wall portion 1320 may be perpendicular or substantially perpendicular to a ground plane 1330. Similar to the interior cavity 610 portion (FIGS. 5-7) and interior cavity 910 portion (FIGS. 8-10), the first interior cavity portion 1210 may be partially or entirely filled with an elastic polymer or elastomer material. The elastic polymer material may be injected into the first interior cavity portion 1210 via an injection molding process via a port on the face portion 1162 and/or the bottom portion 1190 as described herein or described in any of the incorporated by reference applications. The apparatus, methods, and articles of manufacture described herein are not limited in this regard.

Alternatively, the cavity wall portion 1120 may extend between the bottom portion 1190 and a top-and-front transition region (i.e., a transition region between the top portion 1180 and the front portion 1160) so that the cavity wall portion 1120 and the loft plane 1230 may not be parallel to each other. In another example, the cavity wall portion 1120 may extend between the top portion 1180 and a bottom-and-front transition region (i.e., a transition region between the bottom portion 1190 and the front portion 1160) so that the cavity wall portion 1120 and the loft plane 1230 may be not parallel to each other. Although FIGS. 11-13, may depict the cavity wall portions 1120 and 1320 being flat or substantially flat, the cavity wall portions 1120 and/or 1320 may be concave or convex relative to the face portion 1162. The apparatus, methods, and articles of manufacture described herein are not limited in this regard.

While above examples may describe a cavity wall portion dividing an interior cavity of a hollow body portion to form two separate interior cavities with one interior cavity partially or entirely filled with an elastic polymer material, the apparatus, methods, and articles of manufacture described herein may include only one interior cavity that may be empty, partially filled, or fully filled, or two or more cavity wall portions dividing an interior cavity of a hollow body portion to form three or more separate interior cavities with at least two interior cavities partially or entirely filled with an elastic polymer material. In one example, one interior cavity may be partially or entirely filled with a TPE material whereas another interior cavity may be partially or entirely filled with a TPU material. The apparatus, methods, and articles of manufacture described herein are not limited in this regard.

In the example of FIGS. 14-35, a golf club 1400 may include a golf club head 1500, a shaft 1504, and a grip 1506. The golf club head 1500 may be attached to one end of the shaft 1504 and the grip 1506 may be attached to the opposite end of the shaft 1504. An individual can hold the grip 1506 and swing the golf club head 1500 with the shaft 1504 to strike a golf ball (not shown). The golf club head 1500 may include a body portion 1510 (FIG. 15) having a toe portion 1540, a heel portion 1550, a front portion 1560 with a face portion 1562 (e.g., a strike face) having a front surface 1564 and a back surface 1566, a back portion 1570, a top portion

1580, and a sole portion 1590. The toe portion 1540, the heel portion 1550, the front portion 1560, the back portion 1570, the top portion 1580, and/or the sole portion 1590 may partially overlap each other. For example, a portion of the toe portion 1540 may overlap portion(s) of the front portion 1560, the back portion 1570, the top portion 1580, and/or the sole portion 1590. In a similar manner, a portion of the heel portion 1550 may overlap portion(s) of the front portion 1560, the back portion 1570, the top portion 1580, and/or the sole portion 1590. In another example, a portion of the back portion 1570 may overlap portion(s) of the toe portion 1540, the heel portion 1550, the top portion 1580, and/or the sole portion 1590. The apparatus, methods, and articles of manufacture described herein are not limited in this regard.

The golf club head 1500 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). Although FIGS. 15-32 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The golf club head 1500 may have a club head volume less than or equal to 300 cubic centimeters ($cm^3$ or cc). In one example, the golf club head 1500 may have a club head volume greater than or equal to 20 cc and less than or equal to 90 cc. In another example, the golf club head 1500 may have a club head volume greater than or equal to 100 cc and less than or equal to 200 cc. Alternatively, the golf club head 1500 may have a club head volume greater than 300 cc. In one example, the golf club head 1500 may have a club head volume of about 460 cc. In another example, the golf club head 1500 may have a club head volume greater than 500 cc. The club head volume of the golf club head 1500 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 1500. The apparatus, methods, and articles of manufacture described herein are not limited in this regard.

The toe portion 1540 may include a portion of the body portion 1510 opposite of the heel portion 1550. The heel portion 1550 may include a hosel portion 1555 configured to receive the shaft 1504 to form the golf club 1400. The front surface 1564 of the face portion 1562 may include one or more score lines, slots, or grooves 1568 extending to and/or between the toe portion 1540 and the heel portion 1550. While the figures may depict a particular number of grooves, the apparatus, methods, and articles of manufacture described herein may include more or less grooves.

The face portion 1562 may be used to impact a golf ball (not shown). The face portion 1562 may be an integral portion of the body portion 1510. Alternatively, the face portion 1562 may be a separate piece or an insert coupled to the body portion 1510 via various manufacturing methods and/or processes (e.g., a bonding process such as adhesive, a welding process such as laser welding, a brazing process, a soldering process, a fusing process, a mechanical locking or connecting method, any combination thereof, or other suitable types of manufacturing methods and/or processes). The face portion 1562 may be associated with a loft plane 1567 that with a vertical plane 1596 defines the loft angle 1569 of the golf club head 1500. The loft angle 1569 may vary based on the type of golf club (e.g., a long iron, a middle iron, a short iron, a wedge, etc.). In one example, the loft angle 1569 may be between five degrees and seventy-five degrees. In another example, the loft angle 1569 may be between twenty degrees and sixty degrees. The apparatus, methods, and articles of manufacture described herein are not limited in this regard.

Figure 20:
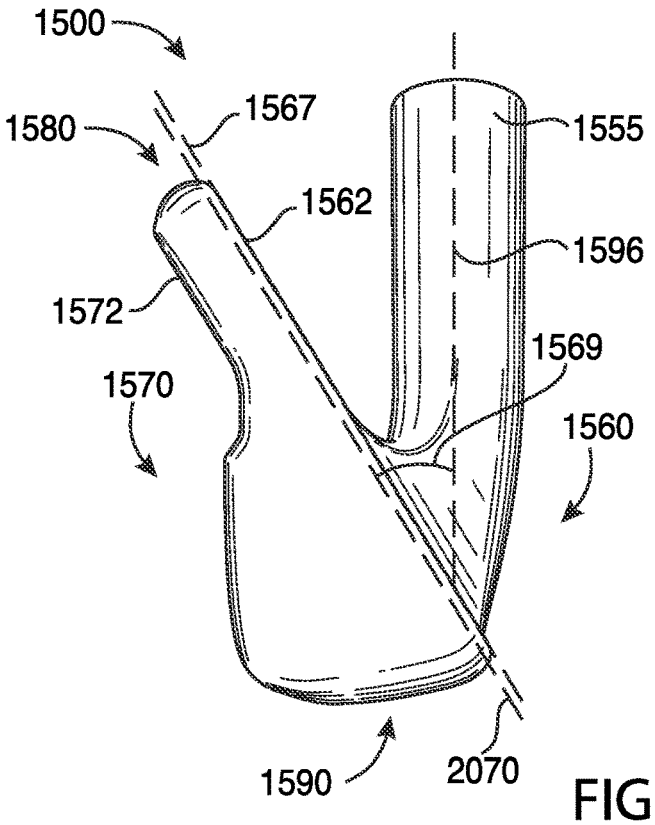

The back portion 1570 may include a portion of the body portion 1510 opposite of the front portion 1560. In one example, the back portion 1570 may be a portion of the body portion 1510 behind the back surface 1566 of the face portion 1562. As shown in FIG. 20, for example, the back portion 1570 may be a portion of the body portion 1510 behind a plane 2070 defined by the back surface 1566 of the face portion 1562. In another example, as shown in FIG. 20, the plane 2070 may be parallel to the loft plane 1567 of the face portion 1562. As mentioned above, for example, the face portion 1562 may be a separate piece or an insert coupled to the body portion 1510. Accordingly, the back portion 1570 may include remaining portion(s) of the body portion 1510 other than the face portion 1562. The apparatus, methods, and articles of manufacture described herein are not limited in this regard.

Figure 28:
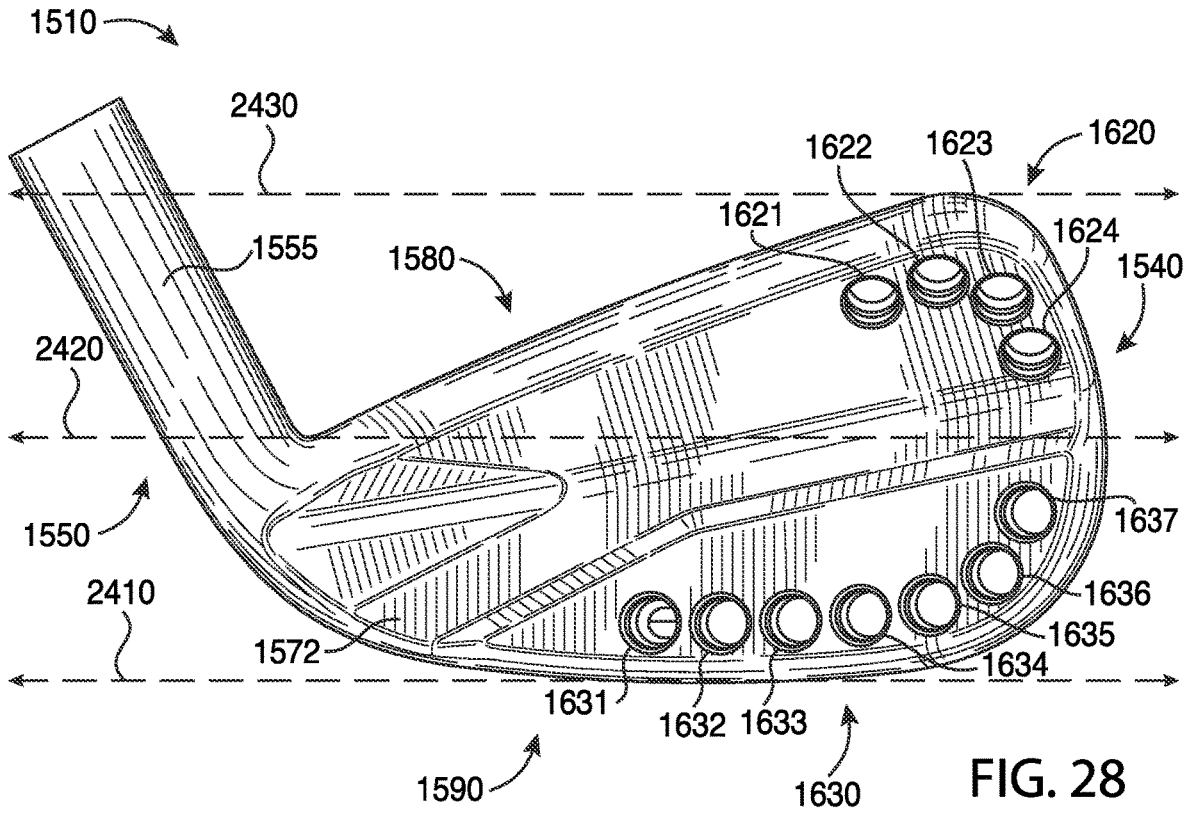
FIG. 28 depicts a rear view of the golf club head of FIG. 15.

Further, the body portion 1510 may include one or more ports, which may be exterior ports and/or interior ports (e.g., located inside the body portion 1510). The interior walls of the body portion 1510 may include one or more ports. In one example, the back portion 1570 may include one or more ports (e.g., inside an interior cavity, generally shown as 2100 in FIG. 21). In another example, the body portion 1510 may include one or more ports along a periphery of the body portion 1510. As illustrated in FIG. 28, for example, the body portion 1510 may include one or more ports on the back portion 1570, generally shown as a first set of ports 1620 (e.g., shown as ports 1621, 1622, 1623, and 1624) and a second set of ports 1630 (e.g., shown as ports 1631, 1632, 1633, 1634, 1635, 1636, and 1637). As also illustrated in FIG. 28, for example, each port may have an opening on a back wall portion 1572 of the back portion 1570. One or more ports may be associated with a port diameter, which may be defined as the largest distance to and/or between opposing ends or boundaries of a port. For example, a port diameter for a rectangular port (e.g., a slot, slit, or elongated rectangular opening) may refer to a diagonal length of a rectangle. In another example, a port diameter of an elliptical port may refer to the major axis of an ellipse. As shown in FIG. 28, for example, each port may have a circular shape with a port diameter equivalent to a diameter of a circle. In one example, the port diameter of the first set of ports 1620 and/or the second set of ports 1630 may be about 0.25 inch (6.35 millimeters). In another example, the port diameter of the first set of ports 1620 and/or second set of ports 1630 may be greater than or equal to 0.1 inch (2.54 millimeters) and less than or equal to 0.4 inch (10.16 millimeters). Any two adjacent ports of the first set of ports 1620 may be separated by less than or equal to the port diameter. In a similar manner, any two adjacent ports of the second set of ports 1630 may be separated by less than or equal to the port diameter. Some adjacent ports may be separated by greater than the port diameter. In one example shown in FIG. 28, the first set of ports 1620 and the second set of ports 1630 may have uniform port diameters to simplify and speed manufacturing by not requiring tooling changes when proceeding through a manufacturing sequence that involves (i) forming a first set of ports 1620 and (ii) forming a second set of ports 1630. In another example, certain ports formed in the body portion 1610 may have non-uniform port diameters to facilitate one of the various cavity filling processes described herein. More specifically, a port that extends from an exterior surface of the body portion 1510 into the interior cavity 2100 within the body may be enlarged to enhance the port's performance as a filling port by providing a larger cross-sectional area that supports a higher flow rate of filler material and thereby enables a shorter duration filling process. The apparatus, methods, and articles of manufacture described herein are not limited in this regard.

Figure 16:
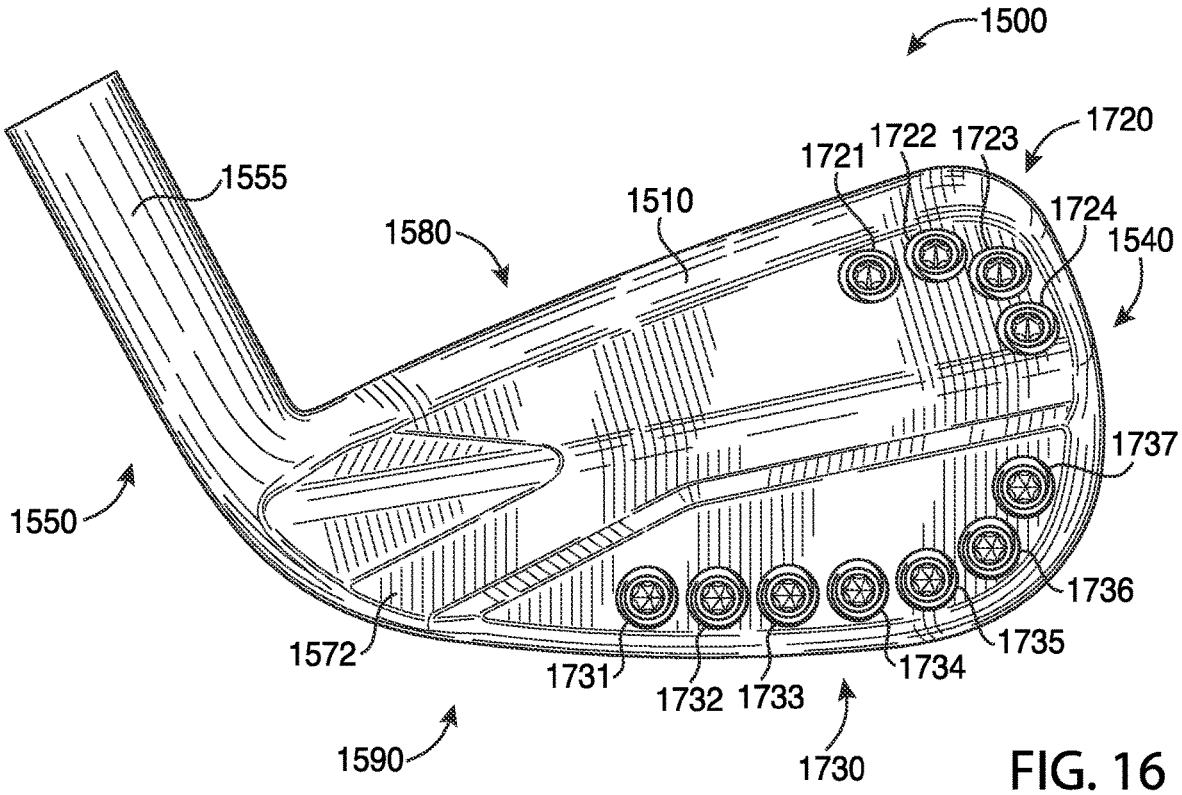
Figure 17:
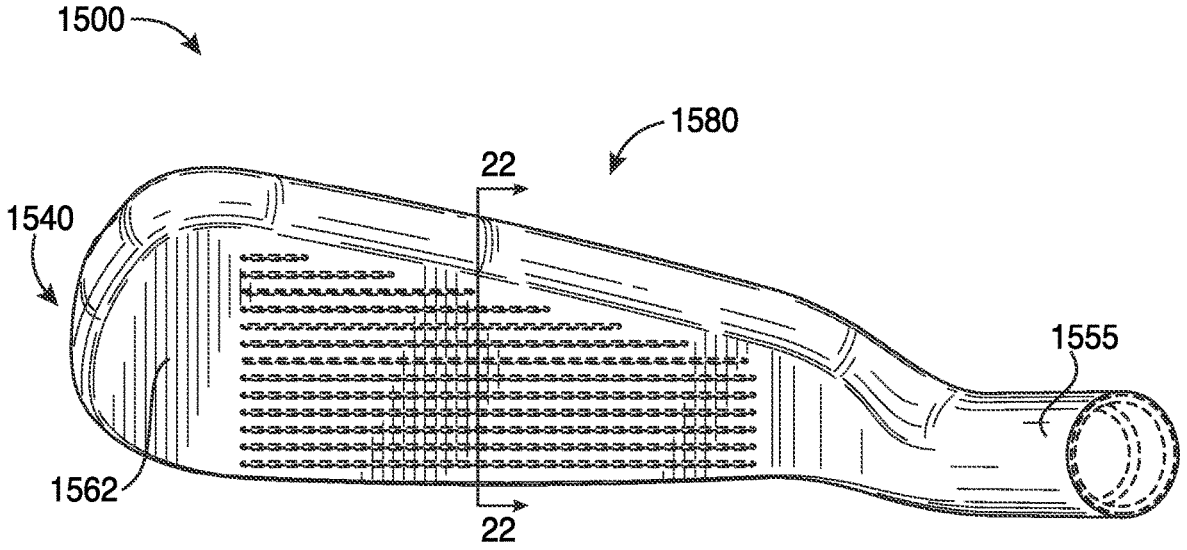

The body portion 1510 may include one or more mass portions (e.g., weight portion(s)), which may be integral mass portion(s) or separate mass portion(s) that may be coupled to the body portion 1510. In the illustrated example as shown in FIG. 16, the body portion 1510 may include a first set of mass portions 1720 (e.g., shown as mass portions 1721, 1722, 1723, and 1724) and a second set of mass portions 1730 (e.g., shown as mass portions 1731, 1732, 1733, 1734, 1735, 1736, and 1737). While the above example, may describe a particular number or portions of mass portions, a set of mass portions may include a single mass portion or a plurality of mass portions. For example, the first set of mass portions 1720 may be a single mass portion or a plurality of mass portions. In a similar manner, the second set of mass portions 1730 may be a single mass portion or a plurality of mass portions. Further, the first set of mass portions or the second set of mass portions 1730 may be a portion of the physical structure of the body portion 1510. The apparatus, methods, and articles of manufacture described herein are not limited in this regard.

The body portion 1510 may be made of a first material whereas the first set of mass portions 1720 and/or the second set of mass portions 1730 may be made of a second material. The first and second materials may be similar or different materials. For example, the body portion 1510 may be partially or entirely made of a steel-based material (e.g., 17-4 PH stainless steel, Nitronic® 50 stainless steel, alloy steel 8620, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. In one example, one or more mass portions of the first set of mass portions 1720 and/or the second set of mass portions 1730 may be partially or entirely made of a high-density material such as a tungsten-based material or other suitable types of materials. In another example, one more mass portions of the first set of mass portions 1720 and/or the second set of mass portions 1730 may be partially or entirely made of other suitable metal material such as a steel-based material, a titanium-based material, an aluminum-based material, any combination thereof, and/or other suitable types of materials. Further, one or more mass portions of the first set of mass portions 1720 and/or the second set of mass portions 1730 may be made of different types of materials (e.g., metal core and polymer sleeve surrounding the metal core). The body portion 1510, the first set of mass portions 1720, and/or the second set of mass portions 1730 may be partially or entirely made of similar or different non-metal materials (e.g., composite, plastic, polymer, etc.). The apparatus, methods, and articles of manufacture are not limited in this regard.

The body portion (e.g., one generally shown as 1510 in FIG. 15) and/or any other portion of a golf club head (e.g., one generally shown as 1500 in FIG. 15) according to any of the examples described herein may be constructed from stainless steel material to resist corrosion (e.g., corrosion resistant). In one example, all or one or more portions of the body portion 1510 and/or any other portion of the golf club head 1500 may be constructed by a forging process. Accordingly, stainless steel material from which all or portions of the body portion and/or any other portion of the golf club head are constructed may be a forgeable stainless steel material. The apparatus, methods, and articles of manufacture are not limited in this regard.

The apparatus, methods, and articles of manufacture described herein may use steel-based material with various ranges of material properties, such as density, tensile strength, yield strength, hardness, elongation, etc. (e.g., different type, grade, alloy, etc. of steel-based material). In one example, the density of steel-based material may be between and including 7.0 g/cm3 and 10.0 g/cm3. In another example, the density of steel-based material may be between and including 7.6 g/cm3 and 9.2 g/cm3. In yet another example, the density of steel-based material may be between and including 7.2 g/cm3 and 8.1 g/cm3. In yet another example, the density of steel-based material may be between and including 7.3 g/cm3 and 7.8 g/cm3. In yet another example, the density of steel-based material may be between and including 7.1 g/cm3 and 7.6 g/cm3. In yet another example, the density of steel-based material may be between and including 7.4 g/cm3 and 8.3 g/cm3. The apparatus, methods, and articles of manufacture described herein are not limited in this regard.

In one example, all or at least one or more portions of the body portion 1510 may be constructed with steel-based material having a tensile strength between and including 600 MPa and 1200 MPa (106 Pascal=106 N/m2). In another example, all or at least one or more portions of the body portion 1510 may be constructed with steel-based material having a tensile strength between and including 620 MPa and 900 MPa. In yet another example, the all or at least one or more portions of the body portion 1510 may be constructed with steel-based material having a tensile strength between and including 660 MPa and 800 MPa. In yet another example, all or at least one or more portions of the body portion 1510 may be constructed with steel-based material having a tensile strength between and including 680 MPa and 2140 MPa. In yet another example, all or at least one or more portions of the body portion 1510 may be constructed with steel-based material having a tensile strength between and including 640 MPa and 720 MPa. In yet another example, all or at least one or more portions of the body portion 1510 may be constructed with steel-based material having a tensile strength between and including 670 MPa and 770 MPa. The apparatus, methods, and articles of manufacture described herein are not limited in this regard.

In one example, all or at least one or more portions of the body portion 1510 may be constructed with steel-based material having a yield strength between and including 500 MPa and 1100 MPa. In another example, all or at least one or more portions of the body portion 1510 may be constructed with steel-based material having a yield strength between and including 520 MPa and 800 MPa. In yet another example, all or at least one or more portions of the body portion 1510 may be constructed with steel-based material having a yield strength between and including 560 MPa and 2100 MPa. In yet another example, all or at least one or more portions of the body portion 1510 may be constructed with steel-based material having a yield strength between and including 580 MPa and 690 MPa. In yet another example, all or at least one or more portions of the body portion 1510 may be constructed with steel-based material having a yield strength between and including 540

MPa and 660 MPa. In yet another example, all or at least one or more portions of the body portion 1510 may be constructed with steel-based material having a yield strength between and including 570 MPa and 670 MPa. The apparatus, methods, and articles of manufacture described herein are not limited in this regard.

In one example, all or at least one or more portions of the body portion 1510 may be constructed with steel-based material having a hardness between and including 10 and 50 HRC (Rockwell Hardness in the C scale). In another example, all or at least one or more portions of the body portion 1510 may be constructed with steel-based material having a hardness between and including 15 and 40 HRC. In yet another example, all or at least one or more portions of the body portion 1510 may be constructed with steel-based material having a hardness between and including 22 and 30 HRC. In yet another example, all or at least one or more portions of the body portion 1510 may be constructed with steel-based material having a hardness between and including 12 and 38 HRC. In yet another example, all or at least one or more portions of the body portion 1510 may be constructed with steel-based material having a hardness between and including 17 and 33 HRC. In yet another example, all or at least one or more portions of the body portion 1510 may be constructed with steel-based material having a hardness between and including 11 and 31 HRC. The apparatus, methods, and articles of manufacture described herein are not limited in this regard.

In one example, all or at least one or more portions of the body portion 1510 may be constructed with steel-based material having an elongation between and including 5% and 50%. In another example, all or at least one or more portions of the body portion 1510 may be constructed with steel-based material having an elongation between and including 10% and 40%. In yet another example, all or at least one or more portions of the body portion 1510 may be constructed with steel-based material having an elongation between and including 13% and 30%. In yet another example, all or at least one or more portions of the body portion 1510 may be constructed with steel-based material having an elongation between and including 18% and 37%. In yet another example, all or at least one or more portions of the body portion 1510 may be constructed with steel-based material having an elongation between and including 14% and 33%. In yet another example, all or at least one or more portions of the body portion 1510 may be constructed with steel-based material having an elongation between and including 7% and 36%. The apparatus, methods, and articles of manufacture described herein are not limited in this regard.

One or more ports may be configured to receive a mass portion having a similar shape as the port. For example, a rectangular port may receive a rectangular mass portion. In another example, an elliptical port may receive an elliptical mass portion. As shown in FIG. 28, for example, the first and second sets of ports 1620 and 1630, respectively, may be cylindrical ports configured to receive one or more cylindrical mass portions. In particular, one or more mass portions of the first set of mass portions 1720 (e.g., generally shown as mass portions 1721, 1722, 1723, and 1724) may be disposed in a port located at or proximate to the toe portion 1540 and/or the top portion 1580. For example, the mass portion 1721 may be partially or entirely disposed in the port 1621. One or more mass portions of the second set of mass portions 1730 (e.g., generally shown as mass portions 1731, 1732, 1733, 1734, 1735, 1736, and 1737) may be disposed in a port located at or proximate to the toe portion 1540 and/or the sole portion 1590. For example, the mass portion 1735 may be partially or entirely disposed in the port 1635. The first set of mass portions 1720 and/or the second set of mass portions 1730 may be coupled to the body portion 1510 with various manufacturing methods and/or processes (e.g., a bonding process, a welding process, a brazing process, a mechanical locking method, any combination thereof, or other suitable manufacturing methods and/or processes).

Alternatively, the golf club head 1500 may not include (i) the first set of mass portions 1720, (ii) the second set of mass portions 1730, or (iii) both the first and second sets of mass portions 1720 and 1730, respectively. In particular, the body portion 1510 may not include ports at or proximate to the top portion 1580 and/or the sole portion 1590. For example, the mass of the first set of mass portions 1720 (e.g., 3 grams) and/or the mass of the second set of mass portions 1730 (e.g., 16.8 grams) may be integral part(s) of the body portion 1510 instead of separate mass portion(s). In one example, the body portion 1510 may include interior and/or exterior integral mass portions at or proximate to the toe portion 1540 and/or at or proximate to the heel portion 1550. In another example, a portion of the body portion 1510 may include interior and/or exterior integral mass portions extending to and/or between the toe portion 1540 and the heel portion 1550. The first and/or second set of mass portions 1720 and 1730, respectively, may affect the mass, the center of gravity (CG), the moment of inertia (MOI), or other physical properties of the golf club head 1500 that may dictate club head performance. The apparatus, methods, and articles of manufacture described herein are not limited in this regard.

Figure 25:
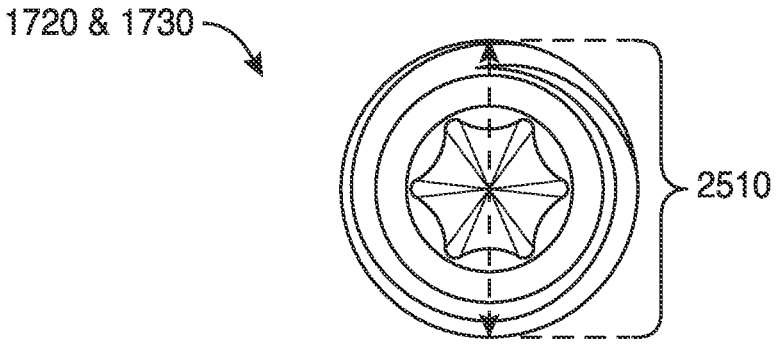
FIGS. 25 and 26 depict a top view and a side view, respectively, of a mass portion associated with a golf club head according to an embodiment of the apparatus, methods, and articles of manufacture described herein.

One or more mass portions of the first set of mass portions 1720 and/or the second set of mass portions 1730 may have similar or different physical properties (e.g., color, marking, shape, size, density, mass, volume, external surface texture, materials of construction, etc.). Accordingly, the first set of mass portions 1720 and/or the second set of mass portions 1730 may contribute to the ornamental design of the golf club head 1500. In the illustrated example as shown in FIG. 25, one or more mass portions of the first set of mass portions 1720 and/or the second set of mass portions 1730 may have a cylindrical shape (e.g., a circular cross section). Alternatively, one or more mass portions of the first set of mass portions 1720 may have a first shape (e.g., a cylindrical shape) whereas one or more mass portions of the second set of mass portions 1730 may have a second shape (e.g., a cubical shape). In another example, the first set of mass portions 1720 may include two or more mass portions with different shapes (e.g., the mass portion 1721 may be a first shape whereas the mass portion 1722 may be a second shape different from the first shape). Likewise, the second set of mass portions 1730 may also include two or more mass portions with different shapes (e.g., the mass portion 1731 may be a first shape whereas the mass portion 1732 may be a second shape different from the first shape). In another example, one or more mass portions of the first set of mass portions 1720 and/or the second set of mass portions 1730 may have a different color(s), marking(s), shape(s), density or densities, mass(es), volume(s), material(s) of construction, external surface texture(s), and/or any other physical property as compared to one or more mass portions of the first set of mass portions 1720 and/or the second set of mass portions 1730. The apparatus, methods, and articles of manufacture described herein are not limited in this regard.

Although the above examples may describe mass portions having a particular shape, the apparatus, methods, and articles of manufacture described herein may include mass portions of other suitable shapes (e.g., a portion of or a whole sphere, cube, cone, cylinder, pyramid, cuboidal, prism, frustum, rectangular, elliptical, or other suitable geometric shape). While the above examples and figures may depict multiple mass portions as a set of mass portions, two or more mass portions of the first set of mass portions 1720 and/or the second set of mass portions 1730 may be a single piece of mass portion. In one example, the first set of mass portions 1720 may be a single piece of mass portion instead of a series of four separate mass portions. In another example, the second set of mass portions 1730 may be a single piece of mass portion instead of a series of seven separate mass portions. The apparatus, methods, and articles of manufacture described herein are not limited in this regard.

Figure 26:
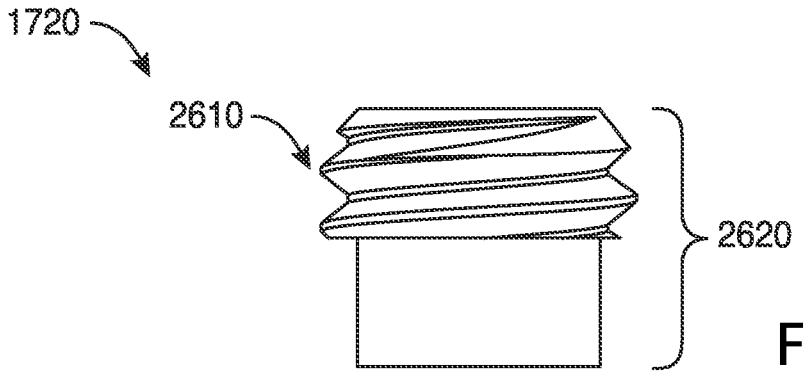
Figure 27:
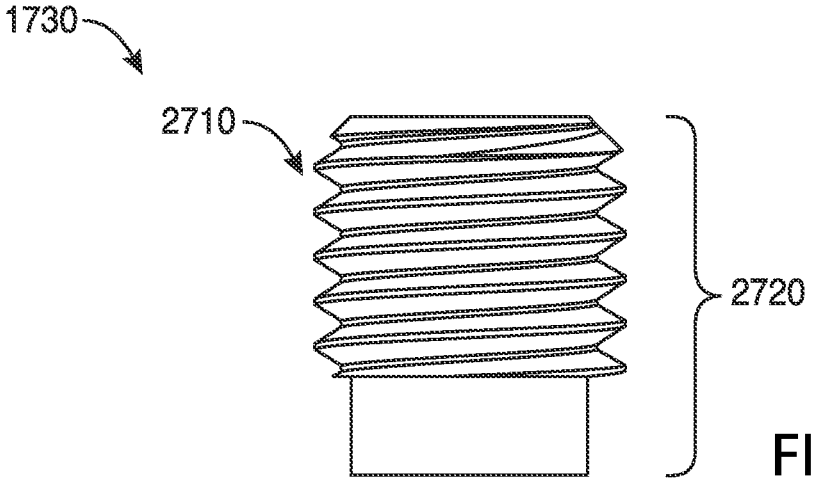
FIG. 27 depicts a side view of a mass portion associated with a golf club head according to an embodiment of the apparatus, methods, and articles of manufacture described herein.

Referring to FIGS. 26 and 27, for example, the first set of mass portions 1720 and/or the second set of mass portions 1730 may include threads, generally shown as 2610 and 2710, respectively, to engage with correspondingly configured threads in the ports to secure in the ports of the back portion 1570 (e.g., generally shown as 1620 and 1630 in FIG. 28). Accordingly, one or more mass portions as described herein may be shaped similar to and function as a screw or threaded fastener for engaging threads in a port. For example, one or more mass portions of the first set of mass portions 1720 and/or the second set of mass portions 1730 may be a screw. One or more mass portions of the first set of mass portions 1720 and/or the second set of mass portions 1730 may not be readily removable from the body portion 1510 with or without a tool. Alternatively, one or more mass portions of the first set of mass portions 1720 and/or the second set of mass portions 1730 may be readily removable (e.g., with a tool) so that a relatively heavier or lighter mass portion may replace one or more mass portions of the first and second sets of mass portions 1720 and 1730, respectively. In another example, one or more mass portions of the first set of mass portions 1720 and/or the second set of mass portions 1730 may be secured in the ports of the back portion 1570 with epoxy or adhesive so that the one or more mass portions of the first set of mass portions 1720 and/or the second set of mass portions 1730 may not be readily removable. In yet another example, one or more mass portions of the first set of mass portions 1720 and/or the second set of mass portions 1730 may be secured in the ports of the back portion 1570 with both threads and thread sealant (e.g. acrylic adhesive, cyanoacrylate adhesive, epoxy, thermoplastic adhesive, silicone sealant, or urethane adhesive) so that the one more mass portions of the first set of mass portions 1720 and/or the second set of mass portions 1730 may not be readily removable. In yet another example, one or more mass portions described herein may be press fit in a port. In yet another example, one or more mass portions described herein may be formed inside a port by injection molding. For example, a liquid metallic material (i.e., molten metal) or a plastic material (e.g. rubber, foam, or any polymer material) may be injected or otherwise introduced into a port. After the liquid material is cooled and/or cured inside the port, the resulting solid material (e.g., a metal material, a plastic material, or a combination thereof) may form a mass portion. The apparatus, methods, and articles of manufacture described herein are not limited in this regard.

In one example, a combination of filler material as described herein and a mass portion may be added to a port in the body portion 1510 of the golf club head 1500 to provide an acoustically-dampened mass portion. In one example, a process of forming an acoustically-dampened mass portion in the body portion 1510 can include (i) adding an amount of filler material to the port and (ii) installing a mass portion in the port to a depth where the mass portion contacts the filler material. In another example, a process of forming an acoustically-dampened mass portion in the body portion 1510 can include (i) installing a mass portion in the port to a depth beneath flush with the outer surface of the body portion 1510 and (ii) adding an amount of filler material to the port volume present above the mass portion. In yet another example, a process of forming an acoustically-dampened mass portion in the body portion 1510 may include (i) adding a first amount of filler material to the port, (ii) installing a mass portion in the port to a depth where the mass portion contacts the filler material and is beneath flush with the outer surface of the body portion 1510, and (iii) adding a second amount of filler material to the port volume present above the mass portion. The acoustically-dampened mass portion(s) may dampen vibrations in the club head that would otherwise transfer through the shaft to an individual's hands. By dampening vibrations in the club head, the acoustically-dampened mass portion(s) may provide a club head with improved sound and feel. The filler material may bond to a wall of the port and an external surface of the mass portion, thereby serving to retain the mass portion in the port without need for a mechanical retention feature. The apparatus, methods, and articles of manufacture described herein are not limited in this regard.

As mentioned above, one or more mass portions of the first set of mass portions 1720 and/or the second set of mass portions 1730 may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. In yet another example, as illustrated in FIGS. 25-27, one or more mass portions of the first set of mass portions 1720 and/or the second set of mass portions 1730 may have a diameter 2510 of about 0.25 inch (6.35 millimeters) but one or more mass portions of the first set of mass portions 1720 and/or the second set of mass portions 1730 may be different in height. In particular, one or more mass portions of the first set of mass portions 1720 may be associated with a first height 2620 (FIG. 26), and one or more mass portions of the second set of mass portions 1730 may be associated with a second height 2720 (FIG. 27). The first height 2620 may be relatively shorter than the second height 2720. In one example, the first height 2620 may be about 0.125 inch (3.175 millimeters) whereas the second height 2720 may be about 0.3 inch (7.62 millimeters). In another example, the first height 2620 may be about 0.16 inch (4.064 millimeters) whereas the second height 2720 may be about 0.4 inch (10.16 millimeters). Alternatively, the first height 2620 may be equal to or greater than the second height 2720. Although the above examples may describe particular dimensions, one or more mass portions described herein may have different dimensions. The apparatus, methods, and articles of manufacture described herein are not limited in this regard.

Figure 24:
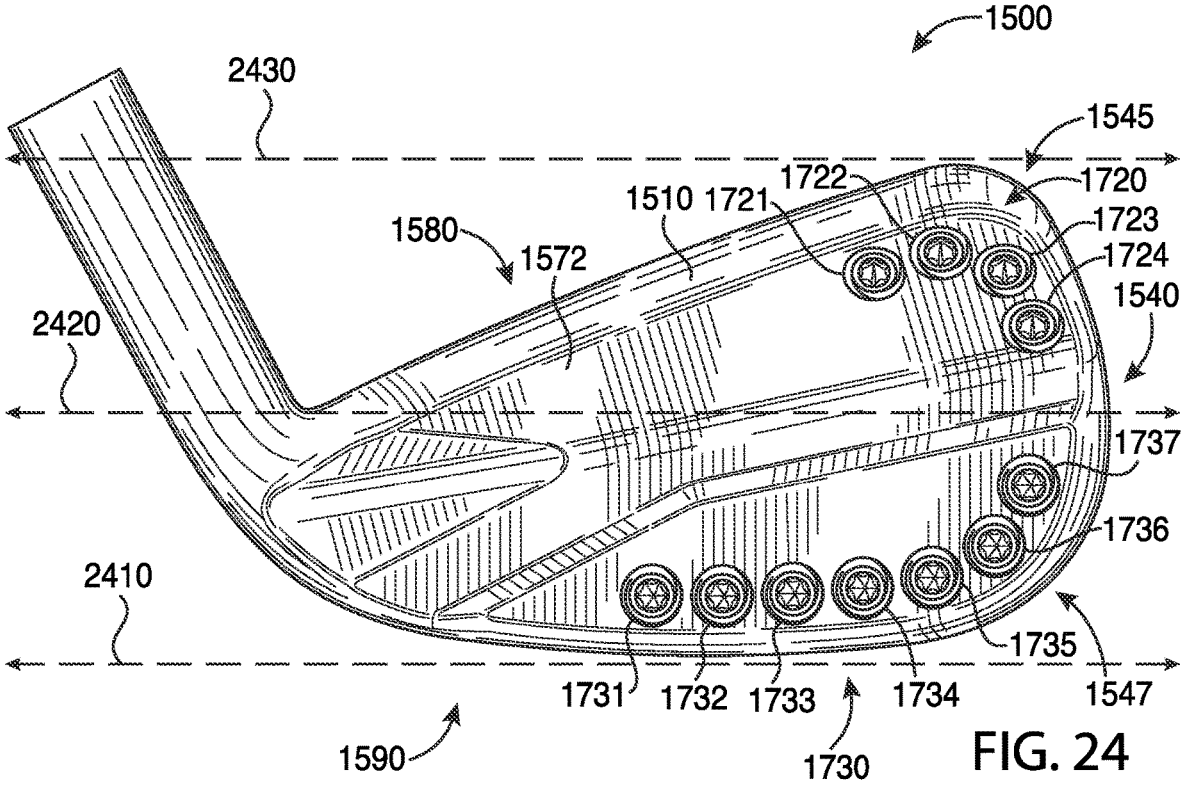

Referring to FIG. 24, for example, the golf club head 1500 may be associated with a ground plane 2410, a horizontal midplane 2420, and a top plane 2430. In particular, the ground plane 2410 may be a tangential plane to the sole portion 1590 of the golf club head 1500 when the golf club head 1500 is at an address position (e.g., the golf club head 1500 is aligned to strike a golf ball). A top plane 2430 may be a tangential plane to the top portion 1580 of the golf club head 1500 when the golf club head 1500 is at the address position. The ground and top planes 2410 and 2430, respectively, may be substantially parallel to each other. The horizontal midplane 2420 may be located vertically halfway between the ground and top planes 2410 and 2430, respectively.

Figure 18:
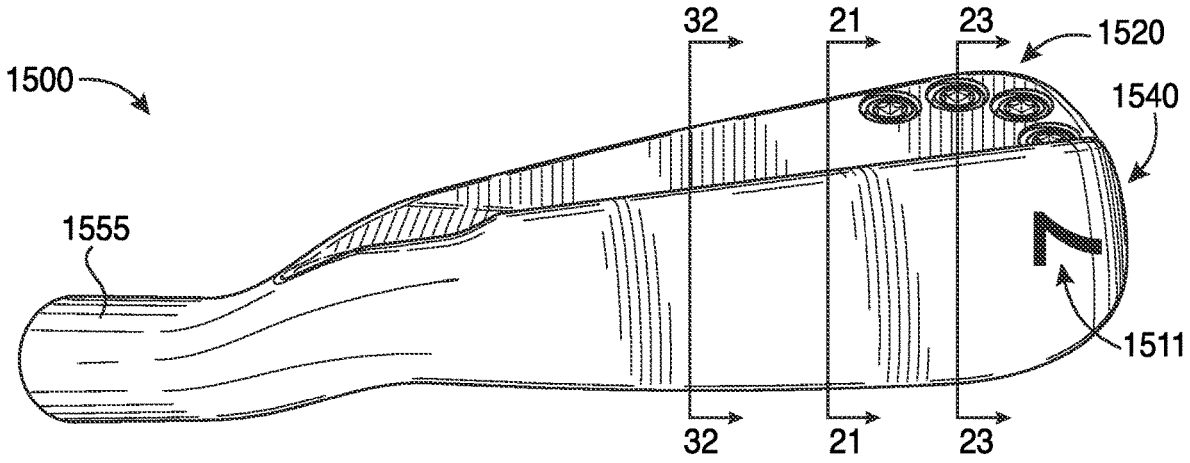
Figure 19:
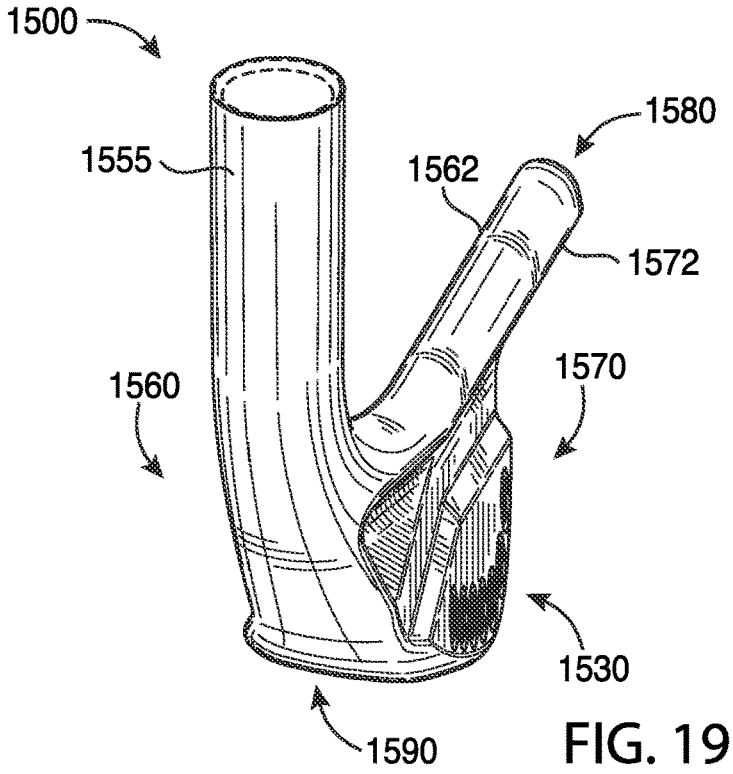

As described herein, the golf club head 1500 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees)(°, 48°, 52°, 56°, 60°, etc.). The body portion 1510 of the golf club head 1500 or any of the golf club heads described herein may include a visual indicator to indicate a particular type of iron-type golf club head or wedge-type golf club head. In particular, the visual indicator 1511 may be a number located on a periphery of the body portion 1510. For example, the visual indicator 1511 may be located on the periphery of the body portion 1510 at or proximate to the sole portion 1590 and/or the toe portion 1540, as shown in FIG. 18. The visual indicator 1511 may avoid or substantially avoid contact with the ground plane 2410 at an address position and/or the ground when the golf club head 1500 strikes a golf ball to avoid or minimize unwanted wear to the visual indicator 1511. The apparatus, methods, and articles of manufacture described herein are not limited in this regard.

The body portion 1510 may include any number of ports (e.g., no ports, one port, two ports, etc.) above the horizontal midplane 2420 and/or below the horizontal midplane 2420. In one example, the body portion 1510 may include a greater number of ports below the horizontal midplane 2420 than above the horizontal midplane 2420. In the illustrated example as shown in FIG. 28, the body portion 1510 may include four ports (e.g., generally shown as ports 1621, 1622, 1623, and 1624) above the horizontal midplane 2420 and seven ports (e.g., generally shown as ports 1631, 1632, 1633, 1634, 1635, 1636, and 1637) below the horizontal midplane 2420. In another example (not shown), the body portion 1510 may include two ports above the horizontal midplane 2420 and five ports below the horizontal midplane 2420. In yet another example (not shown), the body portion 1510 may not have any ports above the horizontal midplane 2420 but have one or more ports below the horizontal midplane 2420. Accordingly, the body portion 1510 may have more ports below the horizontal midplane 2420 than above the horizontal midplane 2420. Further, the body portion 1510 may include a port at or proximate to the horizontal midplane 2420 with a portion of the port above the horizontal midplane 2420 and a portion of the port below the horizontal midplane 2420. Accordingly, the port may be (i) above the horizontal midplane 2420, (ii) below the horizontal midplane 2420, or (iii) both above and below the horizontal midplane 2420. The apparatus, methods, and articles of manufacture described herein are not limited in this regard.

To provide optimal perimeter weighting for the golf club head 1500, the first set of mass portions 1720 (e.g., generally shown as mass portions 1721, 1722, 1723, and 1724) may be configured to counter-balance the mass of the hosel portion 1555. For example, as shown in FIG. 16, the first set of mass portions 1720 (e.g., generally shown as mass portions 1721, 1722, 1723 and 1724) may be located at or near the periphery of the body portion 1510 and extend to and/or between the top portion 1580 and the toe portion 1540. In other words, the first set of mass portions 1720 may be located on the golf club head 1500 at a generally opposite location relative to the hosel portion 1555. In another example, at least a portion of the first set of mass portions 1720 may extend at or near the periphery of the body portion 1510 and extend along a portion of the top portion 1580. In yet another example, at least a portion of the first set of mass portions 1720 may extend at or near the periphery of the body portion 1510 and extend along a portion of the toe portion 1540. Further, the first set of mass portions 1720 may be above the horizontal midplane 2420 of the golf club head 1500. For example, the first set of mass portions 1720 may be at or near the horizontal midplane 2420. In another example, a portion of the first set of mass portions 1720 may be at or above the horizontal midplane 2420 and another portion of the first set of mass portions 1720 may be at or below the horizontal midplane 2420. Accordingly, a set of mass portions, which may be a single mass portion, may have portions above the horizontal midplane 2420 and below the horizontal midplane 2420. The apparatus, methods, and articles of manufacture described herein are not limited in this regard.

At least a portion of the first set of mass portions 1720 may be at or near the toe portion 1540 to increase the MOI of the golf club head 1500 about a vertical axis of the golf club head 1500 that extends through the CG of the golf club head 1500. Accordingly, the first set of mass portions 1720 may be at or near the periphery of the body portion 1510 and extend through the top portion 1580 and/or the toe portion 1540 to counter-balance the mass of the hosel portion 1555 and/or increase the MOI of the golf club head 1500. The locations of the first set of mass portions 1720 (i.e., the locations of the first set of ports 1620) and the physical properties and materials of construction of the first set of mass portions 1720 may be determined to optimally affect the mass, mass distribution, CG, MOI, structural integrity and/or or other static and/or dynamic characteristics of the golf club head 1500. The apparatus, methods, and articles of manufacture described herein are not limited in this regard.

The second set of mass portions 1730 (e.g., generally shown as mass portions 1731, 1732, 1733, 1734, 1735, 1736, and 1737) may be configured to place the CG of the golf club head 1500 at an optimal location and optimize the MOI of the golf club head 1500. Referring to FIG. 16, all or a substantial portion of the second set of mass portions 1730 may be generally at or near the sole portion 1590. For example, the second set of mass portions 1730 (e.g., generally shown as mass portions 1731, 1732, 1733, 1734, 1735, 1736, and 1737) may be at or near the periphery of the body portion 1510 and extend from the sole portion 1590 to the toe portion 1540. As shown in the example of FIG. 16, the mass portions 1731, 1732, 1733, and 1734 may be located at or near the periphery of the body portion 1510 and extend along the sole portion 1590 to lower the CG of the golf club head 1500. The mass portions 1735, 1736 and 1737 may be located at or near the periphery of the body portion 1510 and extend to and/or between the sole portion 1590 and the toe portion 1540 to lower the CG and increase the MOI of the golf club head 1500. For example, the MOI of the golf club head 1500 about a vertical axis extending through the CG may increase due to the presence of the mass portions. To lower the CG of the golf club head 1500, all or a portion of the second set of mass portions 1730 may be located closer to the sole portion 1590 than to the horizontal midplane 2420. For example, the mass portions 1731, 1732, 1733, 1734, 1735, and 1736 may be closer to the sole portion 1590 than to the horizontal midplane 2420. The locations of the second set of mass portions 1730 (i.e., the locations of the second set of ports 1730) and the physical properties and materials of construction of the second set of mass portions 1730 may be determined to optimally affect the mass, mass distribution, CG, MOI, structural integrity and/or or other static and/or dynamic characteristics of the golf club head 1500. The apparatus, methods, and articles of manufacture described herein are not limited in this regard.

Figure 21:
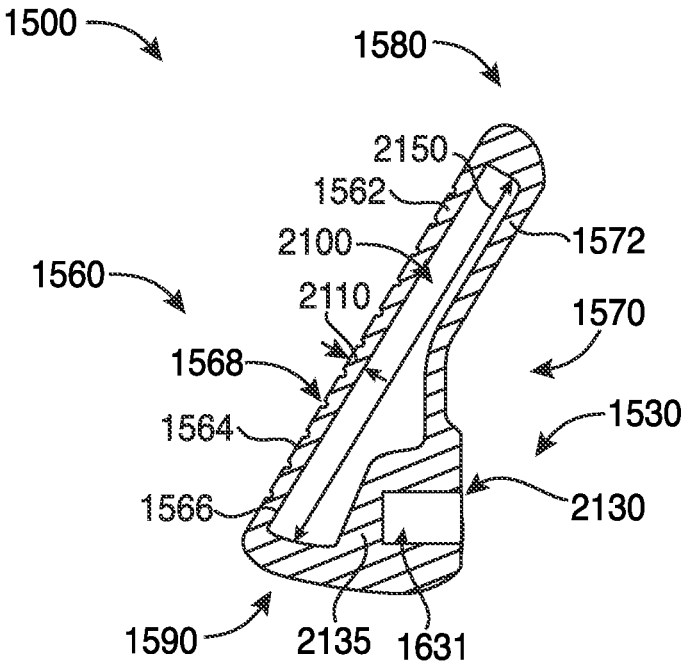
Figure 22:
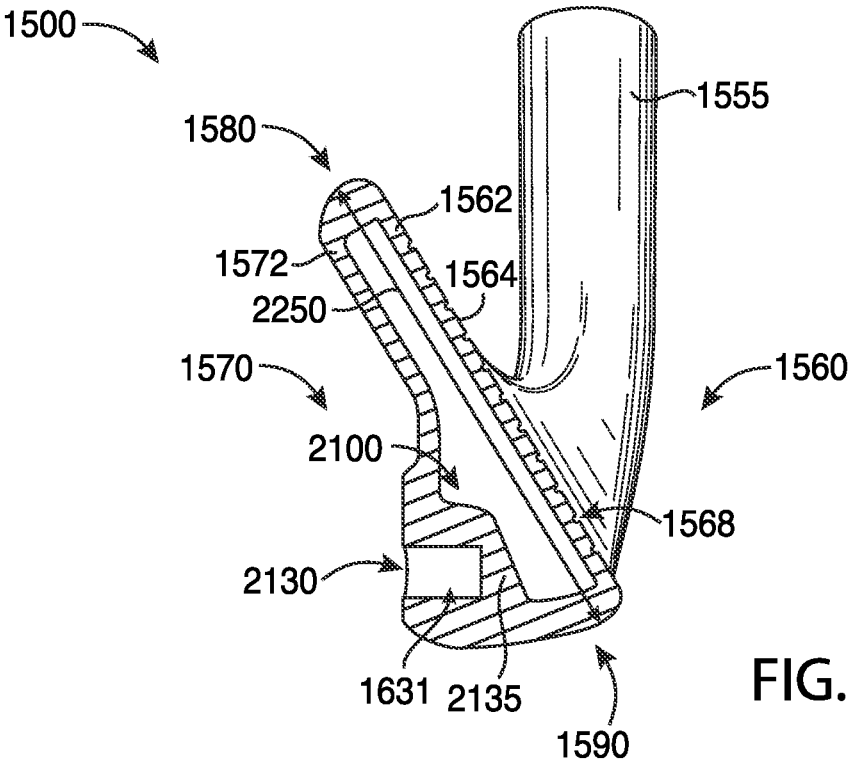
Figure 23:
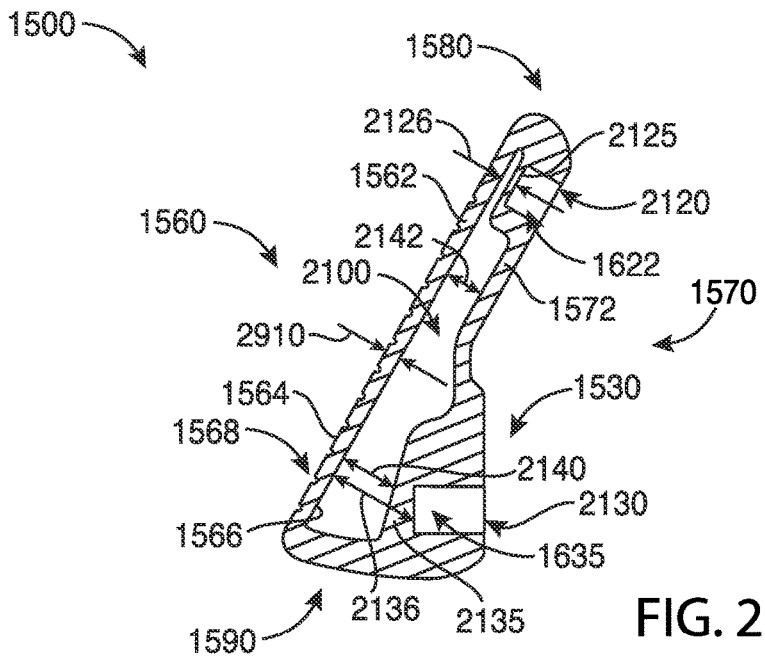

Turning to FIGS. 21-23, for example, one or more mass portions of the first set of mass portions 1720 and/or the second set of mass portions 1730 may be located away from the back surface 1566 of the face portion 1562 (e.g., not directly coupled to each other). That is, one or more mass portions of the first set of mass portions 1720 and/or the second set of mass portions 1730 and the back surface 1566 may be partially or entirely separated by an interior cavity 2100 of the body portion 1510. For example, one or more ports of the first and second sets of ports 1620 and 1630 may include an opening (e.g., generally shown as 2120 and 2130) and a port wall (e.g., generally shown as 2125 and 2135). The port walls 2125 and 2135 may be integral portions of the back wall portion 1572 (e.g., a section of the back wall portion 1572) or the body portion 1510 depending on the location of each port. The opening 2120 may be configured to receive a mass portion such as mass portion 1721. The opening 2130 may be configured to receive a mass portion such as mass portion 1735. The opening 2120 may be located at one end of the port 1621, and the port wall 2125 may be located or proximate to at an opposite end of the port 1621. In a similar manner, the opening 2130 may be located at one end of the port 1635, and the port wall 2135 may be located at or proximate to an opposite end of the port 1635. The port walls 2125 and 2135 may be separated from the face portion 1562 (e.g., separated by the interior cavity 2100). The port wall 2125 may have a distance 2126 from the back surface 1566 of the face portion 1562 as shown in FIG. 23. The port wall 2135 may have a distance 2136 from the back surface 1566 of the face portion 1562. The distances 2126 and 2136 may be determined to optimize the location of the CG of the golf club head 1500 when the first and second sets of ports 1720 and 1730, respectively, receive mass portions as described herein. According to one example, the distance 2136 may be greater than the distance 2126 so that the CG of the golf club head 1500 may be moved toward the back portion 1570. As a result, a width 2140 of a portion of the interior cavity 2100 below the horizontal midplane 2420 may be greater than a width 2142 of the interior cavity 2100 above the horizontal midplane 2420. The apparatus, methods, and articles of manufacture described herein are not limited in this regard.

As described herein, the CG of the golf club head 1500 may be relatively farther back away from the face portion 1562 and relatively lower towards a ground plane (e.g., one shown as 2410 in FIG. 24) with all or a substantial portion of the second set of mass portions 1730 being at or closer to the sole portion 1590 than to the horizontal midplane 2420 and the first and second sets of mass portions 1720 and 1730, respectively being away from the back surface 1566 than if the second set of mass portions 1730 were directly coupled to the back surface 1566. The body portion 1510 may include any number of mass portions (e.g., no mass portions, one mass portion, two mass portions, etc.) and/or any configuration of mass portions (e.g., mass portion(s) integral with the body portion 1510) above the horizontal midplane 2420 and/or below the horizontal midplane 2420. The locations of the first and second sets of ports 1620 and 1630 and/or the locations (e.g., internal mass portion(s), external mass portion(s), mass portion(s) integral with the body portion 1510, etc.), physical properties and materials of construction of the first set of mass portions 1720 and/or the second set of mass portions 1730 may be determined to optimally affect the mass, mass distribution, CG, MOI characteristics, structural integrity and/or or other static and/or dynamic characteristics of the golf club head 1500. Different from other golf club head designs, the interior cavity 2100 of the body portion 1510 and the location of the first set of mass portions 1720 and/or the second set of mass portions 1730 along the periphery of the golf club head 1500 may result in a golf ball traveling away from the face portion 1562 at a relatively higher ball launch angle and a relatively lower spin rate. As a result, the golf ball may travel farther (i.e., greater total distance, which includes carry and roll distances). The apparatus, methods, and articles of manufacture described herein are not limited in this regard.

While the figures may depict ports with a particular cross-section shape, the apparatus, methods, and articles of manufacture described herein may include ports with other suitable cross-section shapes. In one example, the ports of the first and/or second sets of ports 1620 and 1630 may have U-like cross-section shape. In another example, the ports of the first and/or second set of ports 1620 and 1630 may have V-like cross-section shape. One or more of the ports associated with the first set of mass portions 1720 may have a different cross-section shape than one or more ports associated with the second set of mass portions 1730. For example, the port 1621 may have a U-like cross-section shape whereas the port 1635 may have a V-like cross-section shape. Further, two or more ports associated with the first set of mass portions 1720 may have different cross-section shapes. In a similar manner, two or more ports associated with the second set of mass portions 1730 may have different cross-section shapes. The apparatus, methods, and articles of manufacture described herein are not limited in this regard.

The first and second sets of mass portions 1720 and 1730, respectively, may be similar in mass (e.g., all of the mass portions of the first and second sets of mass portions 1720 and 1730, respectively, weigh about the same). Alternatively, the first and second sets of mass portions 1720 and 1730, respectively, may be different in mass individually or as an entire set. In particular, one or more mass portions of the first set of mass portions 1720 (e.g., generally shown as 1721, 1722, 1723, and 1724) may have relatively less mass than one or more portions of the second set of mass portions 1730 (e.g., generally shown as 1731, 1732, 1733, 1734, 1735, 1736, and 1737). For example, the second set of mass portions 1730 may account for more than 50% of the total mass from mass portions of the golf club head 1500. As a result, the golf club head 1500 may be configured to have at least 50% of the total mass from mass portions disposed below the horizontal midplane 2420. Two or more mass portions in the same set may be different in mass. In one example, the mass portion 1721 of the first set of mass portions 1720 may have a relatively lower mass than the mass portion 1722 of the first set of mass portions 1720. In another example, the mass portion 1731 of the second set of mass portions 1730 may have a relatively lower mass than the mass portion 1735 of the second set of mass portions 1730. Accordingly, more mass may be distributed away from the CG of the golf club head 1500 to increase the MOI about the vertical axis through the CG. The apparatus, methods, and articles of manufacture described herein are not limited in this regard.

In one example, the golf club head 1500 may have a mass in the range of about 220 grams to about 330 grams based on the type of golf club (e.g., a 4-iron versus a lob wedge). The body portion 1510 may have a mass in the range of about 200 grams to about 310 grams with the first set of mass portions 1720 and/or the second set of mass portions 1730 having a mass of about 20 grams (e.g., a total mass from mass portions). One or more mass portions of the first set of mass portions 1720 and/or the second set of mass portions 1730 may have a mass greater than or equal to about 0.1 gram and less than or equal to about 20 grams. In one example, one or more mass portions of the first set of mass portions 1720 may have a mass of about 0.75 gram whereas one or more mass portions of the second set of mass portions 1730 may have a mass of about 2.4 grams. The sum of the mass of the first set of mass portions 1720 or the sum of the mass of the second set of mass portions 1730 may be greater than or equal to about 0.1 grams and less than or equal to about 20 grams. In one example, the sum of the mass of the first set of mass portions 1720 may be about 3 grams whereas the sum of the mass of the first set of mass portions 1730 may be about 16.8 grams. The total mass of the second set of mass portions 1730 may weigh more than five times as much as the total mass of the first set of mass portions 1720 (e.g., a total mass of the second set of mass portions 1730 of about 16.8 grams versus a total mass of the first set of mass portions 1720 of about 3 grams). The golf club head 1500 may have a total mass of 19.8 grams from the first and second sets of mass portions 1720 and 1730, respectively (e.g., sum of 3 grams from the first set of mass portions 1720 and 16.8 grams from the second set of mass portions 1730). Accordingly, in one example, the first set of mass portions 1720 may account for about 15% of the total mass from mass portions of the golf club head 1500 whereas the second set of mass portions 1730 may be account for about 85% of the total mass from mass portions of the golf club head 1500. The apparatus, methods, and articles of manufacture described herein are not limited in this regard.

By coupling the first set of mass portions 1720 and/or the second set of mass portions 1730, respectively, to the body portion 1510 (e.g., securing the first set of mass portions 1720 and/or the second set of mass portions 1730 in the ports on the back portion 1570), the location of the CG and the MOI of the golf club head 1500 may be optimized. In particular, as described herein, the first set of mass portions 1720 may lower the location of the CG towards the sole portion 1590 and further back away from the face portion 1562. Further, the first set of mass portions 1720 and/or the second set of mass portions 1730 may increase the MOI as measured about a vertical axis extending through the CG (e.g., perpendicular to the ground plane 2610). The MOI may also be higher as measured about a horizontal axis extending through the CG (e.g., extending towards the toe and heel portions 1540 and 1550, respectively, of the golf club head 1500). As a result, the golf club head 1500 may provide a relatively higher launch angle and a relatively lower spin rate than a golf club head without the first and/or second sets of mass portions 1720 and 1730, respectively. The apparatus, methods, and articles of manufacture described herein are not limited in this regard.

Although the figures may depict the mass portions as separate and individual parts that may be visible from an exterior of the golf club head 1500, the two or more mass portions of the first set of mass portions 1720 and/or the second set of mass portions 1730 may be a single piece of mass portion that may be an exterior mass portion or an interior mass portion (i.e., not visible from an exterior of the golf club head 1500). In one example, all of the mass portions of the first set 1720 of mass portions (e.g., generally shown as 1721, 1722, 1723, and 1724) may be combined into a single piece of mass portion (e.g., a first mass portion). In a similar manner, all of the mass portions of the second set of mass portions 1730 (e.g., generally shown as 1731, 1732, 1733, 1734, 1735, 1736, and 1737) may be combined into a single piece of mass portion as well (e.g., a second mass portion). In this example, the golf club head 1500 may have only two mass portions. In another example (not shown), the body portion 1510 may not include the first set of mass portions 1720 but may include the second set of mass portions 1730 in the form of a single internal mass portion that may be farther from the heel portion 1550 than the toe portion 1540. In yet another example (not shown), the body portion 1510 may not include the first set of mass portions 1720 but may include the second set of mass portions 1730 with a first internal mass portion farther from the heel portion 1550 than the toe portion 1540 and a second internal mass portion farther from the toe portion 1540 than the heel portion 1550. The first internal mass portion and the second internal mass portion may be (i) integral parts of the body portion 1510 or (ii) separate from the body portion 1510 and coupled to the body portion 1510. The apparatus, methods, and articles of manufacture described herein are not limited in this regard.

While the figures may depict a particular number of mass portions, the apparatus, methods, and articles of manufacture described herein may include more or fewer mass portions. In one example, the first set of mass portions 1720 may include two separate mass portions instead of three separate mass portions as shown in the figures. In another example, the second set of mass portions 1730 may include five separate mass portions instead of seven separate mass portions as shown in the figures. Alternatively, as mentioned above, the apparatus, methods, and articles of manufacture described herein may not include any separate mass portions (e.g., the body portion 1510 may be manufactured to include the mass of the separate mass portions as integral part(s) of the body portion 1510). The apparatus, methods, and articles of manufacture described herein are not limited in this regard.

Referring to FIGS. 21-23, for example, the body portion 1510 may be a hollow body including the interior cavity 2100 extending between the front portion 1560 and the back portion 1570. Further, the interior cavity 2100 may extend between the top portion 1580 and the sole portion 1590. The interior cavity 2100 may be associated with a cavity height 2150 (HC), and the body portion 1510 may be associated with a body height 2250 (HB). While the cavity height 2150 and the body height 2250 may vary between the toe and heel portions 1540 and 1550, the cavity height 2150 may be at least 50% of a body height 2250 (HC>0.5*HB). For example, the cavity height 2150 may vary between 70%-85% of the body height 2250. With the cavity height 2150 of the interior cavity 2100 being greater than 50% of the body height 2250, the golf club head 1500 may produce relatively more consistent feel, sound, and/or result when the golf club head 1500 strikes a golf ball via the face portion 1562 than a golf club head with a cavity height of less than 50% of the body height. The apparatus, methods, and articles of manufacture described herein are not limited in this regard.

In one example, the interior cavity 2100 may be unfilled (i.e., empty space). The body portion 1510 with the interior cavity 2100 may weigh about 100 grams less than the body portion 1510 without the interior cavity 2100. Alternatively, the interior cavity 2100 may be partially or entirely filled with a cavity filling or filler material (i.e., a cavity filling portion), which may include one or more similar or different types of materials. In one example, the filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. For example, at least 50% of the interior cavity 2100 may be filled with a TPE material to absorb shock, isolate vibration, and/or dampen noise when the golf club head 1500 strikes a golf ball via the face portion 1562. The apparatus, methods, and articles of manufacture described herein are not limited in this regard.

In another example, the filler material may be a polymer material such as an ethylene copolymer material that may absorb shock, isolate vibration, and/or dampen noise when the golf club head 1500 strikes a golf ball via the face portion 1562. In particular, at least 50% of the interior cavity 2100 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that may be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience, i.e., relatively high coefficient of restitution (COR). The apparatus, methods, and articles of manufacture described herein are not limited in this regard.

For example, the filler material may have a density of less than or equal to 1.5 g/cm3. The filler material may have a compression deformation value ranging from about 0.0787 inch (2 mm) to about 0.1968 inch (5 mm). The filler material may have a surface Shore D hardness ranging from 40 to 60. As mentioned above, the filler material may be associated with a relatively high coefficient of restitution (COR). The filler material may be associated with a first COR (COR1) and the face portion 2662 may be associated with a second COR (COR2), which may be similar or different from the first COR. The first and second CORs may be associated with a COR ratio (e.g., COR12 ratio=COR1/COR2 or COR21 ratio=COR2/COR1). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The golf club head 1500 may be associated with a third COR (COR3), which may be similar or different from the first COR and/or the second COR. As mentioned above, the filler material may be associated with the first COR. The first and third CORs may be associated with a COR ratio (e.g., COR13 ratio=COR1/COR3 or COR31 ratio=COR3/COR1). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The CORs of the filler material, the face portion 1562, and/or the golf club head 1500 (e.g., the first COR (COR1), the second COR (COR2), and/or the third COR (COR3), respectively) may be measured by methods similar to methods that measure the COR of a golf ball and/or a golf club head as defined by one or more golf standard organizations and/or governing bodies (e.g., United States Golf Association (USGA)). In one example, an air cannon device may launch or eject an approximately 1.55 inch (38.1 mm) spherical sample of the filler material at an initial velocity toward a steel plate positioned at about 4 feet (1.2 meters) away from the air cannon device. The sample may vary in size, shape or any other configuration. A speed monitoring device may be located at a distance in a range from 2 feet (0.6 meters) to 3 feet (0.9 meters) from the air cannon device. The speed monitoring device may measure a rebound velocity of the sample of the filler material after the sample of the filler material strikes the steel plate. In one example, the rebound velocity may be greater than or equal to 2 meters per second (m/s). In another example, the rebound velocity may be greater than or equal to 2.5 m/s. In yet another example, the rebound velocity may be greater than or equal to 3 m/s. The COR may be the rebound velocity divided by the initial velocity. The apparatus, methods, and articles of manufacture described herein are not limited in this regard.

In one example, an air cannon device may launch or eject a testing golf ball (e.g., as defined by the USGA) at an initial velocity toward a plate-shaped sample of the filler material with a rigid backing (e.g., a metal plate) positioned at about 4 feet (1.2 meters) away from the air cannon device. The plate-shaped sample of the filler material may have sufficient thickness depending on the elasticity of the filler material so that the striking golf ball compresses the filler material within the elastic range of the filler material. The thickness of the plate-shaped sample of the filler material may vary based on the elasticity of the filler material. For example, the plate-shaped sample of the filler material may have a thickness ranging from about 1 inch to about 5 inches. A speed monitoring device may be located at a distance in a range from 2 feet (0.6 meters) to 3 feet (0.9 meters) from the air cannon device. The speed monitoring device may measure a rebound velocity of the golf ball after the golf ball strikes the plate-shaped sample of the filler material. The method of measuring COR of the filler material may be repeated with multiple samples of the same brand and model of golf balls (i.e., identical or substantially identical golf balls). In one example, the rebound velocity may be greater than or equal to 2 meters per second (m/s). In another example, the rebound velocity may be greater than or equal to 2.5 m/s. In yet another example, the rebound velocity may be greater than or equal to 3 m/s. The COR may be the rebound velocity divided by the initial velocity. The apparatus, methods, and articles of manufacture described herein are not limited in this regard.

In another example, a drop test procedure may be used to determine the COR of the filler material. An approximately 1.68 inch (42.6 mm) spherical sample of the filler material may be dropped onto a horizontally positioned steel plate from a certain drop distance. A bounce distance, which is the distance by which the spherical sample of the filler material bounces from the steel plate may be measured. The COR may be the bounce distance divided by the drop distance. The apparatus, methods, and articles of manufacture described herein are not limited in this regard.

In yet another example, a drop test procedure may be used to determine the COR of the filler material. A USGA testing golf ball may be dropped onto a horizontally positioned plate-shaped sample of the filler material with a rigid backing (e.g., a metal plate) from a certain drop distance. The plate-shaped sample of the filler material may have sufficient thickness depending on the elasticity of the filler material so that the dropped golf ball compresses the filler material within the elastic range of the filler material. In one example, the plate-shaped sample of the filler material may have a thickness ranging from about 1 inch to about 5 inches. A bounce distance, which may be the distance by which the golf ball bounces from the plate-shaped filler material is then measured. The method of measuring COR of the filler material may be repeated with multiple samples of the same brand and model of golf balls (i.e., identical or substantially identical golf balls). The COR may be the bounce distance divided by the drop distance. The apparatus, methods, and articles of manufacture described herein are not limited in this regard.

In one example, the filler material may have a COR value in a range from approximately 0.50 to approximately 0.95 when measured with an initial velocity in a range from 100 ft/s (30.48 m/s) to 250 ft/s (76.2 m/s). In another example, the filler material may have a COR value in a range from approximately 0.65 to approximately 0.85 when measured with an initial velocity in a range from 100 ft/s (30.48 m/s) to 150 ft/s (45.72 m/s). In another example, the filler material may have a COR value in a range from approximately 0.75 to approximately 0.8 when measured with an initial velocity in a range 100 ft/s (30.48 m/s) to 150 ft/s (45.72 m/s). In another example, the filler material may have a COR value in a range from approximately 0.55 to approximately 0.90 when measured with an initial velocity in a range from 100 ft/s (30.48 m/s) and 250 ft/s (76.2 m/s). In another example, the filler material may have a COR value in a range from approximately 0.75 to approximately 0.85 when measured with an initial velocity in a range 110 ft/s (33.53 m/s) to 200 ft/s (60.96 m/s). In yet another example, the filler material may have a COR value in a range from approximately 0.8 to approximately 0.9 when measured with an initial velocity of about 125 ft/s (38.1 m/s). Further, the filler material may have a COR value greater than or equal to 0.8 at an initial velocity of about 143 ft/s (43.6 m/s). While a particular example may be described above, other methods may be used to measure the CORs of the filler material, the face portion 1562, and/or the golf club head 1500. The apparatus, methods, and articles of manufacture described herein are not limited in this regard.

When the face portion 1562 of the golf club head 1500 strikes a golf ball, the face portion 1562 and the filler material may deform and/or compress. The kinetic energy of the impact may be transferred to the face portion 1562 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 1500.

The filler material may include a bonding portion. In one example, the bonding portion may be one or more bonding agents including thermoset polymers having bonding properties (e.g., one or more adhesive or epoxy materials). For example, the bonding agent may assist in bonding or adhering the filler material to at least the back surface 1566 of the face portion 1562. The bonding agent may also absorb shock, isolate vibration, and/or dampen noise when the golf club head 1500 strikes a golf ball via the face portion 1562. Further, the bonding agent may be an epoxy material that may be flexible or slightly flexible when cured. In one example, the filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, the filler material may include 3M™ Scotch-Weld™ DP100 Plus Clear adhesive. In yet another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, the filler material may be LOCTITE® materials manufactured by Henkel Corporation, Rocky Hill, Conn. The apparatus, methods, and articles of manufacture described herein are not limited in this regard.

Further, the filler material may include a combination of one or more bonding agents such as any of the bonding agents described herein and one or more polymer materials such as any of the polymer materials described herein. In one example, the filler material may include one or more bonding agents that may be used to bond the polymer material to the back surface 1566 of the face portion 1562. The one or more bonding agents may be applied to the back surface 1566 of the face portion 1562. The filler material may further include one or more polymer materials may partially or entirely fill the remaining portions of the interior cavity 2100. Accordingly, two or more separate materials may partially or entirely fill the interior cavity 2100. The apparatus, methods, and articles of manufacture described herein are not limited in this regard.

The filler material may only include one or more polymer materials that adhere to inner surface(s) of the interior cavity 2100 without a separate bonding agent (e.g., an adhesive or epoxy material). For example, the filler material may include a mixture of one or more polymer materials and one or more bonding agents (e.g., adhesive or epoxy material(s)). Accordingly, the mixture including the one or more polymer materials and the one or more bonding agents may partially or entirely fill the interior cavity 2100 and adhere to inner surface(s) of the interior cavity 2100. In another example, the interior cavity 2100 may be partially or entirely filled with one or more polymer materials without any bonding agents. In yet another example, the interior cavity 2100 may be partially or entirely filled with one or more bonding agents and/or adhesive materials such as an adhesive or epoxy material. The apparatus, methods, and articles of manufacture described herein are not limited in this regard.

Figure 29:
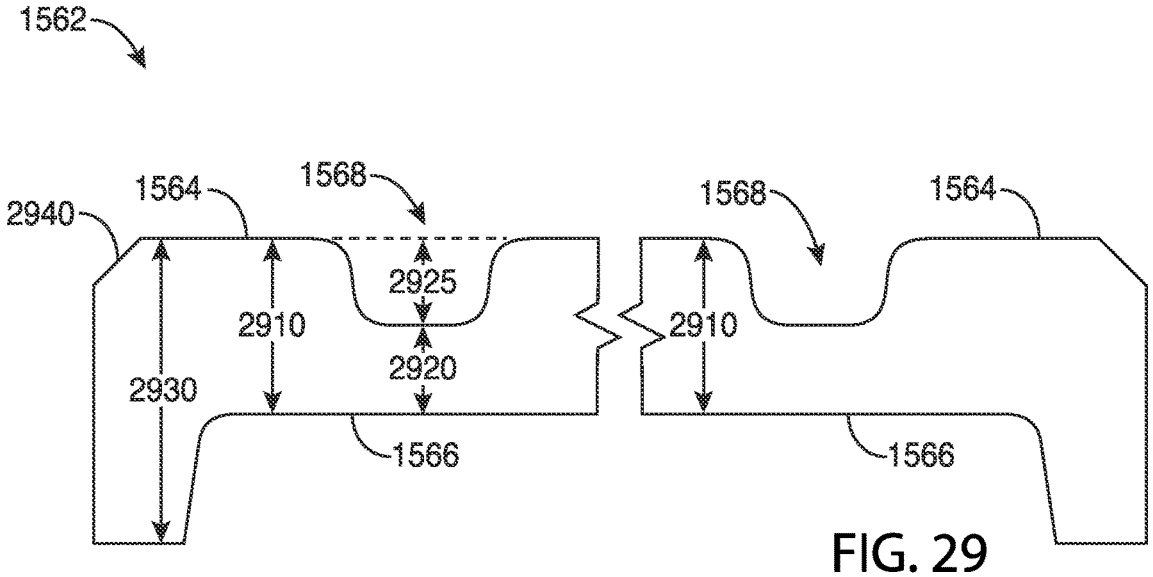
FIG. 29 depicts a cross-sectional view of a face portion associated with a golf club head according to an embodiment of the apparatus, methods, and articles of manufacture described herein.

Turning to FIG. 29, for example, a thickness of the face portion 1562 may be a first thickness 2910 ($T_1$) or a second thickness 2920 ($T_2$). The first thickness 2910 may be a thickness of a section of the face portion 1562 adjacent to a groove 1568 whereas the second thickness 2920 may be a thickness of a section of the face portion 1562 below the groove 1568. For example, the first thickness 2910 may be a maximum distance between the front surface 1564 and the back surface 1566. The second thickness 2920 may be based on the groove 1568. In particular, the groove 1568 may have a groove depth 2925 ($D_{groove}$). The second thickness 2920 may be a maximum distance between the bottom of the groove 1568 and the back surface 1566. The sum of the second thickness 2920 and the groove depth 2925 may be substantially equal to the first thickness 2910 (e.g., $T_2+D_{groove}=T_1$). Accordingly, the second thickness 2920 may be less than the first thickness 2910 (e.g., $T_2<T_1$).

To lower and/or move the CG of the golf club head 1500 further back, mass from the front portion 1560 of the golf club head 1500 may be removed by using a relatively thinner face portion 1562. For example, the first thickness 2910 or the second thickness 2920 may be less than or equal to 0.1 inch (2.54 millimeters). In another example, the first thickness 2910 may be about 0.075 inch (1.905 millimeters) (e.g., $T_1$=0.075 inch). With the support of the back wall portion 1572 to form the interior cavity 2100 and filling at least a portion of the interior cavity 2100 with an elastic polymer material, the face portion 1562 may be relatively thinner (e.g., $T_1$<0.075 inch) without degrading the structural integrity, sound, and/or feel of the golf club head 1500. In one example, the first thickness 2910 may be less than or equal to 0.060 inch (1.524 millimeters) (e.g., $T_1\leq$0.060 inch). In another example, the first thickness 2910 may be less than or equal to 0.040 inch (1.016 millimeters) (e.g., $T_1\leq$0.040 inch). Based on the type of material(s) used to form the face portion 1562 and/or the body portion 1510, the face portion 1562 may be even thinner with the first thickness 2910 being less than or equal to 0.030 inch (0.762 millimeters) (e.g., $T_1\leq$0.030 inch). The groove depth 2925 may be greater than or equal to the second thickness 2920 (e.g., $D_{groove}\geq T_2$). In one example, the groove depth 2925 may be about 0.020 inch (0.508 millimeters) (e.g., $D_{groove}$=0.020 inch). Accordingly, the second thickness 2920 may be about 0.010 inch (0.254 millimeters) (e.g., $T_2$=0.010 inch). In another example, the groove depth 2925 may be about 0.015 inch (0.381 millimeters), and the second thickness 2920 may be about 0.015 inch (e.g., $D_{groove}=T_2$=0.015 inch). Alternatively, the groove depth 2925 may be less than the second thickness 2920 (e.g., $D_{groove}<T_2$). Without the support of the back wall portion 1572 and the elastic polymer material to fill in the interior cavity 2100, a golf club head may not be able to withstand multiple impacts by a golf ball on a face portion. In contrast to the golf club head 1500 as described herein, a golf club head with a relatively thin face portion but without the support of the back wall portion 1572 and the elastic polymer material to fill in the interior cavity 2100 (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form the golf club head 1500, the face portion 1562 may include additional material at or proximate to a periphery of the face portion 1562. Accordingly, the face portion 1562 may also include a third thickness 2930, and a chamfer portion 2940. The third thickness 2930 may be greater than either the first thickness 2910 or the second thickness 2920 (e.g., $T_3>T_1>T_2$). In particular, the face portion 1562 may be coupled to the body portion 1510 by a welding process. For example, the first thickness 2910 may be about 0.030 inch (0.762 millimeters), the second thickness 2920 may be about 0.015 inch (0.381 millimeters), and the third thickness 2930 may be about 0.050 inch (1.27 millimeters). Accordingly, the chamfer portion 2940 may accommodate some of the additional material when the face portion 1562 is welded to the body portion 1510.

Figure 30:
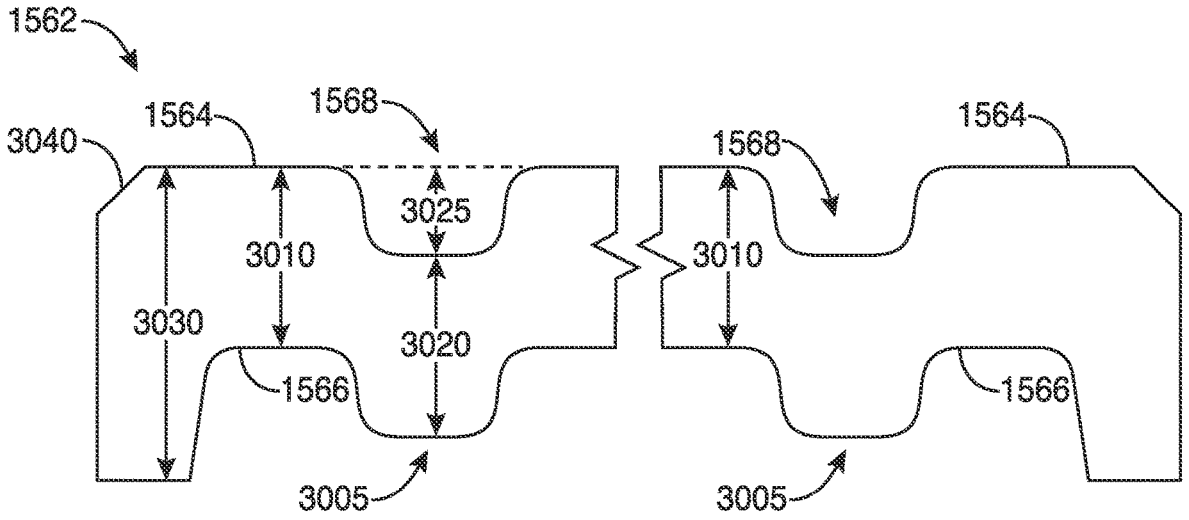
FIG. 30 depicts a cross-section view of a face portion associated with a golf club head according to an embodiment of the apparatus, methods, and articles of manufacture described herein.

As illustrated in FIG. 30, for example, the face portion 1562 may include a reinforcement section, generally shown as 3005, below one or more grooves 1568. In one example, the face portion 1562 may include a reinforcement section 3005 below each groove. Alternatively, face portion 1562 may include the reinforcement section 3005 below some grooves (e.g., every other groove) or below only one groove. The face portion 1562 may include a first thickness 3010, a second thickness 3020, a third thickness 3030, and a chamfer portion 3040. The groove 1568 may have a groove depth 3025. The reinforcement section 3005 may define the second thickness 3020. The first and second thicknesses 3010 and 3020, respectively, may be substantially equal to each other (e.g., $T_1=T_2$). In one example, the first and second thicknesses 3010 and 3020, respectively, may be about 0.030 inch (0.762 millimeters) (e.g., $T_1=T_2$=0.030 inch). The groove depth 3025 may be about 0.015 inch (0.381 millimeters), and the third thickness 3030 may be about 0.050 inch (1.27 millimeters). The groove 1568 may also have a groove width. The width of the reinforcement section 3005 may be greater than or equal to the groove width. The apparatus, methods, and articles of manufacture described herein are not limited in this regard.

Alternatively, the face portion 1562 may vary in thickness at and/or between the top portion 1580 and the sole portion 1590. In one example, the face portion 1562 may be relatively thicker at or proximate to the top portion 1580 than at or proximate to the sole portion 1590 (e.g., thickness of the face portion 1562 may taper from the top portion 1580 towards the sole portion 1590). In another example, the face portion 1562 may be relatively thicker at or proximate to the sole portion 1590 than at or proximate to the top portion 1580 (e.g., thickness of the face portion 1562 may taper from the sole portion 1590 towards the top portion 1580). In yet another example, the face portion 1562 may be relatively thicker between the top portion 1580 and the sole portion 1590 than at or proximate to the top portion 1580 and the sole portion 1590 (e.g., thickness of the face portion 1562 may have a bell-shaped contour). The apparatus, methods, and articles of manufacture described herein are not limited in this regard.

As described herein, the interior cavity 2100 may be partially or fully filled with a filler material, which may be a polymer material, a bonding agent (such as an adhesive or epoxy material), or a combination of polymer material(s) and bonding agent(s) to at least partially provide structural support for the face portion 1562. In particular, the filler material may also provide vibration and/or noise dampening for the body portion 1510 when the face portion 1562 strikes a golf ball. Alternatively, the filler material may only provide vibration and/or noise dampening for the body portion 1510 when the face portion 1562 strikes a golf ball. In one example, the body portion 1510 of the golf club head 1500 (e.g., an iron-type golf club head) may have a body portion volume ($V_b$) between about 2.0 cubic inches (32.77 cubic centimeters) and about 4.2 cubic inches (68.83 cubic centimeters). The volume of the filler material filling the interior cavity ($V_e$), such as the interior cavity 2100, may be between 0.5 and 1.7 cubic inches (8.19 and 27.86 cubic centimeters, respectively). A ratio of the filler material volume ($V_e$) to the body portion volume ($V_b$) may be expressed as:

$$0.2\leq V_e/V_b\leq 0.5$$

Where: $V_e$ is the filler material volume in units of cubic inches, and $V_b$ is the body portion volume in units of cubic inches.

In another example, the ratio of the filler material volume ($V_e$) to the body portion volume ($V_b$) may be between about 0.2 and about 0.4. In yet another example, the ratio of the filler material volume ($V_e$) to the body portion volume ($V_b$) may be between about 0.25 and about 0.35. The apparatus, methods, and articles of manufacture described herein are not limited in this regard.

Based on the amount of filler material filling the interior cavity, for example, the thickness of the face portion may be between about 0.025 inches (0.635 millimeters) and about 0.1 inch (2.54 millimeters). In another example, the thickness of the face portion ($T_f$) may be between about 0.02 inches (0.508 millimeters) and about 0.09 inches (2.286 millimeters). The thickness of the face portion ($T_f$) may depend on the volume of the filler material in the interior cavity ($V_e$), such as the interior cavity 2100. The ratio of the thickness of the face portion ($T_f$) to the volume of the filler material ($V_e$) may be expressed as:

$$0.01 \leq T_f/V_e \leq 0.2$$

Where: $T_f$ is the thickness of the face portion in units of inches, and $V_e$ is the filler material volume in units of cubic inches.

In one example, the ratio of the thickness of the face portion ($T_f$) to the volume of the filler material ($V_e$) may be between 0.02 and 0.09. In another example, the ratio of the thickness of the face portion ($T_f$) to the volume of the filler material ($V_e$) may be between 0.04 and 0.14. The thickness of the face portion ($T_f$) may be the same as $T_1$ and/or $T_2$ mentioned above. The apparatus, methods, and articles of manufacture described herein are not limited in this regard.

The thickness of the face portion ($T_f$) may depend on the volume of the filler material in the interior cavity ($V_e$), such as the interior cavity 2100, and the body portion volume ($V_b$). The volume of the filler material ($V_e$) may be expressed as:

$$V_e = a \cdot V_b + b \pm c \cdot T_f$$

$$a \approx 0.48$$

$$b \approx -0.38$$

$$0 \leq c \leq 10$$

Where: $V_e$ is the filler material volume in units of cubic inches, $V_b$ is the body portion volume in units of cubic inches, and $T_f$ is the thickness of the face portion in units of inches.

As described herein, for example, the body portion volume ($V_b$) may be between about 2.0 cubic inches (32.77 cubic centimeters) and about 4.2 cubic inches (68.83 cubic centimeters). In one example, the thickness of the face portion ($T_f$) may be about 0.03 inches (0.762 millimeters). In another example, the thickness of the face portion ($T_f$) may be about 0.06 inches (1.524 millimeters). In yet another example, the thickness of the face portion ($T_f$) may be about 0.075 inches (1.905 millimeters). The apparatus, methods, and articles of manufacture described herein are not limited in this regard.

Further, the volume of the filler material ($V_e$) when the interior cavity is fully filled with the filler material may be similar to the volume of the interior cavity ($V_c$). Accordingly, when the interior cavity is fully filled with a filler material, the volume of the filler material ($V_e$) in any of the equations provided herein may be replaced with the volume of the interior cavity ($V_c$). Accordingly, the above equations expressed in terms of the volume of the interior cavity ($V_c$) may be expressed as:

$$0.2 \leq V_c/V_b \leq 0.5$$

$$0.01 \leq T_f/V_c \leq 0.2$$

$$V_c = a \cdot V_b + b \pm c \cdot T_f$$

$$a \approx 0.48$$

$$b \approx -0.38$$

$$0 \leq c \leq 10$$

Where: $V_c$ is the volume of the interior cavity in units of cubic inches, $V_b$ is the body portion volume in units of cubic inches, and $T_f$ is the thickness of the face portion in units of inches.

As described herein, the filler material may include a bonding agent that may be bonded to the back surface 1566 of the face portion 1562 to attach the remaining portions of the filler material to the back surface 1566 of the face portion 1562, dampen noise and vibration, provide a certain feel and sound for the golf club head, and/or at least partially structurally support the face portion 1562. The thickness of the bonding agent and/or a portion of the filler material may depend on a thickness of the face portion 1562. In one example, a relationship between a thickness of the face portion 1562 and a thickness of a bonding agent and/or a portion of the filler material may be expressed as:

$$0.1 \leq T_f/T_a \leq 4.0$$

Where: $T_f$ is the thickness of the face portion in units of inches, and $T_a$ is the thickness of the bonding agent and/or the thickness of the filler material in units of inches.

In one example, the bonding agent and/or the filler material may have a thickness ranging from 0.02 inch (0.51 millimeters) to 0.2 inch (5.08 millimeters). In another example, the bonding agent and/or the filler material may be have a thickness ranging from 0.04 inch (0.1.02 millimeters) to 0.08 inch (2.03 millimeters). In another example, the bonding agent and/or the filler material may be have a thickness ranging from 0.03 inch (0.76 millimeters) to 0.06 inch (1.52 millimeters). In yet another example, the bonding agent and/or the filler material may have a thickness ranging from 0.01 inch (0.25 millimeters) to 0.3 inch (7.62 millimeters). The apparatus, methods, and articles of manufacture described herein are not limited in this regard.

Figure 31:
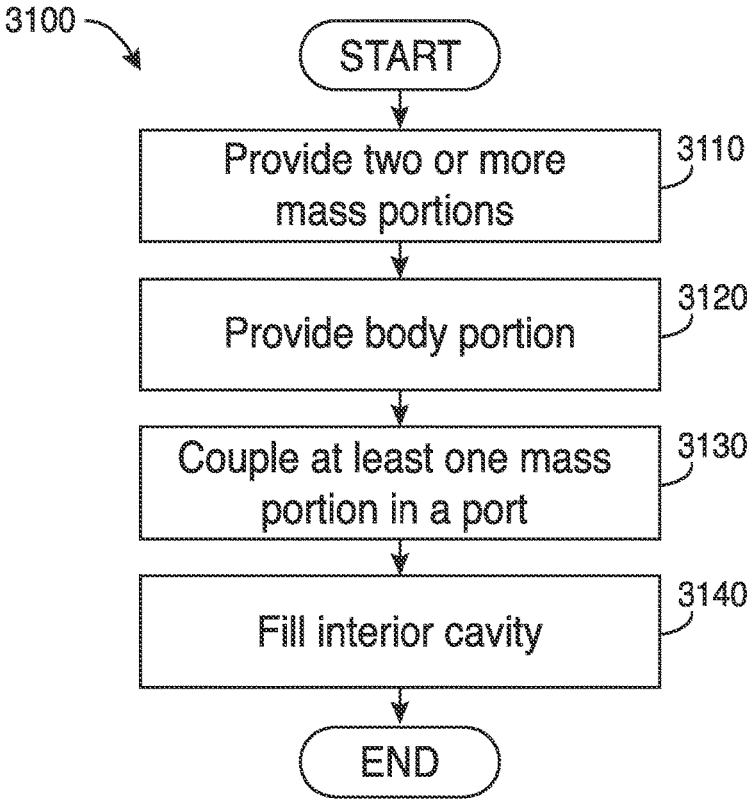
FIG. 31 depicts one manner in which a golf club head according to an embodiment of the apparatus, methods, and articles of manufacture described herein may be manufactured.

FIG. 31 depicts one manner in which the example golf club head described herein may be manufactured. In the example of FIG. 31, the process 3100 may begin with providing one or more mass portions, generally shown as the first and second sets of mass portions 1720 and 1730, respectively (block 3110). The first set of mass portions 1720 and/or the second set of mass portions 1730 may be made of a first material such as a tungsten-based material, a titanium-based material, a steel-based material, an aluminum-based material, a non-metal material, any combination thereof, or other suitable type of materials. In one example, the mass portions of the first and second sets of mass portions 1720 and 1730, respectively, may be tungsten-alloy screws.

The process 3100 may provide a body portion 1510 having the face portion 1562, the interior cavity 2100, and the back portion 1570 with two or more ports, generally shown as 1620 and 1630 (block 3120). The body portion 1510 may be made of a second material, which may be different than the first material or similar to the first material. The body portion 1510 may be manufactured using an investment casting process, a billet forging process, a stamping process, a computer numerically controlled (CNC) machining process, a die casting process, any combination thereof, or other suitable manufacturing processes. In one example, the body portion 1510 may be made of 17-4 PH stainless steel using a casting process. In another example, the body portion 1510 may be made of other suitable type of stainless steel (e.g., Nitronic® 50 stainless steel manufactured by AK Steel Corporation, West Chester, Ohio) using a forging process. By using Nitronic® 50 stainless steel to manufacture the body portion 1510, the golf club head 1500 may be relatively stronger and/or more resistant to corrosion than golf club heads made from other types of steel. One or more ports of the body portion 1510 may include an opening and a port wall. For example, the port 1621 may include the opening 2120 and the port wall 2125 with the opening 2120 and the port wall 2125 being on opposite ends of each other. The interior cavity 2100 may separate the port wall 2125 of the port 1621 and the back surface 1566 of the face portion 1562. In a similar manner, the port 1635 may include the opening 2130 and the port wall 2135 with the opening 2130 and the port wall 2135 being on opposite ends of each other. The interior cavity 2100 may separate the port wall 2135 of the port 1635 and the back surface 1566 of the face portion 1562.

The process 3100 may couple one or more mass portions of the first and second sets of mass portions 1720 and 1730 into one of the one or more ports (blocks 3130). In one example, the process 3100 may insert and secure the mass portion 1721 in the port 1621, and the mass portion 1735 in the port 1635. The process 3100 may use various manufacturing methods and/or processes to secure the first set of mass portions 1720 and/or the second set of mass portions 1730 in the ports such as the ports 1621 and 1635 (e.g., epoxy, welding, brazing, mechanical lock(s), any combination thereof, etc.).

Figure 32:
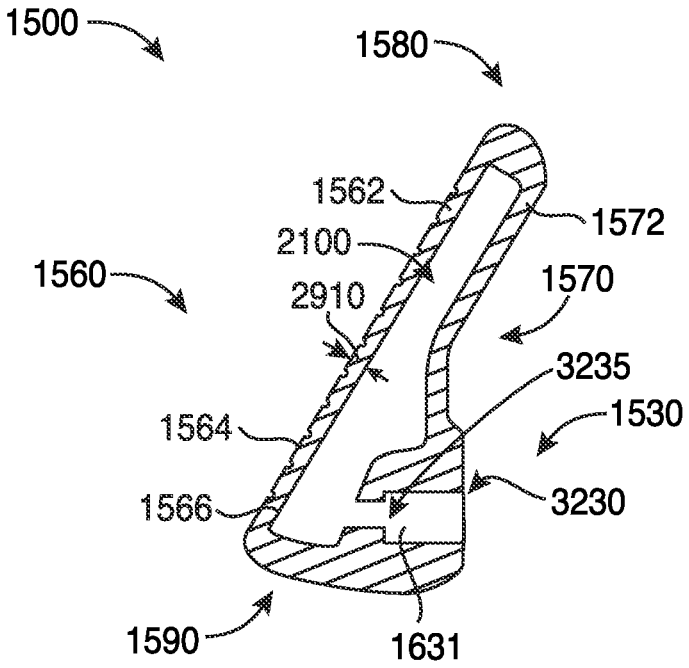
FIG. 32 depicts a cross-sectional view along line 32-32 of FIG. 18 of the golf club head of FIG. 15.

The process 3100 may partially or entirely fill the interior cavity 2100 with a filler material, which may be one or a combination of a polymer material (e.g., an ethylene copolymer material such as DuPont™ HPF family of materials) (block 3140) and/or a bonding agent (e.g., an adhesive or epoxy material such as 3M™ Scotch-Weld™ Epoxy Adhesives DP100, DP100 Plus, DP100NS and DP100FR). In one example, the filler material may fill at least 50% of the interior cavity 2100. The filler material may have a transparent gold color readily identifiable for quality control purposes. As mentioned above, the filler material may absorb shock, isolate vibration, and/or dampen noise in response to the golf club head 1500 striking a golf ball. In one example, the interior cavity 2100 may be filled with filler material, which may be a polymer material, a thermoplastic elastomer material, a thermoplastic polyurethane material, a bonding agent, and/or a combination thereof. In another example, the interior cavity 2100 may be entirely filled with a bonding agent. As illustrated in FIG. 32, for example, the golf club head 1500 may include one or more ports (e.g., one shown as 1631 in FIGS. 28 and 32) with a first opening 3230 and a second opening 3235. The second opening 3235 may be used to access the interior cavity 2100. In one example, the process 3100 (FIG. 31) may fill the interior cavity 2100 with a filler material by injecting the filler material into the interior cavity 2100 from the first opening 3230 via the second opening 3235. The first and second openings 3230 and 3235, respectively, may be the same or different in size and/or shape. While the above example may describe and depict a particular port with a second opening, any other ports of the golf club head 1500 may include a second opening (e.g., the port 1621). The apparatus, methods, and articles of manufacture described herein are not limited in this regard.

Referring back to FIG. 31, the example process 3100 is merely provided and described in conjunction with other figures as an example of one way to manufacture the golf club head 1500. While a particular order of actions is illustrated in FIG. 31, these actions may be performed in other temporal sequences. For example, two or more actions depicted in FIG. 31 may be performed sequentially, concurrently, or simultaneously. In one example, blocks 3110, 3120, 3130, and/or 3140 may be performed simultaneously or concurrently. Although FIG. 31 depicts a particular number of blocks, the process may not perform one or more blocks. In one example, the interior cavity 2100 may not be filled (i.e., block 3140 may not be performed). The apparatus, methods, and articles of manufacture described herein are not limited in this regard. The face portion 1562 may include a non-smooth back surface to improve adhesion and/or mitigate delamination between the face portion 1562 and the elastic polymer material used to fill the interior cavity 2100 (e.g., FIG. 21). Various methods and/or processes such as an abrasive blasting process (e.g., a bead blasting process, a sand blasting process, other suitable blasting process, or any combination thereof) and/or a milling (machining) process may be used to form the back surface 1566 into a non-smooth surface. For example, the back surface 1566 may have with a surface roughness (Ra) ranging from 0.5 to 250 μin (0.012 to 6.3 μm). The apparatus, methods, and articles of manufacture are not limited in this regard.

Figure 33:
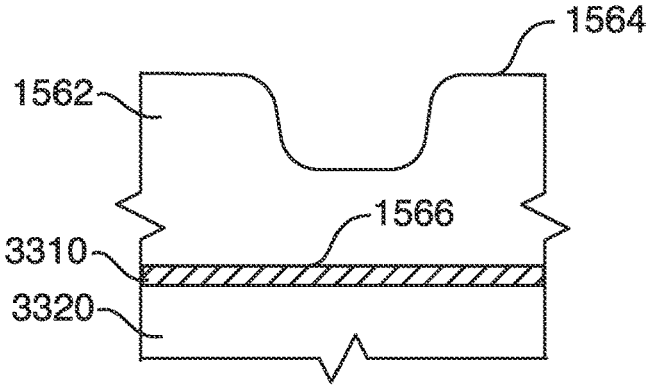
FIG. 33 depicts a partial cross-sectional view of the golf club head of FIG. 15.

Referring to FIG. 33, for example, the golf club head 1500 may include the face portion 1562, a bonding portion 3310, and a polymer material 3320. The bonding portion 3310 may provide connection, attachment and/or bonding of the polymer material 3320 to the face portion 1562. In one example, the bonding portion 3310 and/or the polymer material 3320 may define a filler material as described herein. The bonding portion 3310 may be a bonding agent such as any of adhesive or epoxy materials described herein, a tacky material, a combination of bonding agents, a bonding structure or attachment device (i.e., a physical and/or mechanical structure or device), a combination of bonding structures and/or attachment devices, and/or a combination of one or more bonding agents, one or more bonding structures and/or one or more attachment devices. The bonding portion 3310 may be integral with the polymer material 3320 to partially or entirely fill the interior cavity 2100. In other words, the polymer material 3320 may include inherent bonding properties. For example, the bonding portion 3310 may be a bonding agent mixed with the polymer material 3320 to provide bonding of the mixture to the back surface 1566 of the face portion 1562 and/or other inner surface(s) of the body portion 1510. In one example, the bonding portion may include one or more surface textures or surface structures on the back surface 1566 of the face portion 1562 to assist in adhesion of the polymer material to the back surface 1566 of the face portion. The apparatus, methods, and articles of manufacture are not limited in this regard.

For example, the golf club head 1500 may include a bonding agent such as any adhesive or epoxy materials described herein to improve adhesion and/or mitigate delamination between the face portion 1562 and the polymer material 3320 used to fill the interior cavity 2100 of the golf club head 1500 (e.g., FIG. 21). The bonding portion 3310 may be applied to the back surface 1566 of the face portion 1562 to bond the polymer material 3320 to the face portion 1562 (e.g., extending between the back surface 1566 and the polymer material 3320). For example, the bonding portion 3310 may be applied before or during when the interior cavity 2100 is filled with the polymer material 3320 via an injection molding process or other suitable process. The apparatus, methods, and articles of manufacture are not limited in this regard.

Figure 34:
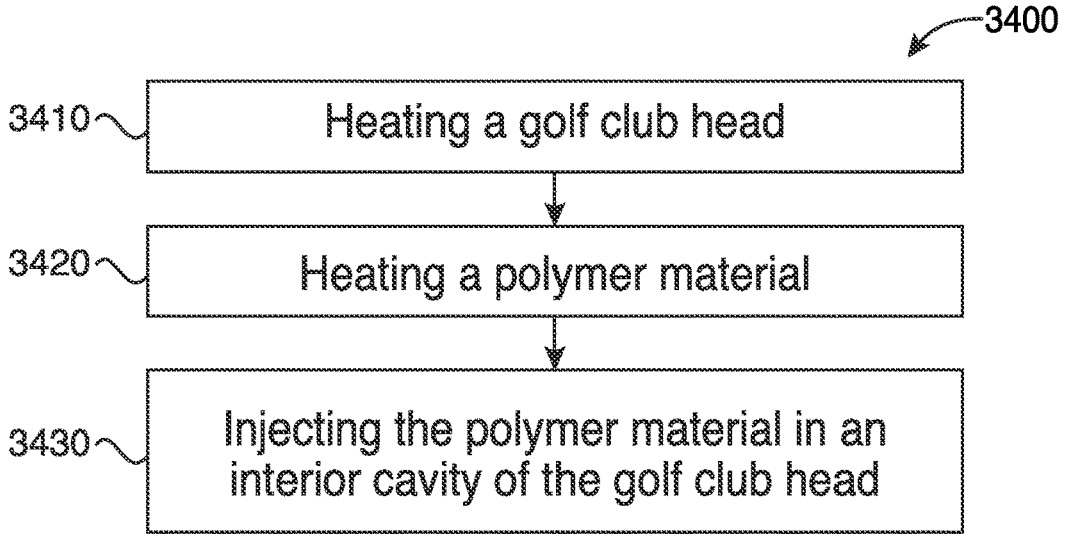
FIGS. 34 and 35 each depicts a manner, respectively, in which a golf club head according to an embodiment of the apparatus, methods, and articles of manufacture described herein may be manufactured.

FIG. 34 depicts one manner to partially or entirely fill the interior cavity 2100 of the golf club head 1500 or any of the golf club heads described herein with a filler material. The process 3400 may begin with heating the golf club head 1500 to a certain temperature (block 3410). In one example, the golf club head 1500 may be heated to a temperature ranging between 150° C. and 250° C., which may depend on factors such as the vaporization temperature of the one or more components of the filler material to be injected in the interior cavity 2100. The filler material may then be heated to a certain temperature (block 3420). In one example, the filler material may be a non-foaming and injection-moldable thermoplastic elastomer (TPE) material. Accordingly, the filler material may be heated to reach a liquid or a flowing state prior to being injected into the interior cavity 2100. The temperature at which the filler material may be heated may depend on the type of polymer material used to form the filler material. The heated filler material may be injected into the interior cavity 2100 to partially or fully fill the interior cavity 2100 (block 3430). The filler material may be injected into the interior cavity 2100 from one or more of the ports described herein (e.g., one or more ports of the first and second sets of ports 1620 and 1630, respectively, shown in FIG. 28). One or more other ports may allow the air inside the interior cavity 2100 displaced by the filler material to vent from the interior cavity 2100. In one example, the golf club head 1500 may be oriented horizontally as shown in FIG. 28 during the injection molding process. The filler material may be injected into the interior cavity 2100 from ports 1631 and 1632. The ports 1621, 1622 and/or 1623 may serve as air ports for venting the displaced air from the interior cavity 2100. Thus, regardless of the orientation of the golf club head 1500 during the injection molding process, the filler material may be injected into the interior cavity 2100 from one or more lower positioned ports while one or more upper positioned ports may serve as air vents. The mold (e.g., the golf club head 1500) may then be cooled passively (e.g., at room temperature) or actively so that the filler material reaches a solid state and adheres to the back surface 1566 of the face portion 1562. The filler material may directly adhere to the back surface 1566 of the face portion 1562. Alternatively, the filler material may adhere to the back surface 1566 of the face portion 1562 with the aid of the one or more structures on the back surface 1566 and/or the bonding portion 3310 shown in FIG. 33 (e.g., a bonding agent as described herein). The apparatus, methods, and articles of manufacture described herein are not limited in this regard.

As described above, the filler material may be heated to a liquid state (i.e., non-foaming) and may solidify after being injection molded in the interior cavity 2100. A filler material with a low modulus of elasticity may provide vibration and/or noise dampening of the face portion 1562 when the face portion 1562 impacts a golf ball. For example, a polymer material that foams when heated may provide vibration and/or noise dampening. However, such a foaming polymer material may not have sufficient rigidity to provide structural support to a relatively thin face portion because of possible excessive deflection and/or compression of the polymer material when absorbing the impact of a golf ball. In one example, the one or more components of the filler material that is injection molded in the interior cavity 2100 may have a relatively high modulus of elasticity to provide structural support to the face portion 1562 and yet elastically deflect to absorb the impact forces experienced by the face portion 1562 when striking a golf ball. Thus, a non-foaming and injection moldable polymer material with a relatively high modulus of elasticity may be used for partially or entirely filling the interior cavity 2100 to provide structural support and reinforcement for the face portion 1562 in addition to providing vibration and noise dampening. That is, the non-foaming and injection moldable polymer material may be a structural support portion for the face portion 1562. Further, the non-foaming and injection moldable polymer material may have a transparent gold color, which may be visible from the exterior of the golf club head 1500. The apparatus, methods, and articles of manufacture are not limited in this regard.

As described herein, the filler material may include a bonding portion. The bonding portion may include an adhesive or epoxy material with a thickness to provide structural support for the face portion 1562. Accordingly, the filler material may include a foaming polymer material to provide vibration and noise dampening whereas the bonding portion may provide structural support for the face portion 1562. The thickness of the bonding portion may depend on a thickness and physical properties of the face portion 1562 as described herein. The apparatus, methods, and articles of manufacture are not limited in this regard.

Figure 35:
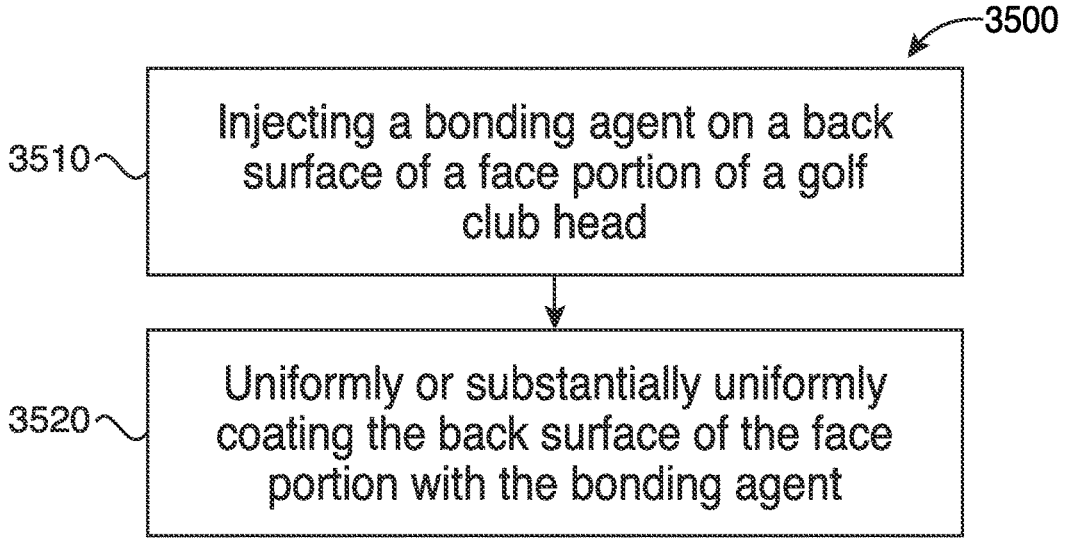

As described herein, the filler material may include a bonding agent (e.g., an adhesive or epoxy material) and a polymer material. FIG. 35 depicts one manner in which a bonding agent as described herein may be applied to a golf club head prior to partially or entirely filling the interior cavity 2100. In the example of FIG. 35, the process 3500 may begin with injecting a bonding agent on the back surface 1566 of the face portion 1562 (block 3510). The bonding agent may be injected on the back surface 1566 prior to or after heating the golf club head as described above depending on the properties of the bonding agent. The bonding agent may be injected through one or more of the first set of ports 1620 and/or the second set of ports 1630. The bonding agent may be injected on the back surface 1566 through several or all of the first set of ports 1620 and the second set of ports 1630. For example, an injection instrument such as a nozzle or a needle may be inserted into each port until the tip or outlet of the instrument is near the back surface 1566. The bonding agent may then be injected on the back surface 1566 from the outlet of the instrument. Additionally, the instrument may be moved, rotated and/or swiveled while inside the interior cavity 2100 so that the bonding agent is injected onto an area of the back surface 1566 surrounding the instrument. For example, the outlet of the injection instrument may be moved in a circular pattern while inside a port to inject the bonding agent in a corresponding circular pattern on the back surface 1566. Each of the first set of ports 1620 and the second set of ports 1630 may be utilized to inject a bonding agent on the back surface 1566. However, utilizing all of first set of ports 1620 and/or the second set of ports 1630 may not be necessary. For example, using every other adjacent port may be sufficient to inject a bonding agent on the entire back surface 1566. In another example, ports 1621, 1622, 1631, 1633 and 1636 may be used to inject the bonding agent on the back surface 1566. The apparatus, methods, and articles of manufacture are not limited in this regard.

The process 2100 may also include spreading the bonding agent on the back surface 1566 (block 3520) after injection of the bonding agent onto the back surface 1566 so that a generally uniform coating of the bonding agent is provided on the back surface 1566. According to one example, the bonding agent may be spread on the back surface 1566 by injecting air into the interior cavity 2100 through one or more of the first set of ports 1620 and the second set of ports 1630. The air may be injected into the interior cavity 2100 and on the back surface 1566 by inserting an air nozzle into one or more of the first set of ports 1620 and the second set of ports 1630. According to one example, the air nozzle may be moved, rotated and/or swiveled at a certain distance from the back surface 1566 so as to uniformly blow air onto the bonding agent to spread the bonding agent on the back surface 1566 for a uniform coating or a substantially uniform coating of the bonding agent on the back surface 1566. The apparatus, methods, and articles of manufacture are not limited in this regard.

The example process 3500 is merely provided and described in conjunction with other figures as an example of one way to manufacture the golf club head 1500. While a particular order of actions is illustrated in FIG. 35, these actions may be performed in other temporal sequences. Further, two or more actions depicted in FIG. 35 may be performed sequentially, concurrently, or simultaneously. The process 3500 may include a single action of injecting and uniformly or substantially uniformly coating the back surface 1566 with the bonding agent. In one example, the bonding agent may be injected on the back surface 1566 by being converted into fine particles or droplets (i.e., atomized) and sprayed on the back surface 1566. Accordingly, the back surface 1566 may be uniformly or substantially uniformly coated with the bonding agent in one action (i.e., a substantially uniform coating of bonding agent particles, droplets or beads). A substantially uniform coating of the back surface 1566 with the bonding agent may be defined as a coating having slight non-uniformities due to the injection process or the manufacturing process. However, such slight non-uniformities may not affect the bonding of the polymer material to the back surface 1566 with the bonding agent as described herein. For example, spraying the bonding agent on the back surface 1566 may result in overlapping regions of the bonding agent having a slightly greater coating thickness than other regions of the bonding agent on the back surface 1566. The apparatus, methods, and articles of manufacture are not limited in this regard.

Figure 36:
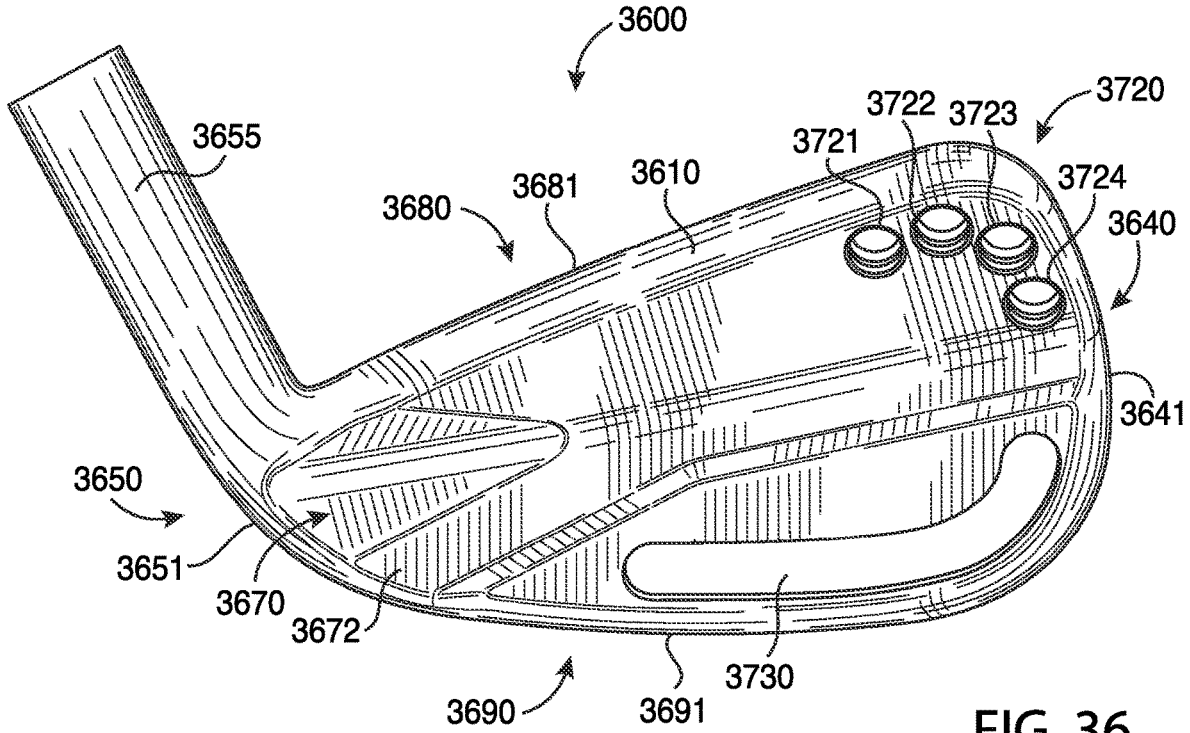
FIGS. 36 and 37 depict rear views of a golf club head according to an embodiment of the apparatus, methods, and articles of manufacture described herein.
Figure 37:
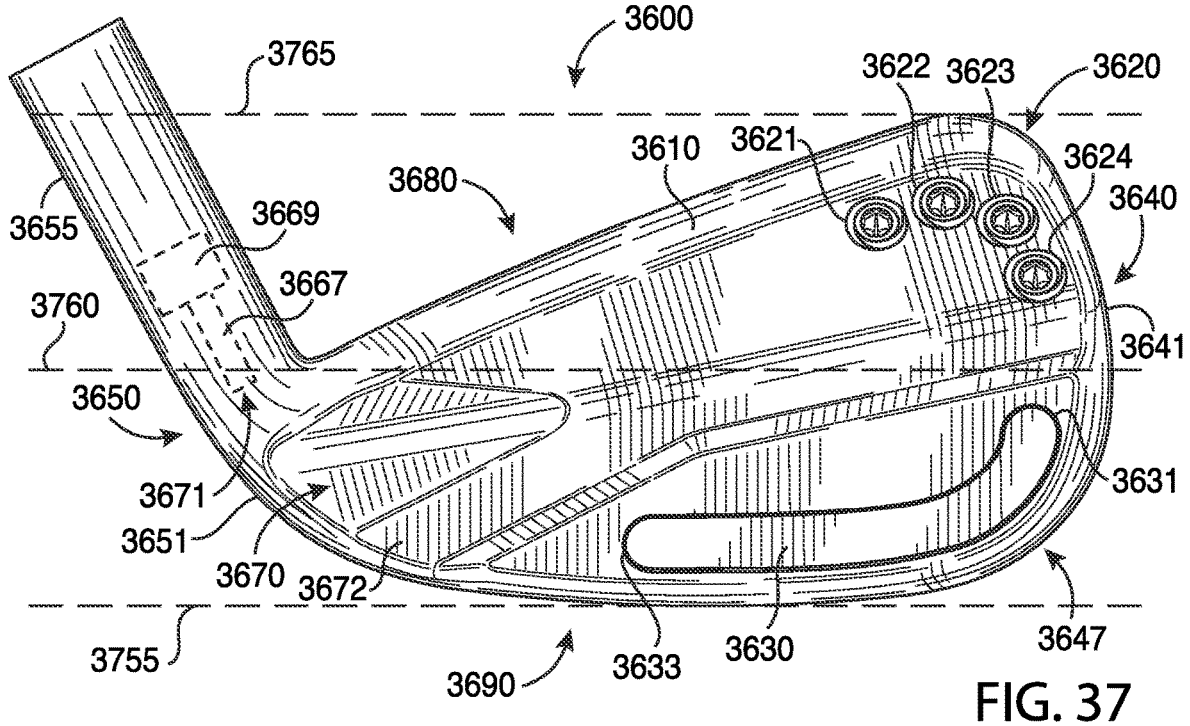

As described herein, any two or more of the mass portions may be configured as a single mass portion. In the example of FIGS. 36 and 37, a golf club head 3600 may include a body portion 3610 having a toe portion 3640 with a toe portion edge 3641, a heel portion 3650 with a heel portion edge 3651, a front portion (not shown), a back portion 3670 with a back wall portion 3672, a top portion 3680 with a top portion edge 3681, and a sole portion 3690 with a sole portion edge 3691. The golf club head 3600 may be similar in many respects to the golf club head 1500 or any of the golf club heads described herein. The golf club head 3600 may include one or more mass portions, generally shown as a first set of mass portions 3620 (e.g., shown as mass portions 3621, 3622, 3623, and 3624) and a second mass portion 3630. The body portion 3610 may be made of a first material whereas the first set of mass portions 3620 and/or the second mass portion 3630 may be made of a second material. The first and second materials may be similar or different materials. The first and second materials of the body portion 3610 and/or the first and second sets of mass portions 3620 and 3630, respectively, may be similar to the first and second materials of the golf club head 1500. The heel portion 3650 may include a hosel portion 3655 configured to receive a shaft (a shaft 1504 shown in FIG. 14) with a grip (a grip 1506 shown in FIG. 14) on one end, and the golf club head 3600 on the opposite end of the shaft to form a golf club. The front portion may be similar to the front portion 1560 of the golf club head 1500. Further, the golf club head 3600 may be the same type of golf club head as any of the golf club heads described herein. The apparatus, methods, and articles of manufacture are not limited in this regard.

The body portion 3610 may include one or more ports along a periphery of the body portion 3610, generally shown as a first set of ports 3720 (e.g., shown as ports 3721, 3722, 3723, and 3724) and a second port 3730. The first set of ports 3720 and/or the second set of ports 3730 may be at any internal or external location on the body portion 3610. In one example, as shown in FIGS. 36 and 37, the first set of ports 3720 and the second set of ports 3730 may be located on the back wall portion 3672 along or proximate to a periphery of the body portion 3610. In one example, as shown in FIGS. 36 and 37, the first set of ports 3720 may be above a horizontal midplane 3760 of the body portion 3610 and the second set of ports 3730 may be below the horizontal midplane 3760. In one example, as shown in FIGS. 36 and 37, a distance between each port of the first set of ports 3720 and the toe portion edge 3641 may be less than a distance between each port of the first set of ports 3720 and the hosel portion 3655, respectively. Each port of the first set of ports 3720 may be associated with a port diameter and at least one port of the first set of ports 3720 may be separated from an adjacent port similar to any of the ports described herein. The apparatus, methods, and articles of manufacture are not limited in this regard.

One or more mass portion of the first set of mass portions 3620 (e.g., shown as mass portions 3621, 3622, 3623, and 3624) may be disposed in a port of the first set of ports 3720 (e.g., shown as ports 3721, 3722, 3723, and 3724) located at or proximate to the toe portion 3640 and/or the top portion 3680 on the back portion 3670. The physical properties and/or configurations of the first set of ports 3720 and the first set of mass portions 3620 may be similar to the golf club head 1500. The apparatus, methods, and articles of manufacture are not limited in this regard.

The second port 3730 may have any configuration and/or extend to and/or between the toe portion 3640 and the heel portion 3650. As illustrated in FIG. 36, for example, the second port 3730 may be a recess extending from the toe portion 3640 or a location proximate to the toe portion 3640 to the sole portion 3690 or a location proximate to the sole portion 3690. Accordingly, the second port 3730 may resemble an L-shaped recess. The second mass portion 3630 may resemble the shape of the second port 3730 and may be disposed in the second port 3730. The second mass portion 3630 may have a first end 3631 and a second end 3633. As shown in FIG. 37, a distance between the first end 3631 and the toe portion edge 3641 may be less than a distance between the second end 3633 and the toe portion edge 3641. As further shown in FIG. 37, a distance between the first end 3631 and the horizontal midplane 3760 may be less than a distance between the second end 3633 and the horizontal midplane 3760. The second mass portion 3630 may be partially or fully disposed in the second port 3730. For example, as shown in FIG. 36, the length of the second port 3730 may be greater than the width of the second port 3730. Accordingly, as shown in FIG. 37, the length of the second mass portion 3630 may be greater than the width of the second mass portion 3630. The second mass portion 3630 may have any shape such as oval, rectangular, triangular, or any geometric or non-geometric shape. The second port 3730 may be shaped similar to the second mass portion 3630. However, portion(s) of the second mass portion 3630 that are inserted in the second port 3730 may have similar shapes as the second port 3730. In one example (not shown), the second port 3730 may have a generally rectangular shape and located at or near the sole portion 3690 extending to and/or between the toe portion 3640 and the heel portion 3650. Accordingly, at least a portion of the second mass portion 3630 may have a similar shape as the second port 3730. As described herein, any of the mass portions described herein, including the first set of mass portions 3620 and the second mass portion 3630 may be coupled to the back portion 3670 of the body portion 3610 with various manufacturing methods and/or processes (e.g., a bonding process, a welding process, a brazing process, a mechanical locking method, any combination thereof, or other suitable manufacturing methods and/or processes). The second mass portion 3630 may be a polymer material that may be injection molded into the second port 3730 as described herein. Also, as described herein, any of the mass portions described herein including the second mass portion 3630 may be integral with the body portion 3610. The apparatus, methods, and articles of manufacture are not limited in this regard.

The second mass portion 3630 may affect the location of the CG of the golf club head 1500 and the MOI of the golf club head about a vertical axis that extends through the CG of the golf club head 3600. All or a substantial portion of the second mass portion 3630 may be generally near the sole portion 3690. For example, the second mass portion 3630 may be near the periphery of the body portion 3610 and extend to and/or between the sole portion 3690 and the toe portion 3640. As shown in the example of FIG. 37, the second mass portion 3630 may be located at or proximate to the periphery of the body portion 3610 and partially or substantially extend at or proximate to the sole portion 3690. A portion of the second mass portion 3630 may be located near the periphery of the body portion 3610 and extend to and/or between the sole portion 3690 and the toe portion 3640 to lower the CG and increase the MOI of the golf club head 3600 about a vertical axis that extends through the CG. To lower the CG of the golf club head 3600, all or a portion of the second mass portion 3630 may be located closer to the sole portion 3690 than to a horizontal midplane 3760 of the golf club head 3600. The horizontal midplane 3760 may be vertically halfway between the ground and top planes 3755 and 3765, respectively. The location of the second mass portion 3630 (i.e., the location of the second port 3730) and the physical properties and materials of construction of the mass portions of the second port 3730 may be determined to optimally affect the mass, mass distribution, CG, MOI characteristics, structural integrity and/or or other static and/or dynamic characteristics of the golf club head 3600. The apparatus, methods, and articles of manufacture described herein are not limited in this regard.

In one example, the golf club head 1500 may include a badge portion (not shown). The badge portion may be configured to adhere to an exterior surface of the body portion 1510 and/or to cover one or more ports (e.g., port 3730) in the body portion 1510. The badge portion may install in and/or cover one or more ports in the body portion 1510. The badge portion may include a vibration dampening portion having polymer material(s) (e.g., polycarbonate ABS, nylon, or a combination of these materials). For example, the badge portion may include an elastomer material (e.g., butyl rubber) and/or a synthetic elastomer material (e.g., polyurethane, a thermoplastic or thermoset material polymer, or silicone). The badge portion may include a badge mass portion embedded in or otherwise attached to the vibration dampening portion. The badge mass portion may include metal-based material(s) (e.g., steel, aluminum, nickel, cobalt, titanium, or alloys including these materials). The badge portion may be coupled to the body portion 1510 with an adhesive, an epoxy, other suitable bonding process, mechanical lock(s), and/or any combination thereof. The badge portion may serve to identify a manufacturer or a model through inclusion of certain text, colors, symbols, logos, and/or trademarks. The apparatus, methods, and articles of manufacture described herein are not limited in this regard.

To balance the mass of a golf club head, such as any of the golf club heads described herein, a golf club head may include one or more hosel mass portions. In one example, the golf club head 3600 may include hosel mass portions 3667 and 3669. The hosel mass portion 3667 may be permanently attached to the hosel portion 3655 whereas the hosel mass portion 3669 may be removable and exchangeable with other hosel mass portions to balance the mass of the golf club head 3600 at the hosel portion 3655. The hosel mass portions 3667 and 3669 may be a third set of mass portions for the golf club head 3600. In one example, the hosel mass portions 3667 and 3669 and the first set of mass portions 3620 may be collectively the first set of mass portions. The apparatus, methods, and articles of manufacture described herein are not limited in this regard.

While the figures may depict a particular number of mass portions in the hosel portion 3655 (e.g., two shown as hosel mass portions 3667 and 3669), the apparatus, methods, and articles of manufacture described herein may include separate mass portions or a single mass portion (e.g., the hosel mass portions 3667 and 3669 may be a single mass portion). The hosel mass portions 3667 and/or 3669 may be the same or different material than the body portion 3610 and/or other mass portions of the golf club head 3600 (e.g., generally shown as 3620 and 3630). The mass of each of the hosel mass portions 3667 and 3669 may be greater than, less than, or equal to the mass of any other mass portions of the golf club head 3600 (e.g., generally shown as 3620 and 3630). Further, the hosel portion 3655 may include one or more ports configured to receive and/or engage one or more mass portions. In one example, a port (e.g. one shown as 3671 in FIG. 37) in the hosel portion 3655 may be connected to an interior cavity (e.g., one schematically shown as 2100 in FIG. 21) of the golf club head. The port 3671 in the hosel portion 3655 may include an opening. Accordingly, the interior cavity may be partially or entirely filled through an opening of the port 3671 in the hosel portion 3655. For example, the polymer material may be injected into the interior cavity from the port 3671. The hosel mass portions 3667 and/or 3669 may enclose the port 3671 in the hosel portion 3655. In one example, the hosel mass portions 3667 and/or 3669 may be a screw to engage the port 3671 in the hosel portion 3655. In another example, the hosel mass portions 3667 and/or 3669 may not include any threads (i.e., the hosel mass portions 3667 and/or 3669 may be coupled to the port 3671 in the hosel portion 3655 with or without adhesive. The apparatus, methods, and articles of manufacture described herein are not limited in this regard.

Figure 38:
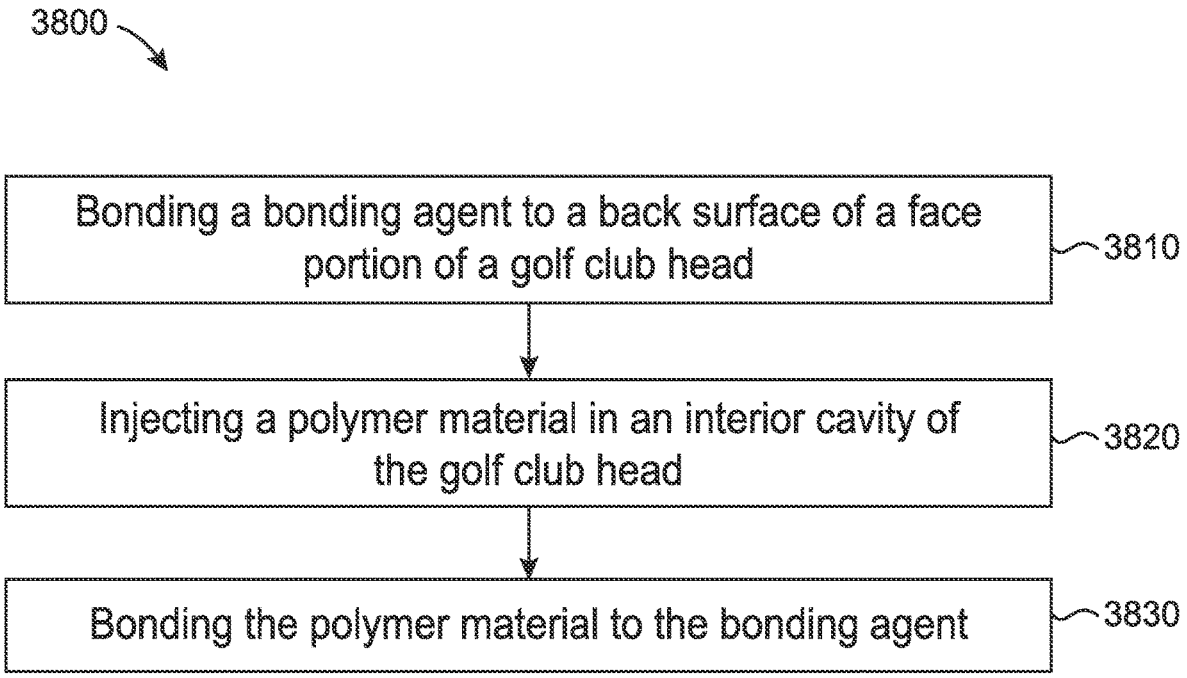
FIGS. 38 and 39 each depicts a manner, respectively, in which a golf club head according to an embodiment of the apparatus, methods, and articles of manufacture described herein may be manufactured.
Figure 39:
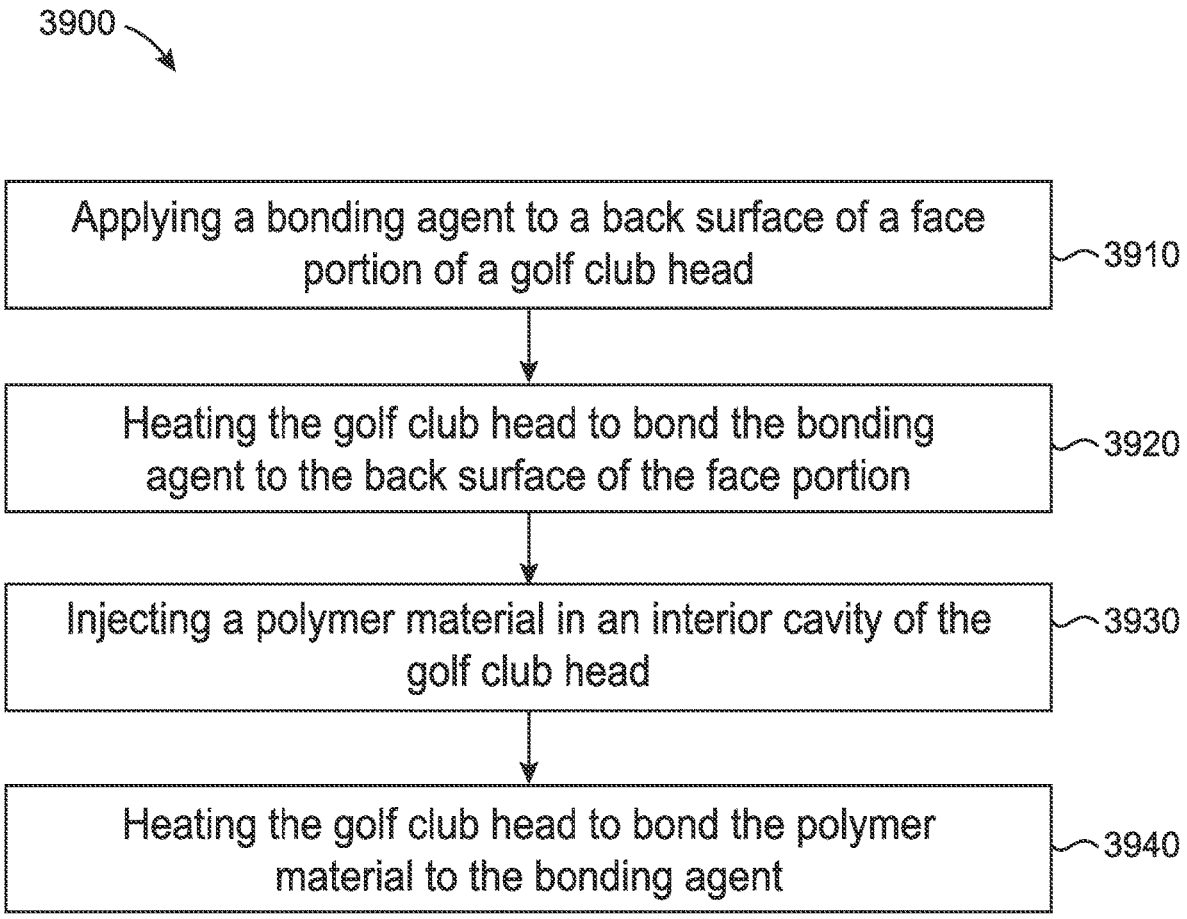
Figure 40:
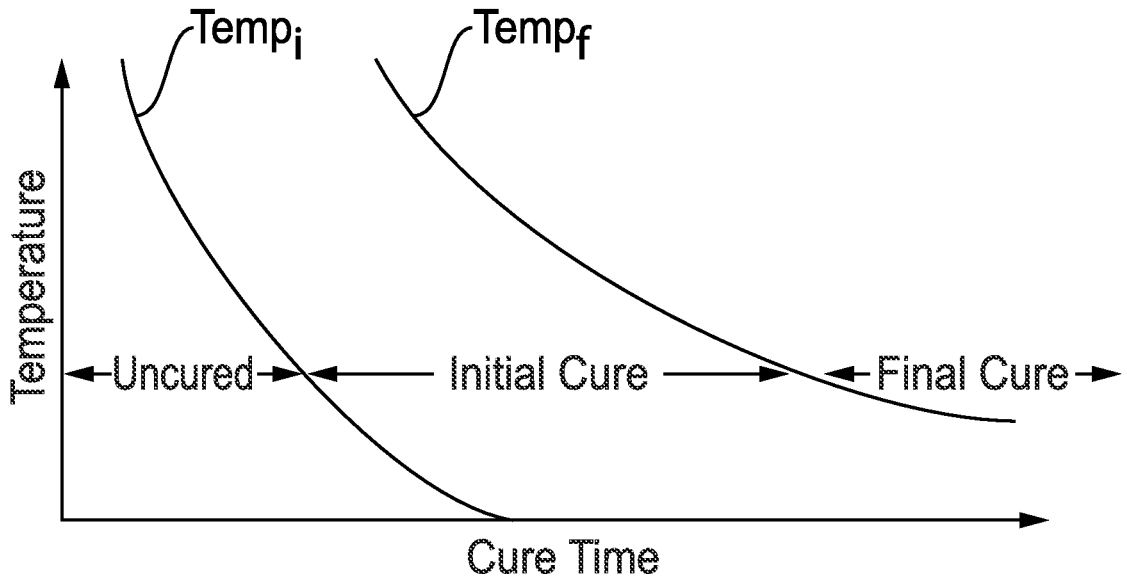
FIG. 40 depicts an example of curing a bonding agent according to an embodiment of the apparatus, methods, and articles of manufacture described herein.

For brevity, the description of processes described herein with reference to FIGS. 38-40 may be provided in reference to the golf club head 1500. However, any apparatuses, methods, and articles of manufacture described herein are applicable to any of the golf club heads described herein. FIG. 38 depicts one manner that the interior cavity of any of the golf club heads described herein may be partially or entirely filled with one or more filler materials such as any of the filler materials described herein. The example process 3800 may begin with bonding a bonding agent to the back surface 1566 of the face portion 1562 of the golf club head 1500 (block 3810). The bonding agent may have an initial bonding state, which may be a temporary bonding state, and a final bonding state, which may be a permanent bonding state. The initial bonding state and the final bonding states may be activated when the bonding agent is exposed to heat, radiation, and/or other chemical compounds. For example, as described herein, the bonding agent may be an epoxy having an initial cure state and a final cure state that are activated by the epoxy being heated to different temperatures for a period of time, respectively, by conduction, convention, and/or radiation. In another example, the bonding agent may be a bonding material that is activated to an initial bonding state and a final bonding state by being exposed to different doses and/or duration of ultraviolet radiation, respectively. In another example, the bonding agent may be a bonding material that is activated to an initial bonding state and a final bonding state by being exposed to different compounds or different amounts of the same compound, respectively. According to the process 3800, the bonding agent may be bonded to the back surface 1566 of the face portion 1562 by being activated to the initial bonding state. A polymer material is then injected in the interior cavity 2100 of the golf club head 1500 (block 3820). The example process 3800 then includes bonding the polymer material to the bonding agent (block 3830). Bonding the polymer material to the bonding agent may include activating the bonding agent to the final bonding state to permanently bond the polymer material to the bonding agent and to permanently bond the bonding agent to the back surface 1566 of the face portion 1562. The example process 3800 is merely provided and described in conjunction with other figures as an example of one way to manufacture the golf club head 1500. While a particular order of actions is illustrated in FIG. 38, these actions may be performed in other temporal sequences. Further, two or more actions depicted in FIG. 38 may be performed sequentially, concurrently, or simultaneously.

FIG. 39 depicts one manner that the interior cavity 2100 of the golf club head 1500 or any of the golf club heads described herein may be partially or entirely filled with one or more filler materials such any of the filler materials described herein. The process 3900 may begin with applying a bonding agent (e.g., a bonding portion 3310 of FIG. 33) to the back surface 1566 of the face portion 1562 of the golf club head 1500 (block 3910). The bonding agent may be any type of adhesive and/or other suitable materials. In one example, the bonding agent may be an epoxy. Prior to applying the bonding agent, the golf club head 1500 may be cleaned to remove any oils, other chemicals, debris or other unintended materials from the golf club head 1500 (not shown). The bonding agent may be applied on the back surface 1566 as described herein depending on the properties of the bonding agent. The bonding agent may be applied to the back surface 1566 of the face portion 1562 through one or more of the first set of ports 1620 and/or the second set of ports 1630. For example, the bonding agent may be in liquid form and injected on the back surface 1566 through several or all of the first set of ports 1620 and the second set of ports 1630. An injection instrument (not shown) such as a nozzle or a needle may be inserted into each port until the tip or outlet of the injection instrument is near the back surface 1566. The bonding agent may then be injected on the back surface 1566 from the outlet of the injection instrument. Additionally, the injection instrument may be moved, rotated, and/or swiveled while inside the interior cavity 2100 so that the bonding agent may be injected onto an area of the back surface 1566 surrounding the injection instrument. For example, the outlet of the injection instrument may be moved in a circular pattern while inside a port to inject the bonding agent in a corresponding circular pattern on the back surface 1566. Each of the first set of ports 1620 and the second set of ports 1630 may be utilized to inject a bonding agent on the back surface 1566. However, utilizing all of first set of ports 1620 and/or the second set of ports 1630 may not be necessary. For example, using every other adjacent port may be sufficient to inject a bonding agent on the entire back surface 1566. In another example, ports 1621, 1622, 1631, 1633 and 1636 may be used to inject the bonding agent on the back surface 1566. The apparatus, methods, and articles of manufacture are not limited in this regard.

The example process 3900 may also include spreading or overlaying the bonding agent on the back surface 1566 (not shown) after injecting the bonding agent onto the back surface 1566 so that a generally uniform coating of the bonding agent is provided on the back surface 1566. According to one example, the bonding agent may be spread on the back surface 1566 by injecting air into the interior cavity 2100 through one or more ports of the first set of ports 1620 and/or the second set of ports 1630. The air may be injected into the interior cavity 2100 and on the back surface 1566 by inserting an air nozzle into one or more ports of the first set of ports 1620 and/or the second set of ports 1630. According to one example, the air nozzle may be moved, rotated and/or swiveled at a certain distance from the back surface 1566 to uniformly blow air onto the bonding agent and spread the bonding agent on the back surface 1566 for a uniform coating or a substantially uniform coating of the bonding agent on the back surface 1566. Further, the golf club head 1500 may be pivoted back and forth in one or several directions so that the bonding agent may spread along a portion or substantially the entire area of the back surface 1566 of the face portion 1562. In one example, the golf club head 1500 may be vibrated with the back surface 1566 of the face portion 1562 in a generally horizontal orientation so that the bonding agent may spread or overlay on the back surface 1566 in a uniform coating manner or a substantially uniform coating manner. The apparatus, methods, and articles of manufacture are not limited in this regard.

The example process 3900 is merely provided and described in conjunction with other figures as an example of one way to manufacture the golf club head 1500 or any of the golf club heads described herein. While a particular order of actions is illustrated in FIG. 39, these actions may be performed in other temporal sequences. Further, two or more actions depicted in FIG. 39 may be performed sequentially, concurrently, or simultaneously. The example process 3900 may include a single action (not shown) of injecting and uniformly or substantially uniformly coating the back surface 1566 with the bonding agent. In one example, the bonding agent may be injected on the back surface 1566 by being converted into fine particles or droplets (i.e., atomized) and sprayed on the back surface 1566. Accordingly, the back surface 1566 may be uniformly or substantially uniformly coated with the bonding agent in one action. A substantially uniform coating of the bonding agent on the back surface 1566 may be defined as a coating having slight non-uniformities due to the injection process or the manufacturing process. However, such slight non-uniformities may not affect the bonding of the elastic polymer material or elastomer material to the back surface 1566 with the bonding agent as described herein. For example, spraying the bonding agent on the back surface 1566 may result in overlapping regions of the bonding agent having a slightly greater coating thickness than other regions of the bonding agent on the back surface 1566. The apparatus, methods, and articles of manufacture are not limited in this regard.

In one example as shown in FIG. 40, the bonding agent may be an epoxy having different curing states based on the temperature and the amount of time to which the epoxy may be exposed. The bonding agent may have an uncured state, an initial cure state, and a final cure state. In one example, the uncured state may be a liquid state, the initial cure state may be gel or a semi-solid/semi-liquid state, and the final cure state may be a solid state. The bonding agent may transition from the uncured state to the initial cure state when the bonding agent is heated to a temperature between an initial cure state temperature ($Temp_i$) and a final cure state temperature ($Temp_f$) for a period of time. Accordingly, an initial cure state temperature range may be defined by temperatures that are greater than or equal to the initial cure state temperature $Temp_i$ and less than the final cure state temperature $Temp_f$. The bonding agent may transition from the initial cure state to the final cure state when the bonding agent may be heated to a temperature greater than or equal to the final cure state temperature $Temp_f$ for a period of time. Accordingly, a final cure state temperature range may be defined by temperatures that are greater than or equal to the final cure state temperature $Temp_f$. The initial cure state temperature $Temp_i$ and the final cure state temperature $Temp_f$ may vary based on the amount of time that the bonding agent may be heated. In particular, a transition from the uncured state to the initial cure state and a transition from the initial cure state to the final cure state may be dictated by certain temperature and time profiles based on the properties of the bonding agent. At a temperature below the initial cure temperature $Temp_i$, the bonding agent may be in the uncured state (e.g., a liquid state). In the initial cure state, the bonding agent may form an initial bond with an object and become pliable to be manipulated (e.g., moved, spread, overlay, etc.) without obtaining full cross linking or forming a permanent bond. In other words, the bonding agent may form an initial bond with an object and be manipulated without forming a permanent bond. In the final cure state, the bond of the bonding agent (e.g., cross linking for a bonding agent that includes epoxy) may be complete or become permanently set.

The bonding agent may be applied to the back surface 1566 of the face portion 1562 when the bonding agent is in the uncured state, which may be a liquid state. Subsequently, the golf club head 1500 and/or the bonding agent may be heated to a first temperature $Temp_1$ that is greater than or equal to the initial cure state temperature $Temp_i$ and less than the final cure state temperature $Temp_f$ to change the bonding agent from an uncured state to an initial cure state (i.e., an initial cure state temperature range) (block 3920). Accordingly, the bonding agent may form an initial bond with the back surface 1566 of the face portion 1562. After bonding the bonding agent to the back surface 1566, the golf club head 1500 may be cooled for a period of time at ambient or room temperature (not shown). Accordingly, the bonding agent may be in an initial cured state and bonded to the back surface 1566 of the face portion 1562 so that the bonding agent may be bonded to the back surface 1566 during the injection molding of a polymer material in the interior cavity 2100. Ambient or room temperature may be defined as a room temperature ranging between 5° C. (32° F.) and 31° C. (104° F.). The first temperature $Temp_1$ and duration by which the golf club head 1500 and/or the bonding agent heated to the first temperature $Temp_1$ may depend on the curing or bonding properties of the bonding agent. The apparatus, methods, and articles of manufacture are not limited in this regard.

After the bonding agent is bonded to the back surface 1566 of the face portion 1562, the golf club head 1500 may be heated (i.e., pre-heating the golf club head 1500) prior to receiving a polymer material (not shown). The golf club head 1500 may be heated so that when the polymer material is injected in the golf club head 1500, the polymer material is not cooled by contact with the golf club head and remains in a flowing liquid form to fill the interior cavity 2100. The temperature at which the golf club head is heated, which may be referred to herein as a third temperature, may be similar to the temperature of the polymer material when being injected into the interior cavity 2100. However, the temperature at which the golf club head is heated may be less than the final cure temperature $Temp_f$ of the bonding agent. Accordingly, the bonding agent may not transition from the initial cure state to the final cured state during the injection molding process. Further, the pre-heating temperature of the golf club head 1500 may be determined so that excessive cooling of the golf club head 1500 may not be necessary after injection molding the polymer material in the interior cavity 2100. Prior to being injected into the interior cavity 2100, the polymer material may also be heated to a liquid state (not shown). The temperature at which the polymer material may be heated may depend on the type of polymer material used to partially or fully fill the interior cavity 2100. Further, the temperature at which the polymer material is heated may be determined so that shrinkage of the polymer material is reduced during the injection molding process. However, as described herein, the polymer material may be heated to a temperature that is less than the final cure temperature $Temp_f$ of the bonding agent. The apparatus, methods, and articles of manufacture are not limited in this regard.

As described herein, the interior cavity 2100 may be partially or fully filled with a polymer material by injecting the polymer material in the interior cavity 2100 (block 3930). The injection speed of the polymer material may be determined so that the interior cavity 2100 may be slowly filled to provide a better fill while allowing air to escape the interior cavity 2100 and allowing the injected polymer material to rapidly cool. For example, the polymer material may be a non-foaming and injection-moldable thermoplastic elastomer (TPE) material. The polymer material may be injected into the interior cavity 2100 from one or more of the ports described herein (e.g., one or more ports of the first and second sets of ports 1620 and 1630, respectively, shown in FIG. 28). One or more other ports may allow the air inside the interior cavity 2100 displaced by the polymer material to vent from the interior cavity 2100. In one example, the golf club head 1500 may be oriented horizontally as shown in FIG. 28 during the injection molding process. The polymer material may be injected into the interior cavity 2100 from ports 1631 and 1632. The ports 1621, 1622 and/or 1623 may serve as air ports for venting the displaced air from the interior cavity 2100. Thus, regardless of the orientation of the golf club head 1500 during the injection molding process, the polymer material may be injected into the interior cavity 2100 from one or more lower positioned ports while one or more upper positioned ports may serve as air vents.

According to one example, any one of the ports or any air vent of the golf club head 1500 used as air port(s) for venting the displaced air may be connected to a vacuum source (not shown) during the injection molding process. Accordingly, air inside the interior cavity 2100 and displaced by the polymer material may be removed from the interior cavity 2100 by the vacuum source. Accordingly, trapped air pocket(s) in the interior cavity 2100 and/or a non-uniform filling of the interior cavity 2100 with the polymer material may be reduced. The apparatus, methods, and articles of manufacture described herein are not limited in this regard.

After injecting the polymer material into the interior cavity 2100, the golf club head 1500 may be heated to a second temperature $Temp_2$ that is greater than or equal to the final cure temperature $Temp_f$ of the bonding agent to reactivate the bonding agent to bond the polymer material to the bonding agent (i.e., a final cure state temperature range) (block 3940). The second temperature $Temp_2$ and the duration by which the golf club head 1500 is heated to the second temperature $Temp_2$ may depend on the properties of the bonding agent as shown in FIG. 40 to form a permanent bond between the golf club head 1500 and the bonding agent and between the polymer material and the bonding agent. The golf club head 1500 may be then cooled at ambient or room temperature (not shown). According to one example, the characteristic time (CT) of the golf club head 1500 may be measured (not shown) after manufacturing the golf club head 1500 as described herein. CT measurements may determine if the golf club head 1500 conforms to CT rules established by one or more golf governing bodies.

In one example, for any of the golf club heads described herein, the thickness of the face portion ($T_f$) may be related to a thickness of the bonding agent ($T_b$) by the following expression:

$$T_b = d \cdot T_f$$

Where: $1 \leq d \leq 6$ $T_f$ is the thickness of the face portion in units of inch, and $T_b$ is the thickness of the bonding agent in units of inch.

In one example, according to the above expression, the thickness of the bonding agent may be similar to the thickness of the face portion. For example, the thickness of the face portion and the thickness of the bonding agent may be 0.050 inch (1.25 mm). In another example, the thickness of the bonding agent may be twice the thickness of the face portion. For example, the thickness of the face portion may be 0.05 inch (1.25 mm) and the thickness of the bonding agent may be 0.1 inch (2.54 mm). In another example, the thickness of the bonding agent may be four times greater than the thickness of the face portion. For example, the thickness of the face portion may be 0.05 inch (1.25 mm) and the thickness of the bonding agent may be 0.2 inch (5.08 mm). In yet another example, the thickness of the bonding agent may be five times greater than to the thickness of the face portion. For example, the thickness of the face portion may be 0.05 inch (1.25 mm) and the thickness of the bonding agent may be 0.3 inch (7.62 mm). The apparatus, methods, and articles of manufacture described herein are not limited in this regard.

In one example, for any of the golf club heads described herein, the hardness of the face portion may be greater than the hardness of the bonding agent, and the hardness of the bonding agent may be greater than the hardness of the polymer material or polymer material that at least partially fills the golf club head as described herein. The relationship between the hardness of the face portion, the hardness of the bonding agent, and the hardness of the polymer material may be expressed as:

$$D_f > D_b > D_e$$

Where:

$D_f$ is the hardness of the face portion, $D_b$ is the hardness of the bonding agent, and $D_e$ is the hardness of the polymer material.

In one example, the hardness of the face portion may be greater than or equal to 35 HRC (Rockwell Hardness C) and less than or equal to 55 HRC. In another example, the hardness of the face portion may be greater than or equal to 45 HRC and less than or equal to 65 HRC. The apparatus, methods, and articles of manufacture described herein are not limited in this regard.

In one example, the hardness of the bonding agent may be greater than or equal to 20 Shore D (Shore durometer hardness type D) and less than or equal to 90 Shore D. In another example, the hardness of the bonding agent may be greater than or equal to 30 Shore D and less than or equal to 60 Shore D. In yet another example, the hardness of the bonding agent may be greater than or equal to 40 Shore D and less than or equal to 50 Shore D. In yet another example, the hardness of the bonding agent may be greater than or equal to 55 Shore D and less than or equal to 70 Shore D. In yet another example, the hardness of the bonding agent may be greater than or equal to 60 Shore D to less than or equal to 75 Shore D. The apparatus, methods, and articles of manufacture described herein are not limited in this regard.

In one example, the hardness of the polymer material at least partially or entirely filling the interior cavity and bonded to the face portion with the bonding agent may be greater than or equal to 5 Shore D (Shore durometer hardness type D) and less than or equal to 25 Shore D. In another example, the hardness of the polymer material at least partially or entirely filling the interior cavity and bonded to the face portion with the bonding agent may be greater than or equal to 10 Shore D and less than or equal to 20 Shore D. In yet another example, the hardness of the polymer material at least partially or entirely filling the interior cavity and bonded to the face portion with the bonding agent may be greater than or equal to 45 Shore D and less than or equal to 65 Shore D. In yet another example, the hardness of the polymer material at least partially or entirely filling the interior cavity and bonded to the face portion with the bonding agent may be greater than or equal to 40 Shore D and less than 80 Shore D. In yet another example, the bonding agent and the polymer material may be selected to have similar or substantially similar hardness characteristics. The apparatus, methods, and articles of manufacture described herein are not limited in this regard.

The thickness of the face portion relative to the thickness of the bonding agent may be related to the relative hardnesses of the face portion material, the bonding agent and/or the polymer material. A relatively thin face portion may be constructed from a relatively harder material to limit the flexure of the face portion and prevent structural damage to the face portion. A relatively thicker face portion may be constructed from a relatively soft material to increase flexure of the face portion to provide improved golf ball trajectory characteristics. The bonding agent may provide structural support to the face portion and further provide dampening and/or reduce vibration and noise. Accordingly, the thickness and/or the hardness of the bonding agent may be related to the thickness and/or hardness of the face portion to provide structural support, vibration and noise reduction and/or dampening to the face portion and or the golf club head and/or to provide improved golf ball trajectory characteristics when the face portion strikes a golf ball. The polymer material may provide structural support to the face portion and further provide dampening and/or reduce vibration and noise. Accordingly, the volume and/or the hardness of the polymer material may be related to the thickness of the face portion, the hardness of the face portion, the thickness of the bonding agent, and/or the hardness of the bonding agent to provide structural support, vibration and noise reduction and/or dampening to the face portion and or the golf club head and/or to provide improved golf ball trajectory characteristics when the face portion strikes a golf ball. The apparatus, methods, and articles of manufacture described herein are not limited in this regard.

In one example, the relative thicknesses of the face portion and the bonding agent may be related to the hardnesses of the face portion, the bonding agent and/or the polymer material. The relative thicknesses of the face portion and the bonding agent may be expressed by the following expressions:

$$D=f(D_f,D_b,D_e)$$

or $$d=f(D_f,D_b)$$

or $$d=f(D_b,D_e)$$

Where:

$d=T_b/T_f$ $D_f>D_b>D_e$ $D_f$ is the hardness of the face portion, $D_b$ is the hardness of the bonding agent, and $D_e$ is the hardness of the polymer material.

According to the above expression, a ratio of the thickness of the bonding agent and the thickness of the face portion may be a function of the hardness of the material of the face portion, the hardness of the bonding agent, and/or the hardness of the polymer material. In one example, function f may be based on the following expression:

$$d\cong D_f/D_b$$

According to the above expression, a ratio of the thickness of the bonding agent and the thickness of the face portion (i.e., d in the above expression) may be equivalent to a ratio of the hardness of the material of the face portion and the hardness of the bonding agent. In another example, function f may be based on the following expression:

$$d\cong D_f/De$$

According to the above expression, a ratio of the thickness of the bonding agent and the thickness of the face portion (i.e., d in the above expression) may be equivalent to a ratio of the hardness of the material of the face portion and the hardness of the polymer material. In another example, the function f may be based on the following expression:

$$d\cong 2D_f/(D_b+D_e)$$

According to the above expression, a ratio of the thickness of the bonding agent and the thickness of the face portion (i.e., d in the above expression) may be equivalent to a ratio of the hardness of the material of the face portion and an average of the hardness of the bonding agent and the hardness of the polymer material. The apparatus, methods, and articles of manufacture described herein are not limited in this regard.

The bonding agent may be any type of bonding agent such as the bonding agents described herein. In one example, the bonding agent may be DP100 Plus Clear epoxy adhesive, DP100 epoxy adhesive, DP420 epoxy adhesive or DP810 epoxy adhesive manufactured by 3M Company of St. Paul, Minn. In another example, the bonding agent may be any type of adhesive material such as epoxy having a hardness within any of the hardness ranges described herein and/or having any of the characteristics described herein. The apparatus, methods, and articles of manufacture described herein are not limited in this regard.

In one example, as described herein, the polymer material may be injection molded in the body portion of any of the golf club heads described herein. In other examples. The polymer material may be made or formed by any useful forming means for forming polymers. This include, molding including compression molding, injection molding, blow molding, and transfer molding; film blowing or casting; extrusion, and thermoforming; as well as by lamination, pultrusion, protrusion, draw reduction, rotational molding, spin bonding, melt spinning, melt blowing; or combinations thereof. In another example, any one or more of the polymer materials described herein may be in pellet or solid pieces that may be placed in the interior cavity and expanded and/or cured with heat. The apparatus, methods, and articles of manufacture described herein are not limited in this regard.

The interior cavity of any of the golf club heads described herein may be partially or entirely filled with one or more thermoset materials (e.g., one or more epoxy materials), such as any one or more of the epoxy materials described herein or any other suitable epoxy material(s). For example, the interior cavity of any of the golf club heads described herein may be substantially filled with one or more thermoset materials (e.g., one or more epoxy materials), such as any of the epoxy materials described herein or any other suitable epoxy material(s). In one example, the interior cavity of any of the golf club heads described herein may be at least 90% filled with a thermoset material. In another example, the interior cavity of any of the golf club heads described herein may be at least 80% filled with a thermoset material. In yet another example, the interior cavity of any of the golf club heads described herein may be at least 70% filled with a thermoset material. In yet another example, the interior cavity of any of the golf club heads described herein may be at least 60% filled with a thermoset material. In yet another example, the interior cavity of any of the golf club heads described herein may be at least 50% filled with a thermoset material. In yet another example, the interior cavity of any of the golf club heads described herein may be partially, substantially, or entirely filled with one or more thermoset materials (i.e., at least two thermoset materials). A thermoset material partially, substantially, or entirely filling the interior cavity may affect vibration and noise dampening, structural support for a relatively thin face portion, ball travel distance, ball speed, ball launch angle, ball spin rate, ball peak height, ball landing angle and/or ball dispersion. The apparatus, methods, and articles of manufacture described herein are not limited in this regard. The apparatus, methods, and articles of manufacture described herein are not limited in this regard.

Figure 41:
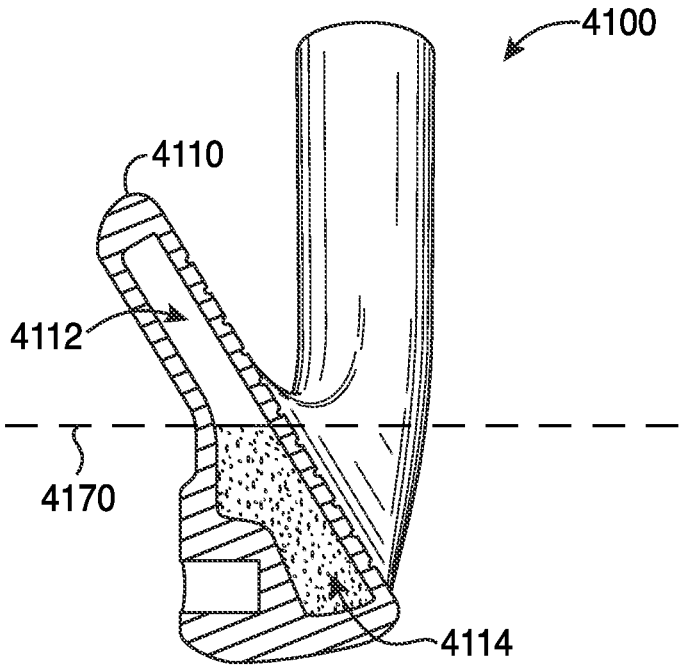
FIGS. 41, 42, and 43 each depicts perspective cross-sectional views of a golf club head according to an embodiment of the apparatus, methods, and articles of manufacture described herein.

As illustrated in FIG. 41, for example, the interior cavity 4112 of a body portion 4110 of the golf club head 4100, which may be similar to any of the golf club heads described herein, may be filled with a thermoset material 4114 (e.g., epoxy material) below the horizontal midplane 4170 of the golf club head 4100. In another example, the interior cavity 4112 of the golf club head 4100 or any of the golf club heads described herein may be filled with a thermoset material (e.g., epoxy material) above the horizontal midplane 4170. In yet another example, the interior cavity 4112 of the golf club head 4100 or any of the golf club heads described herein may be filled with a thermoset material (e.g., epoxy material) above and below the horizontal midplane 4170 and yet have regions in the interior cavity 4112 that may not include any thermoset materials or include other materials (not shown). The apparatus, methods, and articles of manufacture described herein are not limited in this regard.

Figure 42:
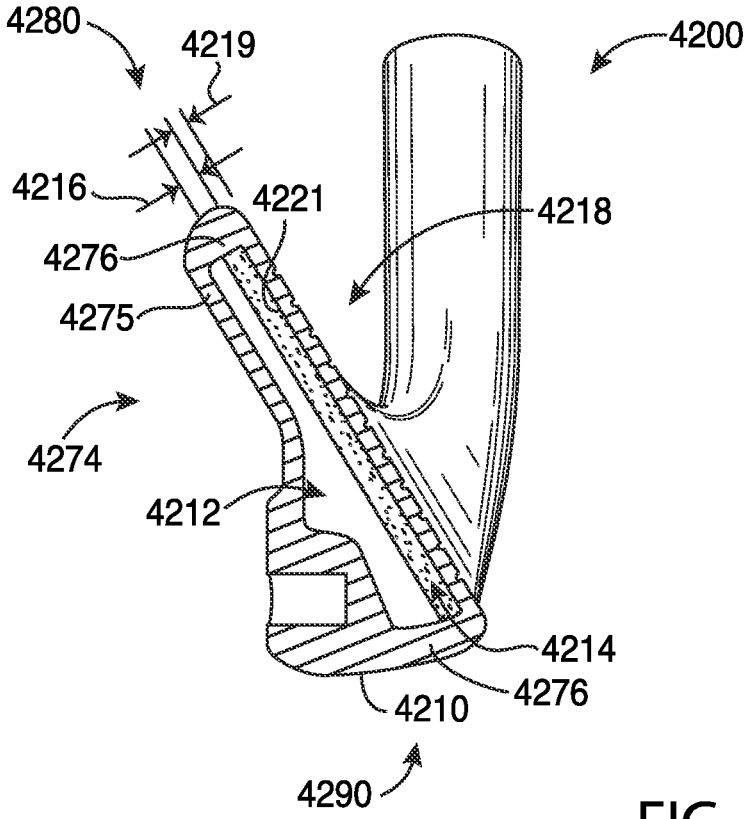

As shown in FIG. 42, for example, a golf club head 4200, which may be similar to any of the golf club heads described herein, may include a body portion 4210 with an interior cavity 4212 having a width 4216 of a thermoset material 4214. The width 4216 may be related to face portion thickness 4219 of the face portion 4218 by the following expression:

$$W_{th}=a\cdot T_f$$

Where: $0.5\leq a\leq 5.0$ $W_{th}$ is the width of the thermoset material in inches, and $T_f$ is the thickness of the face portion in inches.

In one example, the width 4216 of the thermoset material 4214 may be greater than or equal to half the face portion thickness 4219. In another example, the width 4216 of the thermoset material 4214 may be greater than or equal to the face portion thickness 4219 (e.g., $W_{th}\geq T_f$). In yet another example, the width 4216 of the thermoset material 4214 may be greater than or equal to twice the face portion thickness 4219 (e.g., $W_{th}\geq 2\ T_f$). In another example, the width 4216 of the thermoset material 4214 may be greater than or equal to three times the face portion thickness 4219 (e.g., $W_{th}\geq 3\ T_f$). In yet another example, the width 4216 of the thermoset material 4214 may be greater than five times the face portion thickness 4219 (e.g., $W_{th}\geq 5\ T_f$). In yet another example, the width 4216 of the thermoset material 4214 may be greater than or equal to the face portion thickness 4219 and less than or equal to three times the face portion thickness 4219 (e.g., $T_f\leq W_{th}\leq 3\ T_f$). The apparatus, methods, and articles of manufacture described herein are not limited in this regard.

In one example, the mass of the thermoset material (e.g., epoxy) partially, substantially (e.g., filling at least 50% of the interior cavity), or entirely filling the interior cavity of any of the golf club heads described herein may be greater than or equal to 6.0 grams and less than or equal to 32.0 grams. In another example, the mass of the thermoset material partially, substantially or entirely filling the interior cavity of any of the golf club heads described herein may be greater than or equal to 6.0 grams and less than or equal to 24.0 grams. In yet another example, the mass of the thermoset material partially, substantially or entirely filling the interior cavity of any of the golf club heads described herein may be greater than or equal to 12.0 grams and less than or equal to 18.0 grams. In yet another example, the mass of the thermoset material partially, substantially or entirely filling the interior cavity of any of the golf club heads described herein may be greater than or equal to 16.0 grams and less than or equal to 27.0 grams. In yet another example, the mass of the thermoset material partially, substantially or entirely filling the interior cavity of any of the golf club heads described herein may be greater than or equal to 20.0 grams and less than or equal to 31.0 grams. In yet another example, the mass of the thermoset material partially, substantially or entirely filling the interior cavity of any of the golf club heads described herein may be greater than or equal to 21.0 grams and less than or equal to 28.0 grams. In yet another example, the mass of the thermoset material partially, substantially or entirely filling the interior cavity of any of the golf club heads described herein may be greater than or equal to 10.0 grams and less than or equal to 20.0 grams. In yet another example, the mass of the thermoset material partially, substantially, or entirely filling the interior cavity of any of the golf club heads described herein may be greater than or equal to 15.0 grams and less than or equal to 30.0 grams. In yet another example, the mass of the thermoset material partially, substantially, or entirely filling the interior cavity of any of the golf club heads described herein may be greater than or equal to 20.0 grams and less than or equal to 30.0 grams. The apparatus, methods, and articles of manufacture described herein are not limited in this regard.

In one example, for any of the golf club heads described herein, the mass of a thermoset material partially, substantially, or entirely filling the interior cavity may be related to the mass of the golf club head by the following expression:

$$0.03\leq m_T/m_H\leq 0.2$$

Where: $m_T$ is the mass of the thermoset material in grams, and $m_H$ is the mass of the golf club head in grams.

In one example, a ratio of the mass of the thermoset material and the mass of the golf club head may be greater than or equal to 0.04 and less than or equal to 0.08. In another example, a ratio of the mass of the thermoset material and the mass of the golf club head may be greater than or equal to 0.05 and less than or equal to 0.09. In another example, a ratio of the mass of the thermoset material and the mass of the golf club head may be greater than or equal to 0.05 and less than or equal to 0.11. In another example, a ratio of the mass of the thermoset material and the mass of the golf club head may be greater than or equal to 0.09 and less than or equal to 0.12. In another example, a ratio of the mass of the thermoset material and the mass of the golf club head may be greater than or equal to 0.08 and less than or equal to 0.17. In yet another example, a ratio of the mass of the thermoset material and the mass of the golf club head may be greater than or equal to 0.01. The apparatus, methods, and articles of manufacture described herein are not limited in this regard.

A thermoset material partially, substantially, or entirely filling the interior cavity may have a certain Shore D hardness to provide vibration and noise dampening and/or structurally support a relatively thin face portion of a golf club head. In one example, a thermoset material partially, substantially, or entirely filling the interior cavity may have a Shore D hardness of at least 20. In another example, a thermoset material partially, substantially, or entirely filling the interior cavity may have a Shore D hardness of greater than or equal to 20 and less than or equal to 80. In another example, a thermoset material partially, substantially, or entirely filling the interior cavity may have a Shore D hardness of greater than or equal to 25 and less than or equal to 45. In yet another example, a thermoset material partially, substantially, or entirely filling the interior cavity may have a Shore D hardness of greater than or equal to 35 and less than or equal to 65. In yet another example, a thermoset material partially, substantially, or entirely filling the interior cavity may have a Shore D hardness of greater than or equal to 45 and less than or equal to 75. The apparatus, methods, and articles of manufacture described herein are not limited in this regard.

A thermoset material partially, substantially, or entirely filling the interior cavity may have a certain density to provide vibration and noise dampening and/or structurally support a relatively thin face portion of a golf club head. In one example, a thermoset material partially, substantially, or entirely filling the interior cavity may have a density of greater than or equal to 1.0 grams per cubic centimeter (g/cm3) and less than or equal to 2.0 g/cm3. In another example, a thermoset material partially, substantially, or entirely filling the interior cavity may have a density of greater than or equal to 1.1 g/cm3 and less than or equal to 1.5 g/cm3. In yet another example, a thermoset material partially, substantially, or entirely filling the interior cavity may have a density of greater than or equal to 1.0 g/cm3 and less than or equal to 1.4 g/cm3. In yet another example, a thermoset material partially, substantially, or entirely filling the interior cavity may have a density of greater than or equal to 1.1 g/cm3 and less than or equal to 1.2 g/cm3. The apparatus, methods, and articles of manufacture described herein are not limited in this regard.

The polymer material (e.g., the thermoset material 4214 as shown in FIG. 42) may be located adjacent to the back surface 4221 of the face portion 4218. For example, the thermoset material 4214 may be attached and/or bonded directly to the back surface 4221 of the face portion 4218. Alternatively, the thermoset material 4214 may be located away from the face portion 4218. In one example, the thermoset material 4214 may be attached and/or bonded to the back wall portion 4275 of the back portion 4274. As a result, the thermoset material 4214 may not be in contact with the back surface 4221 of the face portion 4218. In yet another example, the thermoset material 4214 may be attached and/or bonded to the back surface 4221 and the back wall portion 4275 but not to the side wall portion 4276 at or proximate to the top portion 4280 and/or the sole portion 4290. In another example, the thermoset material 4214 may not be attached and/or bonded to the side wall portion 4276 at or proximate to the toe portion and/or the heel portion of the golf club head 4200. That is, the thermoset material 4214 may be suspended in the interior cavity 4212 without contact with the side wall portion 4276 (e.g., 360-degree space around the thermoset material 4214). In yet another example, the thermoset material 4214 may be attached and/or bonded to the back surface 4221, the back wall portion 4275, and the side wall portion 4276 at or proximate the top portion 4280 and the sole portion 4290 but not the toe portion and the heel portion of the golf club head 4200. While the above examples may describe the thermoset material 4214 being attached and/or bonded to various surfaces and/or wall portions of the golf club head 4200, the thermoset material 4214 may be attached and/or bonded to more or less surfaces and/or wall portions. The apparatus, methods, and articles of manufacture described herein are not limited in this regard.

Figure 43:
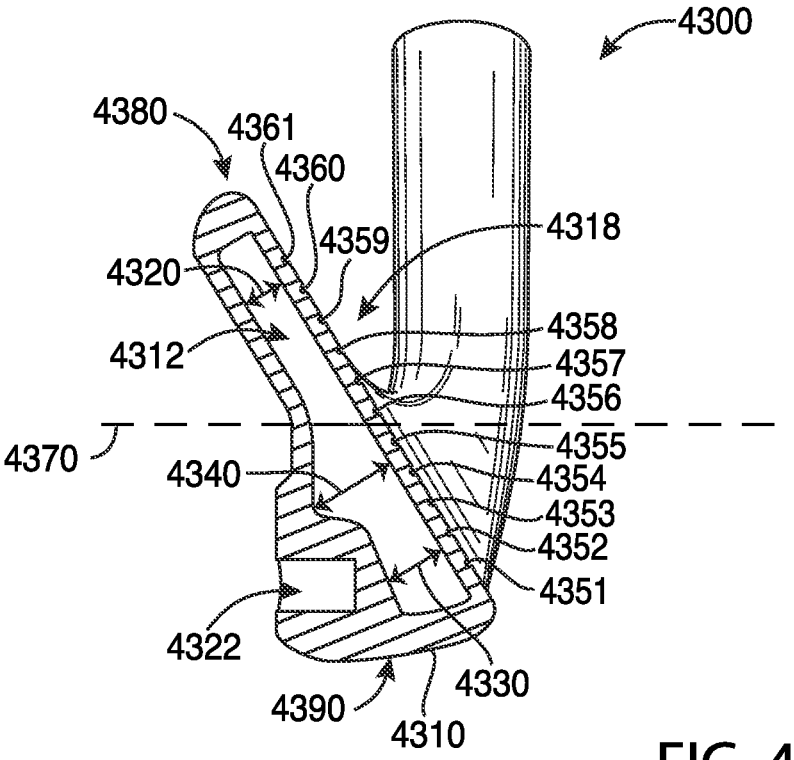

As shown in FIG. 43, for example, a golf club head 4300, which may be similar to any of the golf club heads described herein, may have a body portion 4310 with an internal cavity 4312 having an internal cavity width that may vary between the top portion 4380 and the sole portion 4390. In particular, the internal cavity 4312 may include a first width 4320 ($W_1$) above a horizontal midplane 4370 of the golf club head 4300, a second width 4330 ($W_2$) below the horizontal midplane 4370, and a third width 4340 ($W_3$) between the first width 4320 and the second width 4330. The third width 4340 may be at or below the horizontal midplane 4370. In one example, the third width 4340 may be above one or more ports (e.g., one generally shown as 4322). Accordingly, the third width 4340 may be located above one or more mass portions (not shown in FIG. 43 but for example, a mass portion disposed in the port 4322) and/or be closer to the horizontal midplane 4370 than one or more mass portions. In another example, the third width 4340 may be above one or more ports of the golf club head 4200 and below the horizontal midplane 4370. The third width 4340 may be greater than the first width 4320 (i.e., $W3>W_1$) and greater than the second width 4330 (i.e., $W_3>W_2$). In one example, the first width 4320 may be greater than or equal to the second width 4330 (i.e., $W_1 \geq W_2$). In another example, the second width 4330 may be greater than or equal to the first width 4320 (i.e., $W_2 \geq W_1$). In yet another example, the third width 4340 may be no more than three times the second width 4330 (i.e., $3W_2 \geq W_3$). In yet another example, the third width 4340 may be no more than twice the second width 4330 (i.e., $2W_2 \geq W_3$). In yet another example, the third width 4340 may be no more than 1.5 times the second width 4330 (i.e., $1.5W_2 \geq W_3$). In yet another example, the third width 4340 may be no more than 1.25 times the second width 4330 (i.e., $1.25W_2 \geq W_3$). The apparatus, methods, and articles of manufacture described herein are not limited in this regard.

The third width 4340 may be located at a certain vertical location within the body portion 4310. The face portion 4318 of the golf club head 4300 may include a plurality of grooves. The face portion 4318 of the golf club head 4300 may include a similar number of grooves as the golf club head 1500 of FIG. 15. Accordingly, the face portion 4318 may include a plurality of grooves (e.g., eleven grooves are generally shown as grooves 4351, 4352, 4353, 4354, 4355, 4356, 4357, 4357, 4359, 4360, and 4361 in FIG. 43). The third width 4340 may be located between any of the plurality of grooves. In one example, the third width 4340 may be located between the first groove 4351 and the eleventh groove 4361 from the sole portion 4390. In another example, the third width 4340 may be located between the fourth groove 4354 and the eighth groove 4358 from the sole portion 4390. In yet another example, the third width 4340 may be located between the fifth groove 4355 and the seventh groove 4357 from the sole portion 4390. Although FIG. 43 may depict the first, second, and third widths (4320, 4330, and 4340, respectively) of the internal cavity 4312 as being perpendicular to a loft plane (not shown) associated with the face portion 4318, the one or more widths may instead be measured relative to the ground plane (e.g., one generally shown as 2410 in FIG. 24). For example, one or more widths of the internal cavity 4312 may be measured along a plane that is substantially parallel to the ground plane. The apparatus, methods, and articles of manufacture described herein are not limited in this regard.

Figure 44:
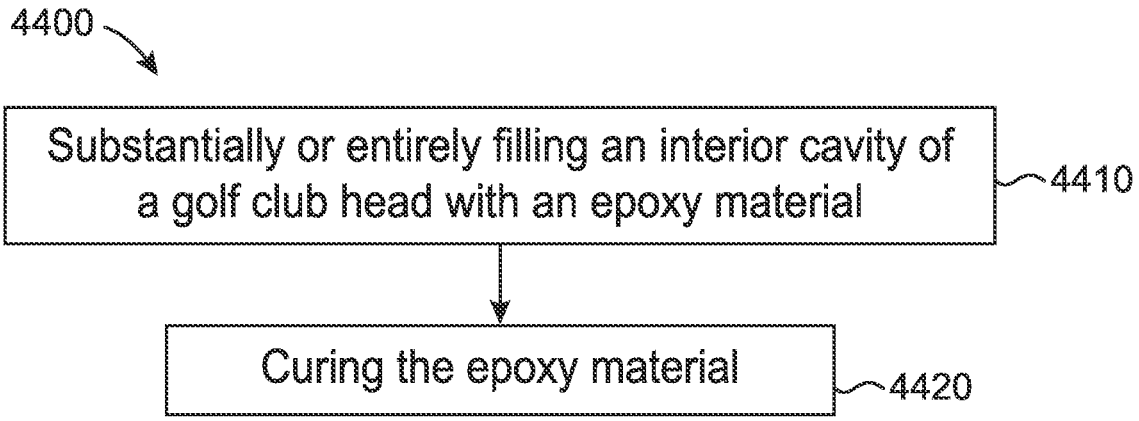
FIGS. 44, 45, 46, and 47 each depicts a manner, respectively, in which a golf club head according to an embodiment of the apparatus, methods, and articles of manufacture described herein may be manufactured.

In one example, the process of filling the interior cavity of the golf club head may not include applying a bonding portion to the back surface of the face portion. For example, as shown in FIG. 44, the process 4400 of filling the interior cavity of the golf club head may include partially, substantially, or entirely filling the interior cavity with an epoxy material (block 4410), and then curing the epoxy material (block 4420). The epoxy material may be injected into the interior cavity from one or more ports on the body portion of a golf club head as described herein. In one example, the process of curing the epoxy material may include using heat, radiation, and/or pressure for a certain period of time. In another example, the process of curing the epoxy material may only include allowing the epoxy material to cure at ambient or room temperature for a certain period of time. In another example, the process of filling the interior cavity of the golf club head may include applying a first epoxy material to the back surface of the face portion, curing the first epoxy material to a first cure state as described herein, filling the interior cavity with a second epoxy material that may be the same as or different from the first epoxy material, and curing the first epoxy material to the second cure state and curing the second epoxy material as described herein. In another example, more than two epoxy materials can be used to substantially or fully fill the interior cavity with single or multiple curing processes used for each epoxy material. The apparatus, methods, and articles of manufacture described herein are not limited in this regard.

Figure 49:
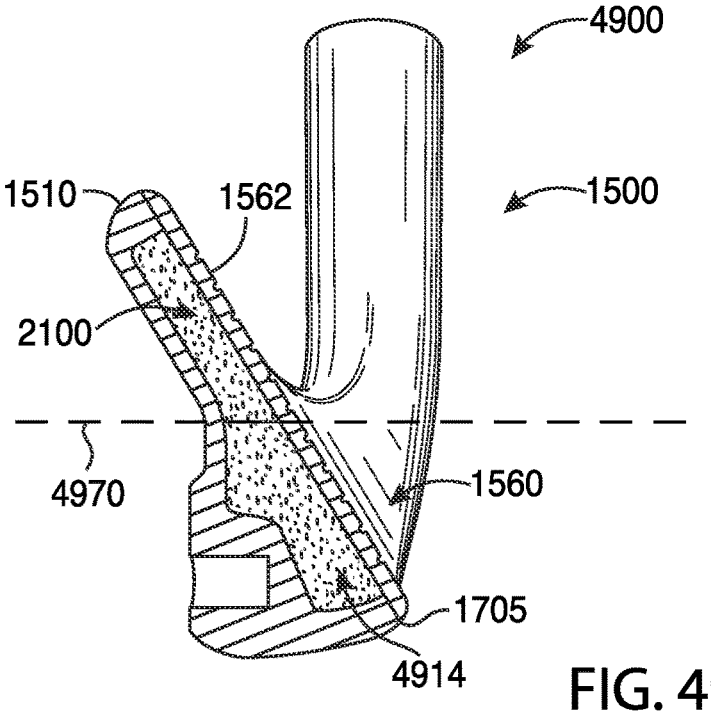
FIG. 49 is a perspective cross-sectional view of a golf club head according to an embodiment of the apparatus, methods, and articles of manufacture described herein.

The filler material may be a structural adhesive 4914, such as an epoxy adhesive. As illustrated in FIG. 49, for example, the interior cavity 2100 of the body portion 1510 of the golf club head 4900, which may be similar to any of the golf club heads described herein, may be filled, or substantially filled, with a structural adhesive 4914. When the interior cavity 2100 is filled or substantially filled with structural adhesive, the structural adhesive 4914 may be present both above and below a horizontal midplane 4970 of the golf club head 4900. In one example, the epoxy adhesive may have a transparent gold color readily identifiable for quality control purposes. Examples of structural adhesives include polyurethane, acrylic, cyanoacrylate, and others. The epoxy adhesive may be formulated as a liquid reactive polymer that undergoes a chemical reaction when a base material is mixed with an accelerating material and then cures to form a solid plastic material. When the base and accelerating materials are mixed in a specified ratio (e.g., 1:1), these materials may begin curing and offer a limited working time during which the structural adhesive 4914 may be applied to the golf club head 4900. The structural adhesive 4914 may provide relatively high shear and peel strengths. The structural adhesive 4914 may offer resistance to high temperatures, solvents, and/or weathering. The structural adhesive 4914 may be a two-part epoxy adhesive having a base material mixed with an accelerator material, also known as a curing agent. In one example, the accelerator material may be a polymeric mercaptan. Upon mixing the accelerator material with the base material, the epoxy adhesive may have a cure time of less than 10 minutes at room temperature (e.g., 21° C.). In one example, the epoxy adhesive may have a cure time of between and including 3 and 5 minutes at room temperature. In another example, the epoxy adhesive may have a cure time of between and including 2 and 6 minutes at room temperature. Cure time may be defined as the amount of time required for the epoxy adhesive to achieve, for example, 80% of an ultimate tensile strength of the epoxy adhesive when fully cured. In one example, the epoxy adhesive may have a density of between and including 1.126 and 1.162 g/cm3 (0.0406 and 0.0419 lb/in3). In another example, the epoxy adhesive may have a density of between and including 1.148 and 1.174 g/cm3 (0.0414 and 0.0424 lb/in3). In yet another example, the epoxy adhesive may have a density of between and including 1.162 and 1.186 g/cm3 (0.0419 and 0.0428 lb/in3). In one example, the epoxy adhesive 4914 may have a density of less than 1.2 g/cm3. In another example, the epoxy adhesive may have a density of less than 1.186 g/cm3. In another example, the epoxy adhesive may have a density of less than 1.174 g/cm3. In yet another example, the epoxy adhesive may have a density of less than 1.162 g/cm3. In still another example, the epoxy adhesive may have a density of less than 1.148 g/cm3. The apparatus, methods, and articles of manufacture described herein are not limited in this regard.

The epoxy adhesive 4914 may remain slightly flexible when cured, which may allow the epoxy adhesive to effectively absorb shock and vibration resulting from the club head 1500 striking a golf ball without shattering and/or fragmenting within the interior cavity 2100. In one example, the epoxy adhesive may have a Shore D hardness of at least 45. In another example, the epoxy adhesive may have a Shore D hardness between and including 48 and 62. In another example, the epoxy adhesive may have a Shore D hardness between and including 50 and 60. In another example, the epoxy adhesive may have a Shore D hardness between and including 60 and 67. In another example, the epoxy adhesive may have a Shore D hardness of between and including 62 and 72. In yet another example, the epoxy adhesive may have a Shore D hardness of between and including 65 and 70. In still another example, the epoxy adhesive may have a Shore D hardness of between and including 68 and 74. The apparatus, methods, and articles of manufacture described herein are not limited in this regard.

At an ambient temperature of 21° C., the epoxy adhesive 4914 may have a thermal coefficient of expansion of between and including 90 and 95. When applying test method ASTM D882 to evaluate tensile strength and elongation of the epoxy adhesive in the form of a 5.08 cm (2 inch) dumbbell sample with a 0.3175 cm (0.125 inch) neck and 0.0762 cm (0.030 inch) thickness, the epoxy adhesive may exhibit an elongation of 75% at a separation rate of 5.08 cm (2 inch) per minute. In one example, the epoxy adhesive may have a tensile strength of between and including 11.48 and 12.76 MPa (1665 and 1850 psi) at 21° C. In another example, the epoxy adhesive may have a tensile strength of between and including 12.58 and 12.93 MPa (1825 and 1875 psi) at 21° C. In yet another example, the epoxy adhesive may have a tensile strength of 12.76 MPa (1850 psi) at 21° C. In still another example, the epoxy adhesive may have a tensile strength of between and including 12.76 and 14.03 MPa (1850 and 2035 psi) at 21° C. The high tensile strength of the epoxy adhesive may allow the club head 1500 to maintain high durability and reliability despite having a relatively thin metallic face. In one example, the face portion 1562 may have a thickness of less than 2.54 mm. In another example, the face portion 1562 may have a thickness of less than 1.9 mm. In another example, the face portion 1562 may have a thickness of less than 1.5 mm. In still another example, the face portion 1562 may have a thickness of less than 0.8 mm. In yet another example, the face portion 1562 may have a thickness of less than 0.76 mm. By employing a thin face portion, the CG of the club head 1500 may be shifted reward and/or downward. The apparatus, methods, and articles of manufacture described herein are not limited in this regard.

As used herein, "coefficient of restitution" or "COR" may represent a measure of energy transfer between two objects when they collide. A measurement of COR can be expressed as a number between zero (where all energy is lost in the collision) and 1.0 (representing a perfect, elastic collision in which all energy is transferred from a first object to a second object). In one example, a COR measurement may describe energy transfer between a golf club head (i.e. first object) and a golf ball (i.e. second object). In another example, a COR measurement may describe energy transfer between a material (i.e. first object) used in the manufacture of a golf club head and a golf ball (i.e. second object). In yet another example, a COR measurement may describe energy transfer between a material (i.e. first object) used in the manufacture of a golf club head and a test device (i.e. second object). The test device may allow for a comparative analysis of materials used in the manufacture of golf club heads. In one example, COR may be measured by launching a golf ball at the strike face 1562 of the golf club and measuring the velocity of the ball before it impacts the strike face ($V_{in}$) and then measuring the velocity of the ball after it rebounds from the strike face ($V_{out}$) and calculating the ratio of velocities ($COR=V_{out}/V_{in}$). The apparatus, methods, and articles of manufacture described herein are not limited in this regard.

A golf club head having an interior cavity and a relatively thin strike face may exhibit inconsistent COR values at various locations across the strike face. During impact with a golf ball, the strike face may exhibit a spring-like or trampoline effect by deflecting inwardly during impact and then deflecting outwardly during rebound, which in turn, may impart energy to the golf ball. If the strike face is not adequately supported across its back surface, the golf club head may exhibit variations in COR measurements across the strike face. For instance, a maximum COR value may exist at a first location on the strike face (e.g. near a center point of the strike face) and a lower COR value may exist at a second point on the strike face a distance from the first location. Consequently, during a mishit where golf ball contacts the second location instead of the first location, a lower ball speed may result. Diminished ball speed may cause the golf ball to travel a shorter distance than desired and/or produce a ball flight trajectory that deviates from a desired ball flight trajectory. It is therefore desirable to provide a golf club head that exhibits consistent COR values across the strike face. The apparatus, methods, and articles of manufacture described herein are not limited in this regard.

Upon curing, the structural adhesive 4914 may strongly bond to one or more surface(s) of the body portion 1510 and/or the face portion 1562 that together define the interior cavity 2100. By strongly bonding to interior surface(s) of the interior cavity 2100, the structural adhesive 4914 may avoid detaching and rattling within the interior cavity 2100 as a result of repeated ball strikes. By strongly bonding to interior surface(s) of the interior cavity 2100, the structural adhesive 4914 may improve performance of the club head during a mishit. For example, when the interior cavity 2100 of the golf club head is substantially filled with structural adhesive and the structural adhesive is strongly bonded to the back surface 1566 of the face portion 1562, the golf club head 1500 may exhibit substantially uniform COR measurements across the front surface 1564 of the face portion, which may minimize deviations in ball speed and/or ball flight trajectory resulting from a mishit. The apparatus, methods, and articles of manufacture described herein are not limited in this regard.

In one example, the golf club head 4900 may be made of a steel-based material (e.g., 8620 steel). After the structural adhesive 4914 is introduced into the interior cavity 2100 and bonds to the surface(s) of the body portion 1510 and/or the face portion 1562, the structural adhesive may exhibit an overlap shear strength of at least 1700 psi (at least 11.72 MPa) relative to the steel-based body portion 1510. Overlap shear strength may be determined in accordance with ASTM D1002 using metal specimens with a width of 25.4 mm, a length of 177.8 mm, an overlap of 12.7 mm, and an adhesive bond thickness of about 0.127 to 0.203 mm (0.005 to 0.008 inch) at 21° C. The pieces of metal substrate (i.e., the metal specimens) may be made of the same material as the body portion 1510 and/or the face portion 1562 with surfaces of the substrates prepared in a similar manner as the surface(s) of the body portion 1510 and/or the face portion 1562 forming the interior cavity 2100. To ensure long-term durability of a bonding interface between the structural adhesive and the surface(s) of the body portion 1510 and/or the face portion 1562 forming the interior cavity 2100, the structural adhesive may have an overlap shear strength (relative to the material(s) of the surface(s) of the body portion 1510 and/or the face portion 1562 forming the interior cavity 2100) of at least 1250, at least 1475, at least 1625, or at least 1700 psi at 21° C. In one example, the body portion 1510 may be a forged steel body with an unfinished interior cavity. The unfinished interior cavity may be subjected to a machining process (e.g., a milling process) to produce a finished interior cavity 2100 with finished surface(s) having an average roughness (Ra) greater than 0.8 micrometers. The finished surface(s) may enhance bonding of the structural adhesive 4914 to the surface(s) of the body portion 1510 and/or the face portion 1562 forming the interior cavity 2100 to improve overlap shear strength. The apparatus, methods, and articles of manufacture described herein are not limited in this regard.

Figure 45:
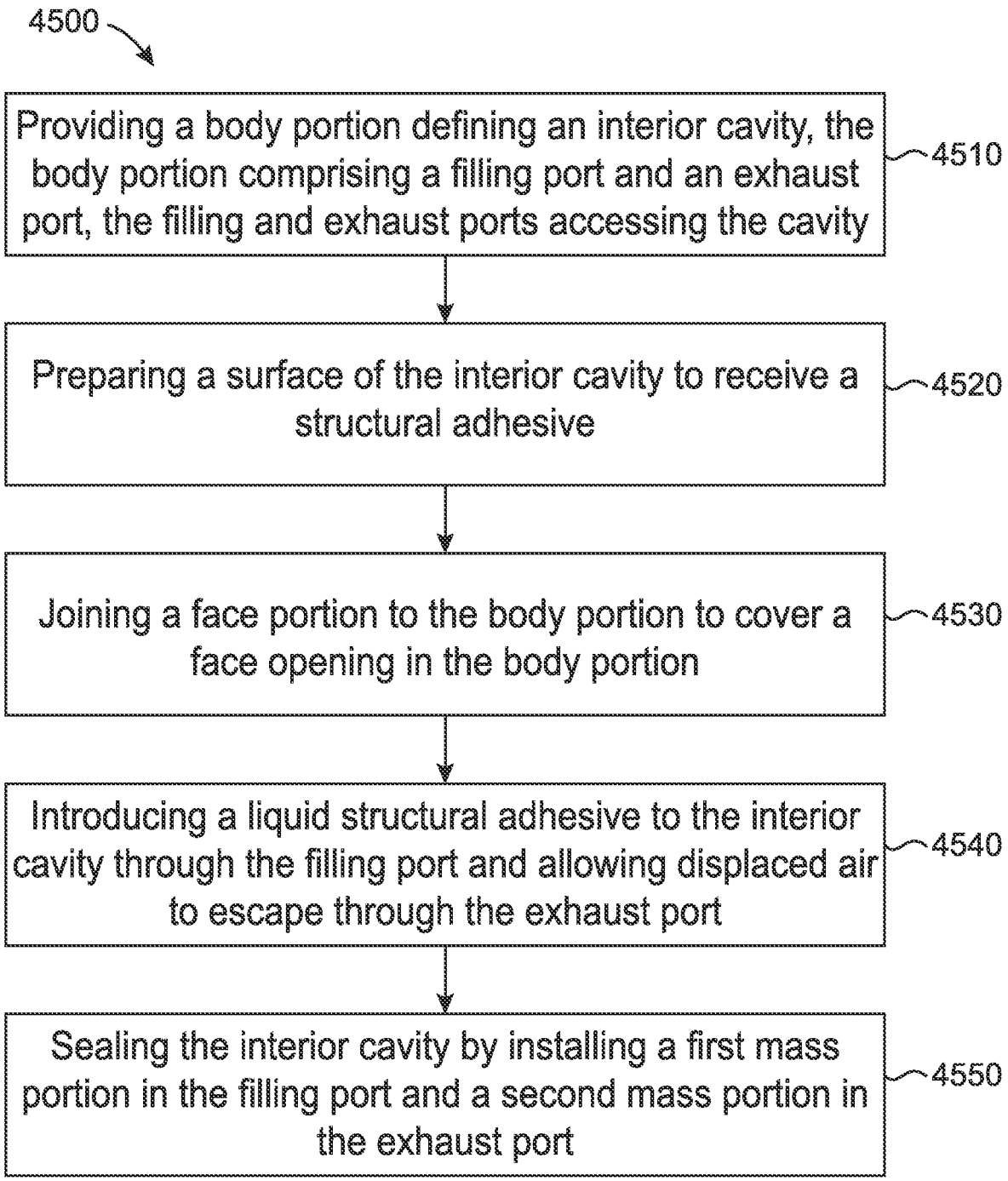

FIG. 45 shows an example process 4500 to manufacture a golf club head. The process may include providing a body portion 1510 (block 4510). The body portion 1510 may include an opening configured to receive a face portion 1562. In one example, the body portion 1510 may include a metal material having a density greater than 7 g/cm3. In another example, the body portion 1510 may include a metal material having a density greater than 7.75 g/cm3. The body portion 1510 may be formed with an interior cavity 2100 (e.g., through a casting or forging process), or the interior cavity 2100 may be subsequently formed in the body portion 1510 (e.g., through a machining process). The body portion 1510 may be formed with a filling port (e.g., one port generally shown in FIG. 28 as 1631) and an exhaust port (e.g., one port generally shown as 1621) accessing the interior cavity 2100 (e.g., through a casting process), or the filling and exhaust ports (e.g., generally shown as 1621 and 1631, respectively, or vice versa) may be subsequently formed in the body portion 1510 (e.g., through a drilling or milling process). In one example, the filling port 1631 may be located below the horizontal midplane 4970, and the exhaust port 1621 may be located above the horizontal midplane 4970 (see, e.g., FIG. 49 and the horizontal midplane 2420 in FIG. 28). In another example, the filling port 1621 may be located above the horizontal midplane 4970, and the exhaust port 1631 may be located below the horizontal midplane 4970. The filling and/or exhaust ports may access the interior cavity 2100 from a back portion 1570 of the body portion 1510 and/or from a sole portion 1590 of the body portion 1510. Alternatively, the filling and/or exhaust ports may access the interior cavity 2100 from the heel portion 1550, the hosel portion 1555, and/or the top portion 1580. The surface(s) of the body portion 1510 and/or the face portion 1562 forming the interior cavity 2100 may have unfinished surface(s) resulting from casting or forging process(es). To improve bonding of the structural adhesive 4914 to the surface of the interior cavity 2100, the process 4500 may include preparing the surface(s) of the body portion 1510 and/or the face portion 1562 forming the interior cavity 2100 to receive structural adhesive(s) (block 4520). In one example, preparing the surface(s) of the body portion 1510 and/or the face portion 1562 forming the interior cavity 2100 for bonding may include cleaning the surface with a solvent, such as isopropyl alcohol. In another example, preparing the surface(s) of the body portion 1510 and/or the face portion 1562 forming the interior cavity 2100 for bonding may include milling, sanding, sandblasting, or otherwise abrading the surface(s) to provide a certain average surface roughness. In still another example, preparing the surface(s) of the body portion 1510 and/or the face portion 1562 forming the interior cavity 2100 for bonding may include milling, sanding, sandblasting, or otherwise abrading the surface(s) to provide a certain average surface roughness and then cleaning the surface with a solvent, such as isopropyl alcohol. In one example, preparing the surface(s) of the body portion 1510 and/or the face portion 1562 forming the interior cavity 2100 may result in an average roughness (Ra) of between and including 0.8 and 6.3 micrometers. In another example, the surface roughness of the surface(s) of the body portion 1510 and/or the face portion 1562 forming the interior cavity 2100 may between and including 0.8 and 2.3 micrometers. In yet another example, the surface roughness of the surface(s) of the body portion 1510 and/or the face portion 1562 forming the interior cavity 2100 may between and including 2.2 and 4.5 micrometers. In yet another example, the surface roughness of the surface(s) of the body portion 1510 and/or the face portion 1562 forming the interior cavity 2100 may between and including 4.4 and 6.3 micrometers. Cleaning the surface(s) with a solvent may remove loose particles or residual lubricant(s) remaining from a machining process and may therefore improve bonding of the adhesive material to the surface(s) of the interior cavity 2100. Machining the surface(s) of the body portion 1510 and/or the face portion 1562 forming the interior cavity 2100 to receive the filler material may remove excess material from certain regions of the interior cavity 2100 to allow for repositioning of the CG of the golf club head 1500 to a more optimal location. The process 3300 may include introducing a liquid structural adhesive, such as an epoxy adhesive, to the interior cavity 2100 through the filling port (block 4540). As the structural adhesive flows into the interior cavity 2100, air within the interior cavity 2100 may be displaced and forced out of the interior cavity 2100 through the exhaust port. The interior cavity 2100 may be filled to a level where structural adhesive 4914 occupies between and including 40% and 100% of the interior cavity volume. In one example, the structural adhesive 4914 may occupy at least 50% of the interior cavity volume. In another example, the structural adhesive 4914 may occupy at least 55% of the interior cavity volume. In yet another example, the structural adhesive 4914 may occupy at least 65% of the interior cavity volume. In still another example, the structural adhesive 4914 may occupy at least 75% of the interior cavity volume. In another example, the structural adhesive 4914 may occupy at least 85% of the interior cavity volume. In another example, the structural adhesive 4914 may occupy at least 95% of the interior cavity volume. To reduce or prevent debris from entering the interior cavity 2100 and/or liquid structural adhesive from flowing out of the ports prior to curing, the interior cavity 2100 may be sealed by installing a first mass portion in the filling port (e.g., one generally shown as 1631) and a second mass portion in the exhaust port (e.g., one generally shown as 1621). The apparatus, methods, and articles of manufacture described herein are not limited in this regard.

In one example, after joining the face portion 1562 to cover the face opening 4810 of the body portion 1510 (block 4530), introducing a liquid structural adhesive to the interior cavity 2100 may occur without heating the structural adhesive or the body portion 1510 (shown in block 4540). Not heating the structural adhesive and/or the body portion 1510 may reduce energy required to complete the process 4500. For a two-part structural adhesive (e.g., epoxy adhesive) made of liquid reactive polymers, a step of mixing a base material with an accelerator material may precede introducing the liquid structural adhesive to the interior cavity 2100. In one example, the structural adhesive 4914 may be introduced to the interior cavity 2100 at a delivery rate of greater than 40 grams/minute. In another example, the structural adhesive 4914 may be introduced to the interior cavity 2100 at a delivery rate of between and including 40 and 47 grams/minute. In still another example, the structural adhesive 4914 may be introduced to the interior cavity 2100 at a delivery rate of between and including 46 and 54 grams/minute. In yet another example, the structural adhesive 4914 may be introduced to the interior cavity 2100 at a delivery rate of between and including 53 and 62 grams/minute. The structural adhesive 4914 may be introduced to the interior cavity 2100 at elevated pressure by, for example, a pneumatic applicator or other suitable applicator. In one example, the structural adhesive 4914 may be introduced to the interior cavity 2100 at a pressure of greater than 40 psi. In another example, the structural adhesive 4914 may be introduced to the interior cavity 2100 at a pressure of between and including 45 and 60 psi (310 and 413 kPa). In another example, the structural adhesive 4914 may be introduced to the interior cavity 2100 at a pressure of between and including 55 and 70 psi (379 and 482 kPa). In another example, the structural adhesive 4914 may be introduced to the interior cavity 2100 at a pressure of between and including 70 and 75 psi (482 and 517 kPa). In another example, the structural adhesive 4914 may be introduced to the interior cavity 2100 at a pressure of between and including 75 and 80 psi (517 and 551 kPa). The apparatus, methods, and articles of manufacture described herein are not limited in this regard.

In one example, the structural adhesive 4914 may have a viscosity of between and including 4,000 and 7,000 centipoise at 73° F. In another example, the structural adhesive 4914 may have a viscosity of between and including 7,000 and 11,000 centipoise at 73° F. In another example, the structural adhesive 4914 may have a viscosity of between and including 11,000 and 13,000 centipoise at 73° F. A filling duration required to introduce the structural adhesive 4914 to the interior cavity 2100 may depend on the diameter of the filling port. In one example where the filling port has a diameter of about 0.375 in., the filling duration may be about 3 to 90 seconds. The filling duration may depend on the viscosity and pressure of the structural adhesive 4914 being introduced to the interior cavity 2100. In one example, the filling duration may be between and including 3 and 15 seconds. In another example, the filling duration may be between and including 10 and 30 seconds. In another example, the filling duration may be between and including 30 and 45 seconds. In another example, the filling duration may be between and including 46 and 60 seconds. In still another example, the filling duration may be between and including 60 and 75 seconds. In yet another example, the filling duration may be between and including 75 and 90 seconds. The filling duration may be longer for a relatively smaller diameter filling port, and the filling duration may be shorter for a relatively larger diameter filling port. The ratio of the structural adhesive 4914 volume to the body portion 1510 volume may be greater than 0.2. In one example, the ratio of the structural adhesive 4914 volume to the body portion 1510 volume may be between and including 0.20 and 0.30. In another example, the ratio of the structural adhesive 4914 volume to the body portion 1510 volume may be between and including 0.25 and 0.35. In still another example, the ratio of the structural adhesive 4914 volume to the body portion 1510 volume may be between and including 0.30 and 0.45. In yet another example, the ratio of the structural adhesive 4914 volume to the body portion 1510 volume may be between and including 0.45 and 0.55. The apparatus, methods, and articles of manufacture described herein are not limited in this regard.

The process 4500 may include sealing the filling port and/or the exhaust port (block 4550). In one example, first and second mass portions may be installed in the filling and exhaust ports, respectively, immediately after introducing the structural adhesive 4914 into the interior cavity 2100. In another example, the first and second mass portions may be installed after the structural adhesive 4914 is partially cured. In yet another example, the first and second mass portions may be installed after the structural adhesive 4914 is substantially or completely cured. Alternatively, the filling and exhaust ports may not be sealed with mass portions. The apparatus, methods, and articles of manufacture described herein are not limited in this regard.

The process of 4500 of FIG. 45 may be performed at room temperature to eliminate the need for heating. Alternatively, the process 4500 may be performed at a temperature above room temperature for at least a portion of the curing process. In one example, the process 4500 may include heating the club head 1500 at a temperature of greater than 75° C. In another example, the process 4500 may include heating the club head 1500 at a temperature of 75 to 85° C. In another example, the process 4500 may include heating the club head 1500 at a temperature of 85 to 90° C. In another example, the process 4500 may include heating the club head 1500 at a temperature of 90 to 95° C. Providing heat may speed curing of the structural adhesive 4914 after it has been introduced to the interior cavity 2100. The apparatus, methods, and articles of manufacture described herein are not limited in this regard.

Figure 46:
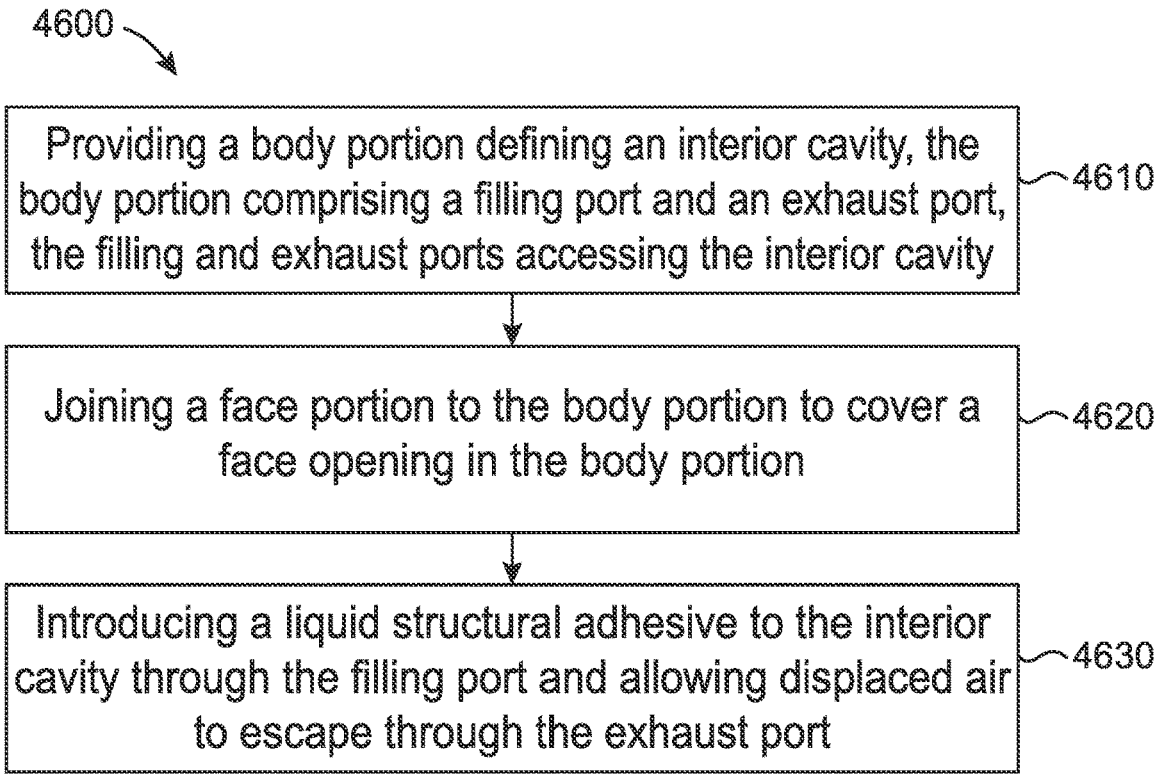

FIG. 46 shows an example process 4600 to manufacture a golf club head. The process 3400 may include providing a body portion 1510 defining an interior cavity 2100 (block 4610). The body portion 1510 may include a filling port and an exhaust port accessing the interior cavity 2100. The filling port and exhaust port may access the interior cavity 2100 from a back portion, a sole portion, a top portion, a toe portion, a heel portion, a perimeter portion, and/or other portion(s) of the body portion 1510. In one example, the hosel portion 1555 may be used as a filling and/or exhaust port. The process 3400 may include joining a face portion 1562 to cover an opening in the body portion 1510 (block 4620). In one example, the face portion 1562 may be welded to the front portion 1560 of the body portion 1510 to cover the opening. The process 4600 may include introducing a liquid structural adhesive to the interior cavity 2100 through the filling port and allowing displaced air to escape through the exhaust port (block 4630). Accordingly, the liquid structural adhesive may cure and solidify to form a solid structural adhesive after being introduced to the interior cavity 2100. The solid structural adhesive 4914 may provide relatively high shear and peel strengths as described herein. In one example, the solid structural adhesive 4914 may have a tensile strength of greater than 11.0 MPa at 21° C. (1595 psi at 70° F.). In another example, the solid structural adhesive 4914 may have a tensile strength of greater than 11.48 MPa at 21° C. (1665 psi at 70° F.). In another example, the solid structural adhesive 4914 may have a tensile strength of greater than 12.5 MPa at 21° C. (1812 psi at 70° F.). In another example, the solid structural adhesive 4914 may have a tensile strength of greater than 12.7 MPa at 21° C. (1850 psi at 70° F.). In another example, the solid structural adhesive 4914 may have a tensile strength of greater than 12.7 MPa at 21° C. (1850 psi at 70° F.). The apparatus, methods, and articles of manufacture described herein are not limited in this regard.

The process 4600 may include curing the liquid structural adhesive for 24 hours at a temperature of 21° C. (70° F.). Accordingly, the resulting solid structural adhesive 4914 may exhibit a desirably high overlap shear strength relative to the surface(s) of the body portion 1510 and/or the face portion 1562 forming the finished interior cavity 2100. For example, the solid structural adhesive 4914 may exhibit an overlap shear strength relative to the surface(s) of the body portion 1510 and/or the face portion 1562 forming the finished interior cavity 2100 of at least 8.6 MPa (1250 psi). In another example, the solid structural adhesive 4914 may exhibit an overlap shear strength relative to the surface(s) of the body portion 1510 and/or the face portion 1562 forming the finished interior cavity 2100 of at least 10.2 MPa (1475 psi). In another example, the solid structural adhesive 4914 may exhibit an overlap shear strength relative to the surface(s) of the body portion 1510 and/or the face portion 1562 forming the finished interior cavity 2100 of at least 11.2 MPa (1625 psi). In another example, the solid structural adhesive 4914 may exhibit an overlap shear strength relative to the surface(s) of the body portion 1510 and/or the face portion 1562 forming the finished interior cavity 2100 of at least 11.72 MPa (1700 psi). The liquid structural adhesive may be a two-part epoxy adhesive having a base material mixed with an accelerator material. In one example, the accelerator material may be a polymeric mercaptan. The apparatus, methods, and articles of manufacture described herein are not limited in this regard.

Figure 47:
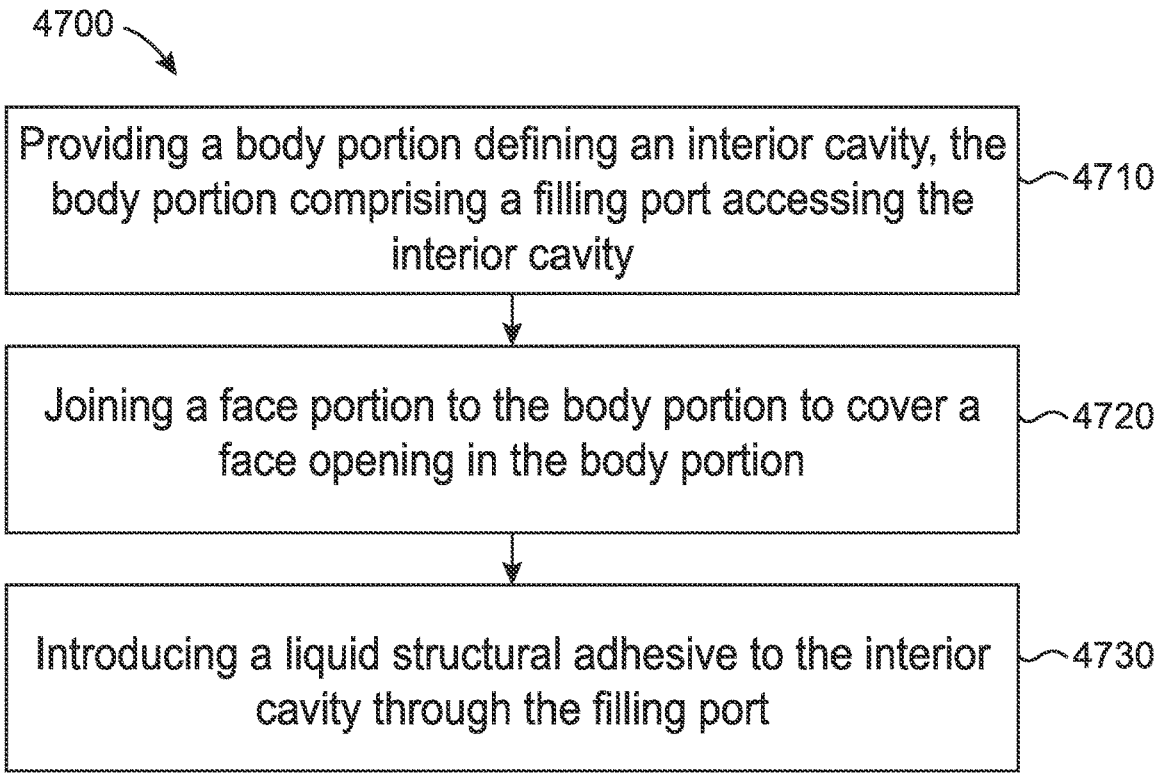

FIG. 47 shows an example process 4700 to manufacture a golf club head. The process 4700 may include providing a body portion 1510 defining an interior cavity 2100 (block 4710). The body portion 1510 may include a filling port accessing the interior cavity 2100. The filling port may access the interior cavity 2100 from a back portion, a sole portion, a top portion, a toe portion, a heel portion, a perimeter portion, and/or other suitable portion(s) of the body portion 1510. In one example, the hosel portion 1555 may be used as a filling or exhaust port. The process 4700 may include joining a face portion 1562 to cover an opening in the body portion 1510 (block 4720). In one example, the face portion 1562 may be welded the front portion 1560 of the body portion 1510 to cover the opening. The process 4700 may include introducing a liquid structural adhesive to the interior cavity 2100 through the filling port and allowing displaced air to escape (block 4730). Accordingly, the liquid structural adhesive may cure and solidify to form a solid structural adhesive 4914 after being introduced to the interior cavity 2100. The solid structural adhesive 4914 may provide relatively high shear and peel strengths as described herein. The process 4700 may include curing the liquid structural adhesive for 24 hours at a temperature of 70° F. (21° C.). Accordingly, the resulting solid structural adhesive 4914 may exhibit a relatively high overlap shear strength, as described herein, relative to the surface(s) of the body portion 1510 and/or the face portion 1562 forming the finished interior cavity 2100. The liquid structural adhesive may be a two-part epoxy adhesive having a base material mixed with an accelerator material. In one example, the accelerator material may be a polymeric mercaptan. The apparatus, methods, and articles of manufacture described herein are not limited in this regard.

Figure 48:
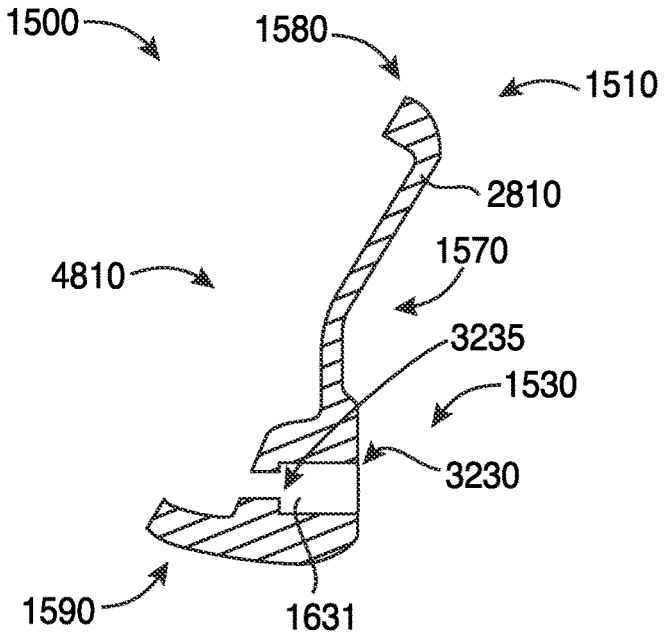
FIG. 48 depicts a partial cross-sectional view of an example golf club head according to an embodiment of the apparatus, methods, and articles of manufacture described herein.

FIG. 48 illustrates a cross-sectional view of an example golf club head 1500 prior to joining the face portion 1562 to the body portion 1510 and prior to adding structural adhesive 4914 to the interior cavity 2100. The body portion 1510 of the golf club head 1500 may include a face opening 4810 proximate a front portion 1560 of the body portion 1510. The face opening 4810 may be configured to receive a face portion 1562 (e.g., a strike face) having a front surface 1564 and a back surface 1566. The face opening 4810 may provide access to the surface(s) of the interior cavity 2100, thereby facilitating preparation of the surface(s) as described herein prior to introducing liquid structural adhesive 4914 to the interior cavity. The apparatus, methods, and articles of manufacture described herein are not limited in this regard.

FIG. 49 illustrates a cross-sectional view of the example golf club head of FIG. 48 after the face portion 1562 has been joined to the body portion 1510 and after structural adhesive 4914 has been introduced to the interior cavity 2100. A weld, such as a seam weld or a stich weld may be used to join the face portion 1560 to the body portion 1510. In the example illustrated in FIGS. 51-55, a weld 1705 may circumscribe or substantially circumscribe the face portion 1562. The weld 1705 may be continuous or substantially continuous around a perimeter edge of the face portion 1562. After the weld 1705 is formed, it may be sanded and/or polished to provide a surface contour that matches the contour of the body portion 1510. Along a top side, bottom side, and toe side of the golf club head 1500, the weld 1705 may be provided along a rear perimeter edge of the face portion 1562. As illustrated in FIGS. 51-55, the weld 1705 may extend along a top perimeter (i.e. top rail), bottom perimeter (i.e. sole) and toe perimeter of the club head. The weld location may provide a golf club head 1500 with a larger functional face area without increasing the surface area of an external face area of the face portion 1562 or the overall size of the club head. The functional face area may be a measure of the area of the face portion that is capable of moving relative to the golf club head 1500 and/or inwardly deflecting when the club head strikes a golf ball. The functional face area may be equivalent in size to an internal face area defined as a surface area on the rear surface of the face portion 1562 that is in contact with the structural adhesive 4914. In one example, the internal face area may be at least 75% as large as the external face area. In another example, the internal face area may be at least 85% as large as the external face area. In yet another example, the internal face area may be at least 95% as large as the external face area. Providing a larger internal face area while keeping the external face area the same size provides a larger functional face area. The larger functional face area, supported by structural adhesive 4914 in the interior cavity 2100, may provide consistent responses to impacts at various locations across the face portion 1562, despite the face portion being relatively thin as discussed herein. The apparatus, methods, and articles of manufacture described herein are not limited in this regard.

As illustrated in the example golf club head 4900 of FIG. 49, the interior cavity 2100 may be filled or substantially filled with structural adhesive 4914. The structural adhesive 4914 may be strongly bonded to the back surface of the face portion 1562 and may occupy the interior cavity between the back surface of the face portion 1562 and a surface of the interior cavity 2100 of the body portion 1510. In one example, the face portion 1562 may have a thickness of less than 2.54 mm. In another example, the face portion 1562 may have a thickness of less than 1.9 mm. In yet another example, the face portion 1562 may have a thickness of less than 1.52 mm. In still another example, the face portion 1562 may have a thickness of less than 0.76 mm. Despite having a thin face in combination with the interior cavity 2100, the golf club head 4900 may exhibit unexpected forgiveness in response to mishits. Higher forgiveness may correlate with a lower percentage difference between a first COR ($COR_A$) value at a first location on the strike face and a second ($COR_B$) value at a second location on the strike face. The apparatus, methods, and articles of manufacture described herein are not limited in this regard.

Figure 50:
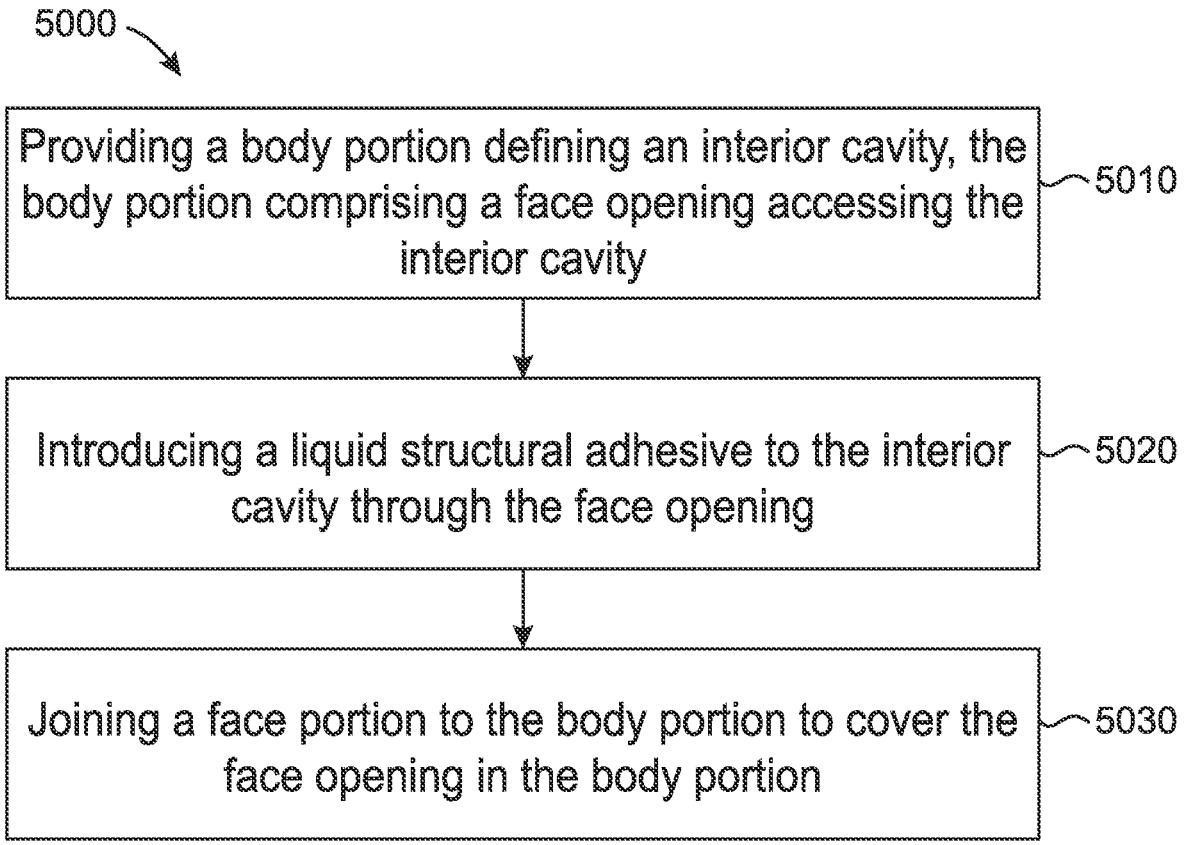
FIG. 50 depicts a manner in which an example golf club head described herein may be manufactured.
Figure 51:
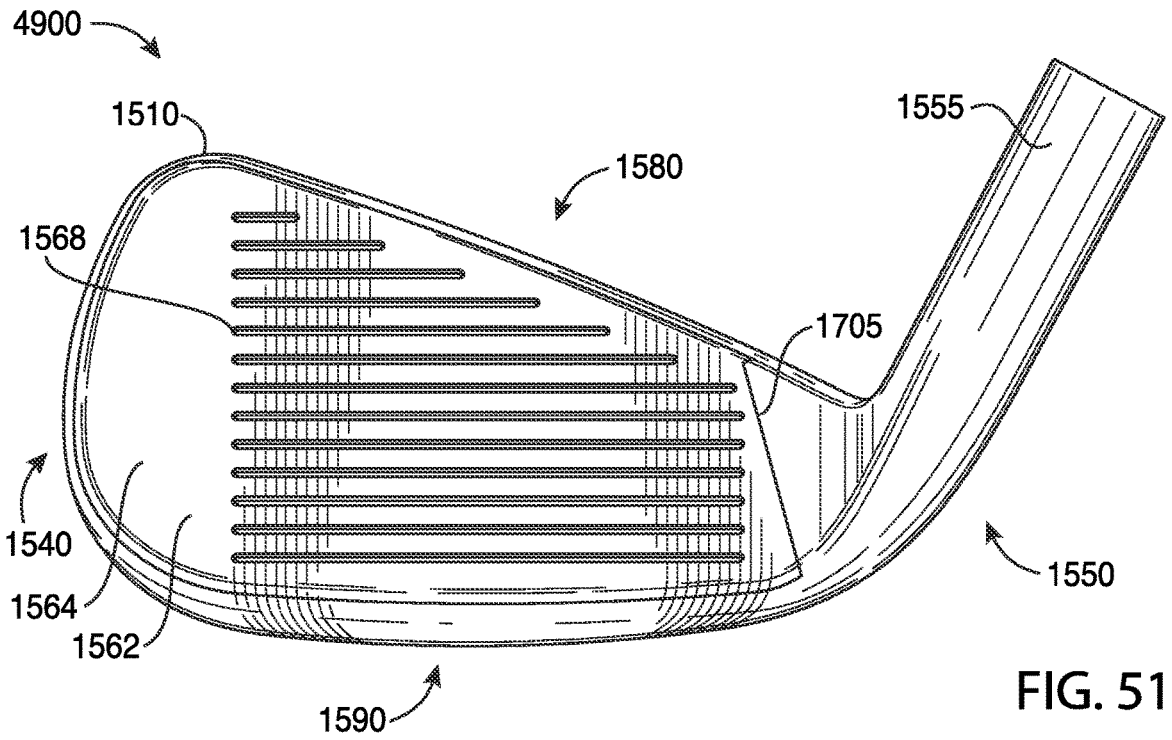
FIGS. 51, 52, 53, 54, and 55 depict a front view, a rear view, a top view, a bottom view, and a heel side perspective view, respectively, of a golf club head according to an embodiment of the apparatus, methods, and articles of manufacture described herein.
Figure 52:
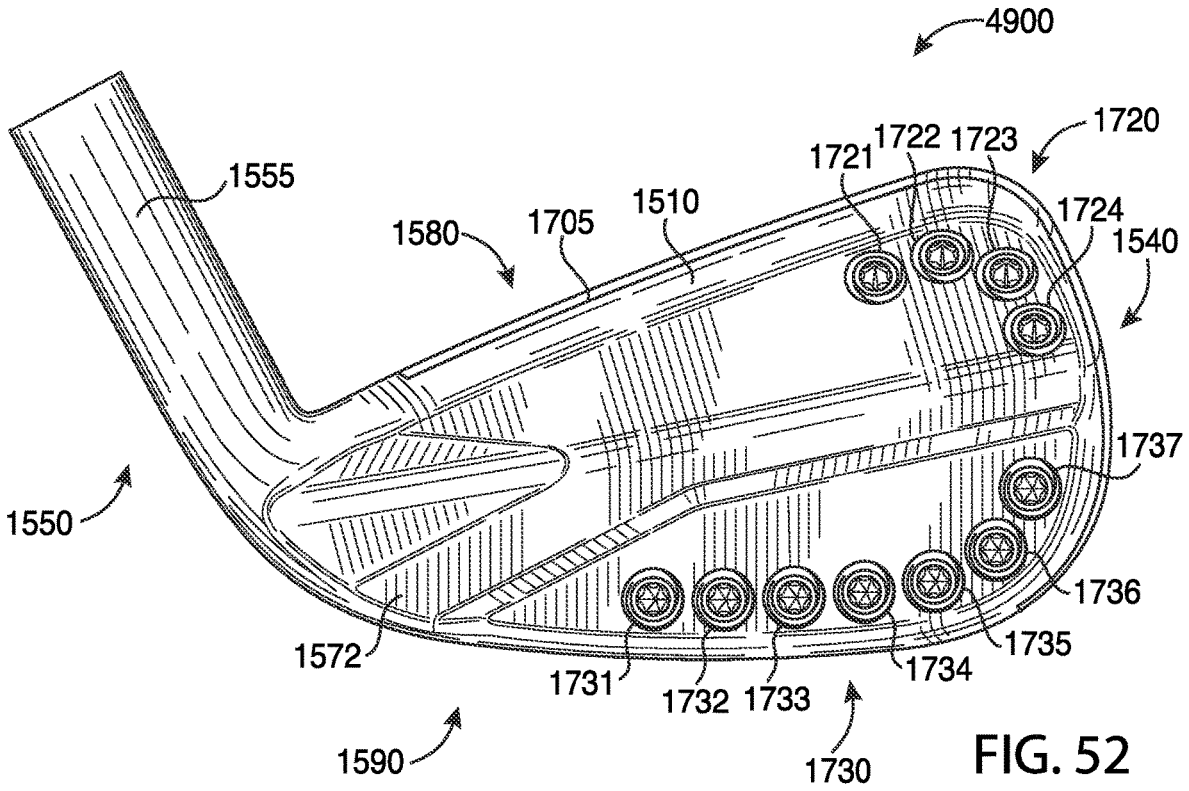
Figure 53:
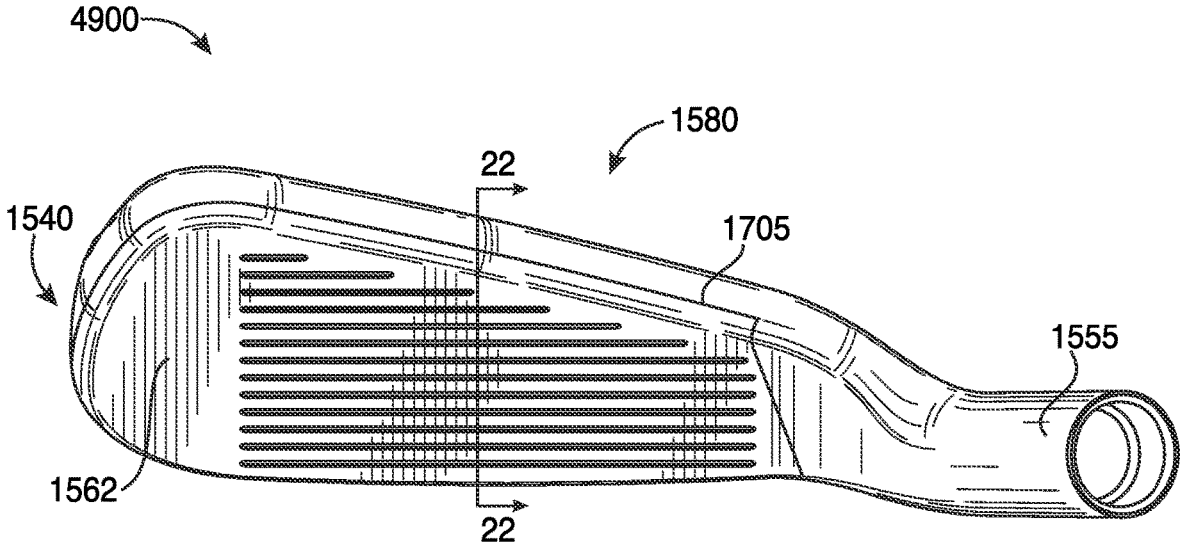
Figure 54:
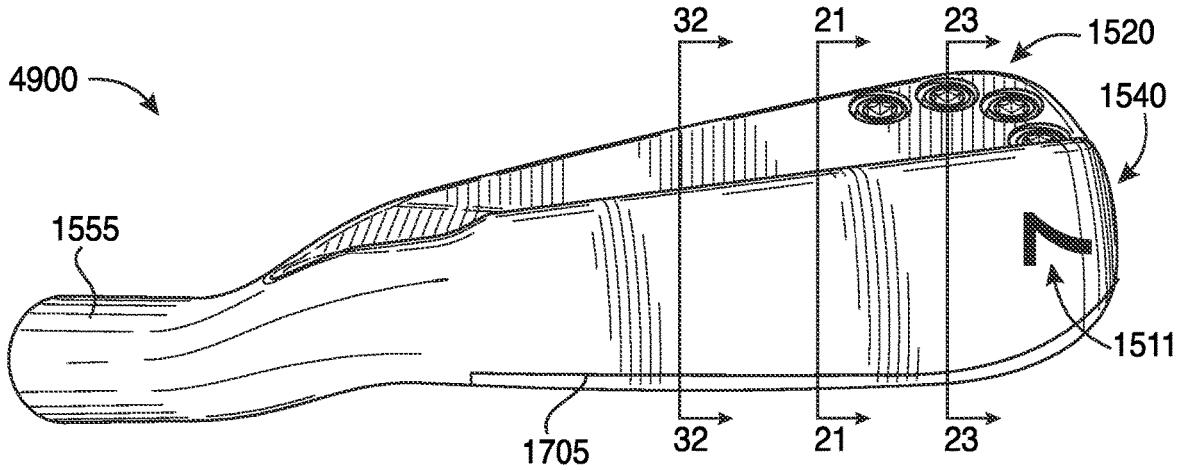
Figure 55:
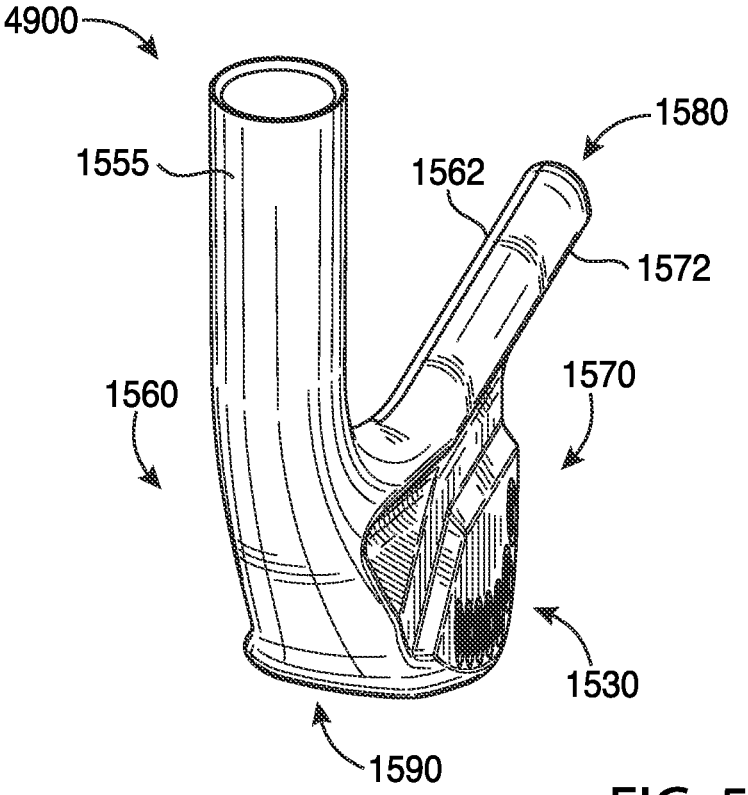

FIG. 50 shows an example process 5000 to manufacture a golf club head 1500. The process 5000 may include providing a body portion 1510 defining an interior cavity 2100 (block 5010). The body portion 1510 may include a face opening 4810 accessing the interior cavity 2100. The face opening 4810 may access the interior cavity 2100. The process 5000 may include introducing a liquid structural adhesive 4914 to the interior cavity 2100 through the face opening 4810 and allowing displaced air to escape (block 5020). The process 5000 may include joining a face portion 1562 to cover an opening in the body portion 1510 (block 5030). In one example, the face portion 1562 may be joined to the front portion 1560 of the body portion 1510 to cover the face opening 4810. Accordingly, the liquid structural adhesive may cure and solidify to form a solid structural adhesive 4914 after being introduced to the interior cavity 2100. The solid structural adhesive 4914 may provide relatively high shear and peel strengths as described herein. In one example, the process 3500 may include curing the liquid structural adhesive for 24 hours at a temperature of about 70° F. (21° C.). In another example, the process 3500 may include curing the liquid structural adhesive at a temperature of above 70° F. (21° C.) for a duration less than 24 hours. Accordingly, the resulting solid structural adhesive 4914 may exhibit a high overlap shear strength, as described herein, relative to the surface(s) of the body portion 1510 and/or the face portion 1562 forming the finished interior cavity 2100. The liquid structural adhesive may be a two-part epoxy adhesive having a base material mixed with an accelerator material. In one example, the accelerator material may be a polymeric mercaptan. The apparatus, methods, and articles of manufacture described herein are not limited in this regard.

The heating and cooling processes described herein may be performed by conduction, convention, and/or radiation. The heating or cooling processes may employ heating or cooling systems with conveyor systems that move the golf club head 1500 or any of the golf club heads described herein through a heated or cooled environment for a period of time as described herein. The apparatus, methods, and articles of manufacture described herein are not limited in this regard.

The face portion 1562 may include a non-smooth back surface to improve adhesion and/or mitigate delamination between the face portion 1562 and the elastic polymer material used to fill the interior cavity 2100 (e.g., FIG. 21). Various methods and/or processes such as an abrasive blasting process (e.g., a bead blasting process, a sand blasting process, other suitable blasting process, or any combination thereof) and/or a milling (machining) process may be used to form the back surface 1566 into a non-smooth surface. For example, the back surface 1566 may have with a surface roughness ($R_a$) ranging from 0.5 to 250 μin (0.012 to 6.3 μm). The apparatus, methods, and articles of manufacture are not limited in this regard.

Figure 56:
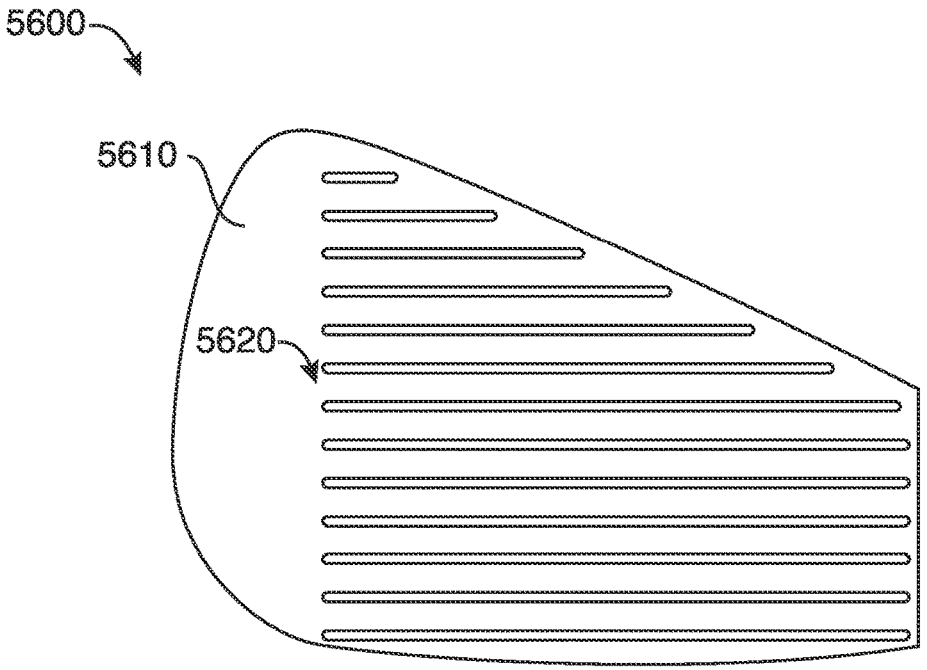
FIGS. 56 and 57 depict a front view and a back view, respectively, of a face portion of any of the example golf club heads described herein.
Figure 57:
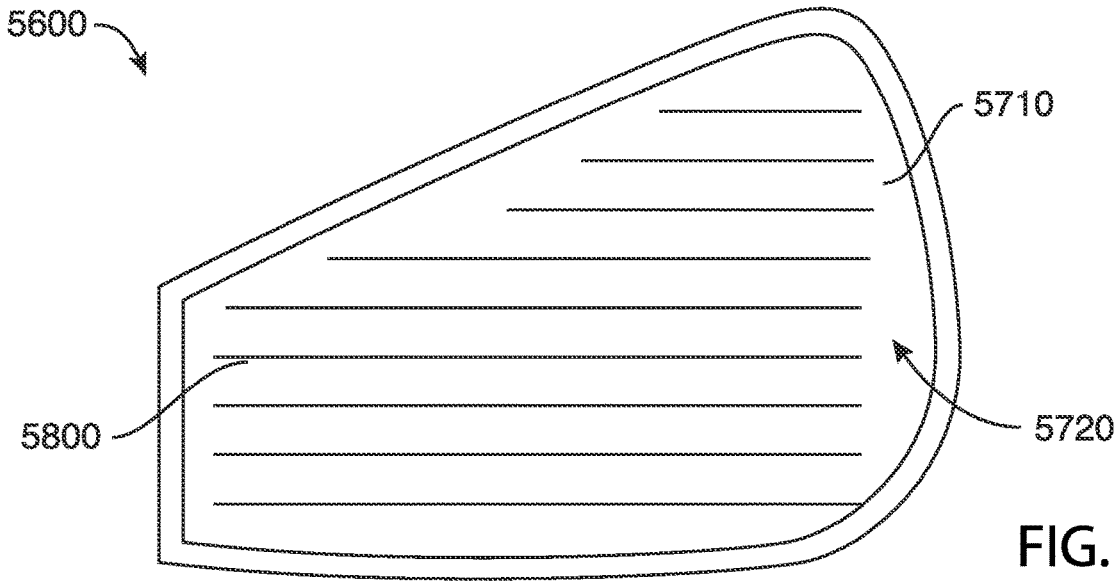
Figure 58:
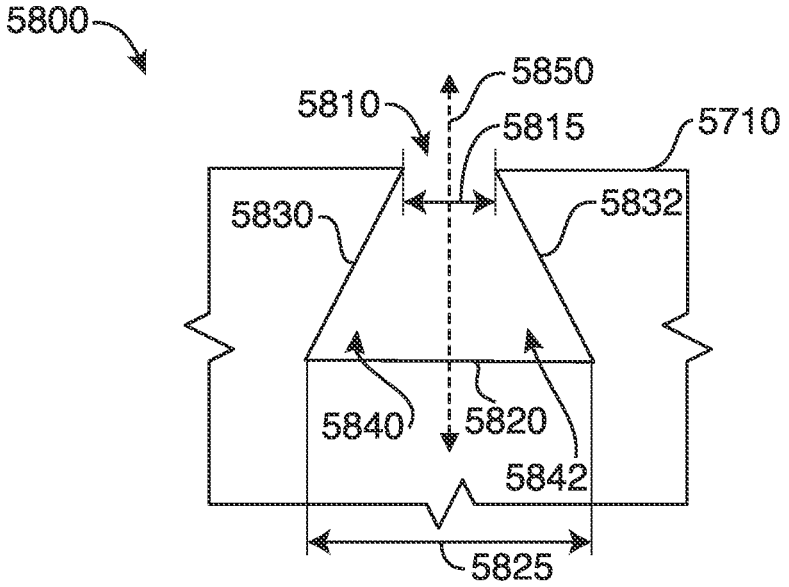
FIGS. 58, 59, 60, and 61 depict cross-sectional views of example channels, respectively, of the face portion of FIG. 56.

As illustrated in FIGS. 56-58, for example, a face portion 5600 may include the front surface 5610, and the back surface 5710. The front surface 5610 may include one or more grooves, generally shown as 5620, extending longitudinally across the front surface 5610 (e.g., extending between the toe portion 1540 and the heel portion 1550 of FIG. 15). The front surface 5610 may be used to impact a golf ball (not shown). The back surface 5710 may also include one or more channels, generally shown as 5720. The channels 5720 may extend longitudinally across the back surface 5710. The channels 5720 may be parallel or substantially parallel to each other. The channels 5720 may engage with the elastic polymer material used to fill the interior cavity 2100, and serve as a mechanical locking mechanism between the face portion 5600 and the elastic polymer material. In particular, a channel 5800 may include an opening 5810, a bottom section 5820, and two sidewalls, generally shown as 5830 and 5832. The bottom section 5820 may be parallel or substantially parallel to the back surface 5710. The two sidewalls 5830 and 5832 may be converging sidewalls (i.e., the two sidewalls 5830 and 5832 may not be parallel to each other). The bottom section 5820 and the sidewalls 5830 and 5832 may form two undercut portions, generally shown as 5840 and 5842. That is, a width 5815 at the opening 5810 may be less than a width 5825 of the bottom section 5820. A cross section of the channel 5800 may be symmetrical about an axis 5850. While FIG. 58 may depict flat or substantially flat sidewalls, the two sidewalls 5830 and 5832 may be curved (e.g., convex relative to each other). The apparatus, methods, and articles of manufacture are not limited in this regard.

Figure 59:
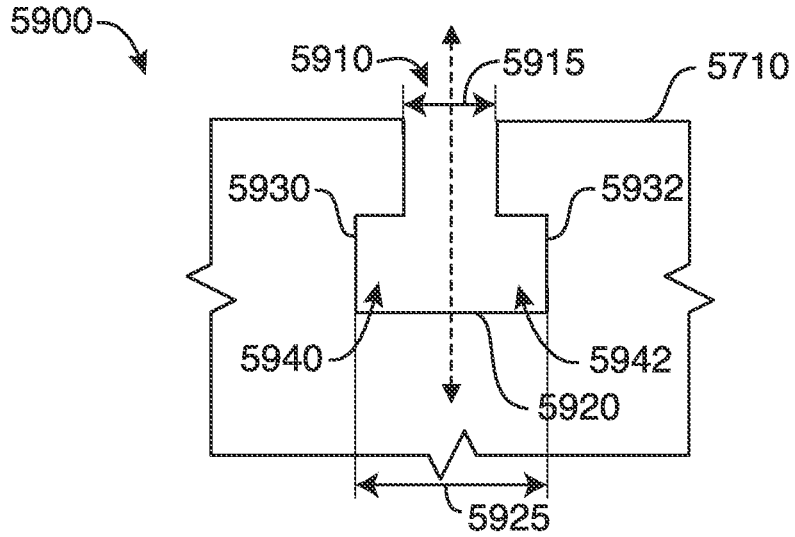

Instead of flat or substantially flat sidewalls as shown in FIG. 58, a channel may include other types of sidewalls. As illustrated in FIG. 59, for example, a channel 5900 may include an opening 5910, a bottom section 5920, and two sidewalls, generally shown as 5930 and 5932. The bottom section 5920 may be parallel or substantially parallel to the back surface 5710. The two sidewalls 5930 and 5932 may be stepped sidewalls. The bottom section 5920 and the sidewalls 5930 and 5932 may form two undercut portions, generally shown as 5940 and 5942. That is, a width 5915 at the opening 5910 may be less than a width 5925 of the bottom section 5920. A cross section of the channel 5900 may be symmetrical about an axis 5950. The apparatus, methods, and articles of manufacture are not limited in this regard.

Figure 60:
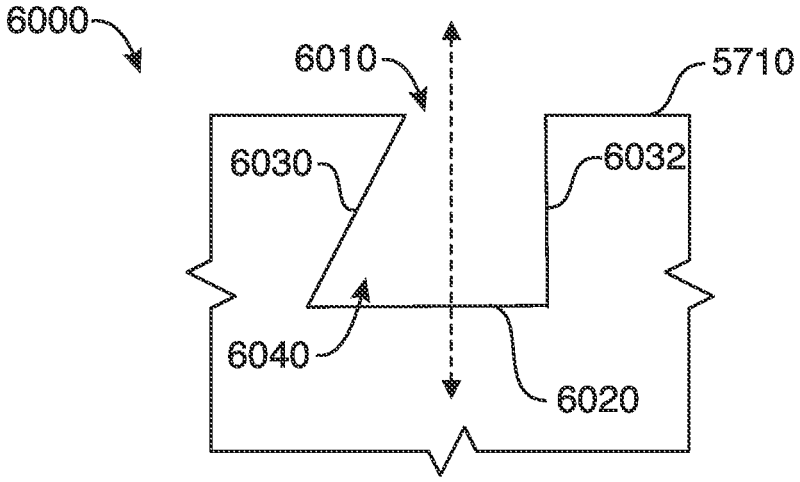

Instead of being symmetrical as shown in FIGS. 58 and 59, a channel may be asymmetrical. As illustrated in FIG. 60, for another example, a channel 6000 may include an opening 6010, a bottom section 6020, and two sidewalls, generally shown as 6030 and 6032. The bottom section 6020 may be parallel or substantially parallel to the back surface 5710. The bottom section 6020 and the sidewall 6030 may form an undercut portion 6040. The apparatus, methods, and articles of manufacture are not limited in this regard.

Figure 61:
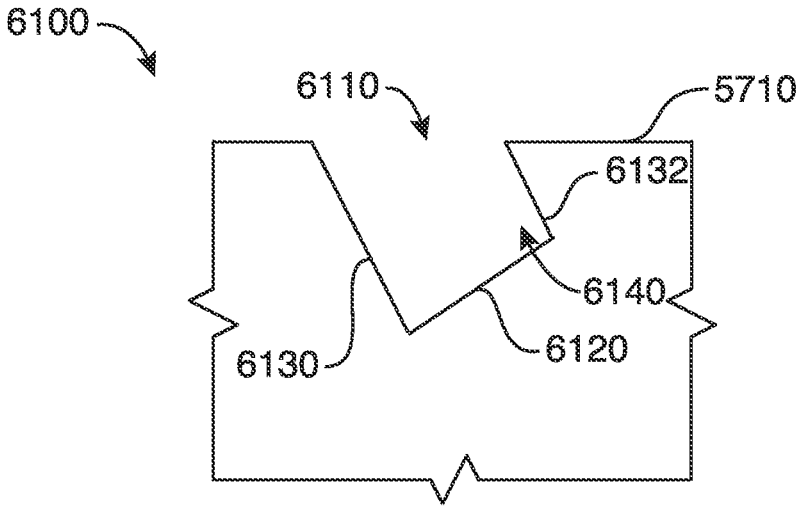

Referring to FIG. 61, for example, a channel 6100 may include an opening 6110, a bottom section 6120, and two sidewalls, generally shown as 6130 and 6132. The bottom section 6120 may not be parallel or substantially parallel to the back surface 5710. The two sidewalls 6130 and 6132 may be parallel or substantially parallel to each other but one sidewall may be longer than the other sidewall. The bottom section 6120 and the sidewall 6132 may form an undercut portion 6140. The apparatus, methods, and articles of manufacture are not limited in this regard.

Figure 15:
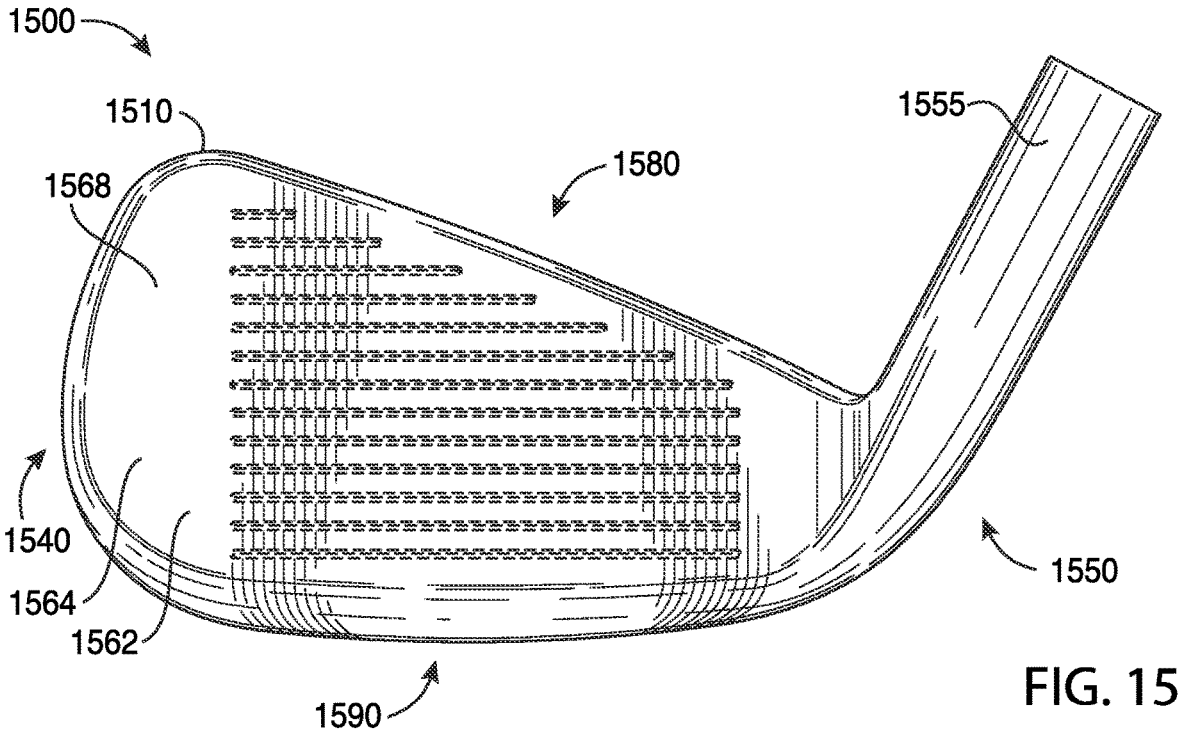
FIGS. 15, 16, 17, 18, 19, 20, 21, 22, 23, and 24 depict a front view, a rear view, a top view, a bottom view, a heel-side view, a toe-side view, a cross-sectional view along line 21-21 of FIG. 18, a cross-sectional view along line 22-22 of FIG. 17, a cross-sectional view along line 23-23 of FIG. 18, and another rear view, respectively, of a golf club head of the golf club of FIG. 14.
Figure 62:
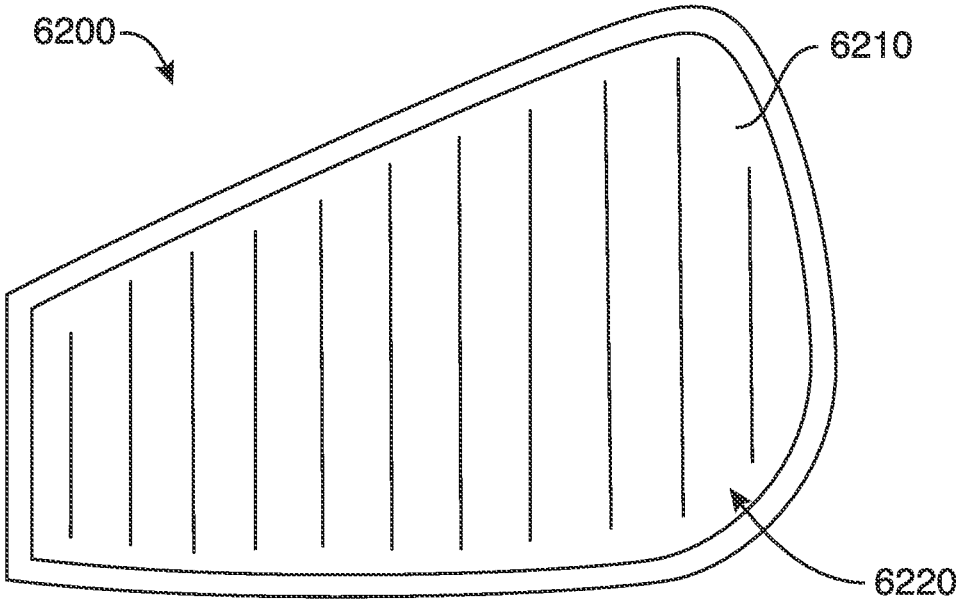
FIGS. 62, 63, and 64 each depicts a back view, respectively, of a face portion of any of the example golf club heads described herein.
Figure 63:
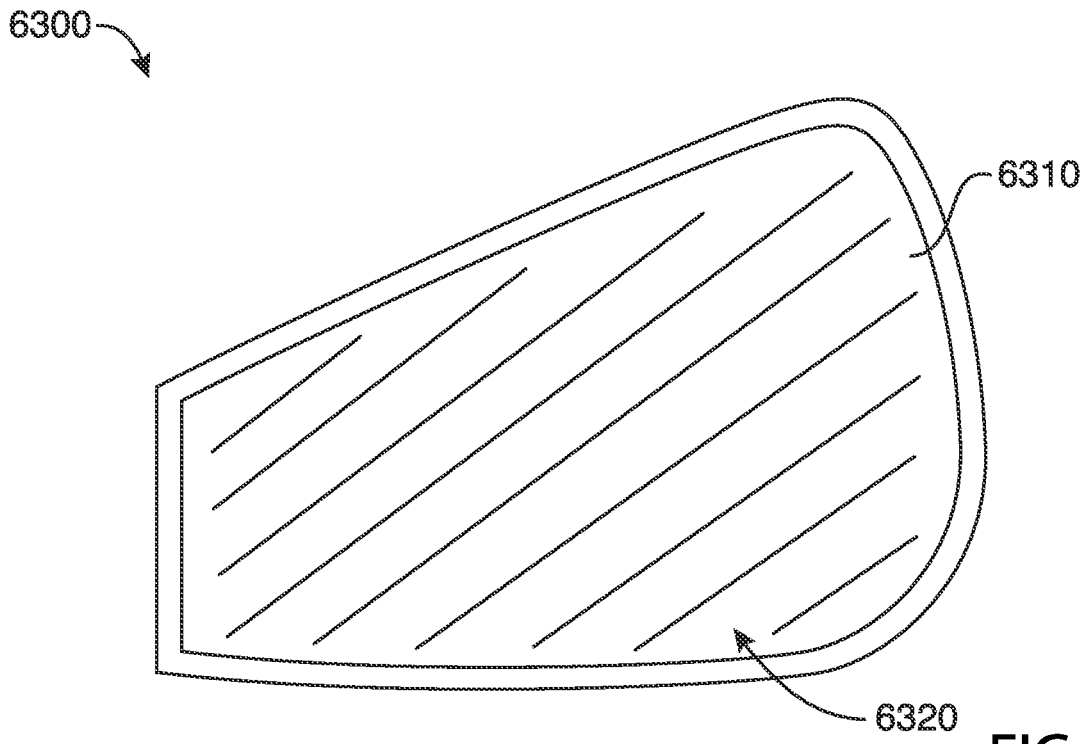
Figure 64:
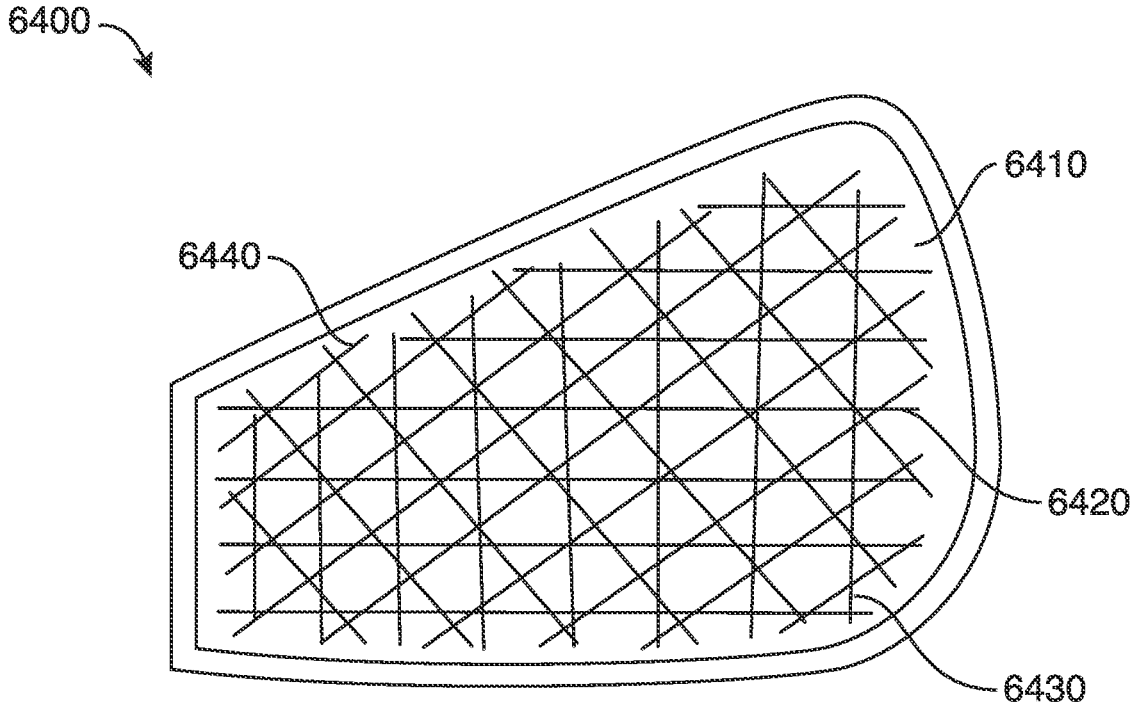
Figure 65:
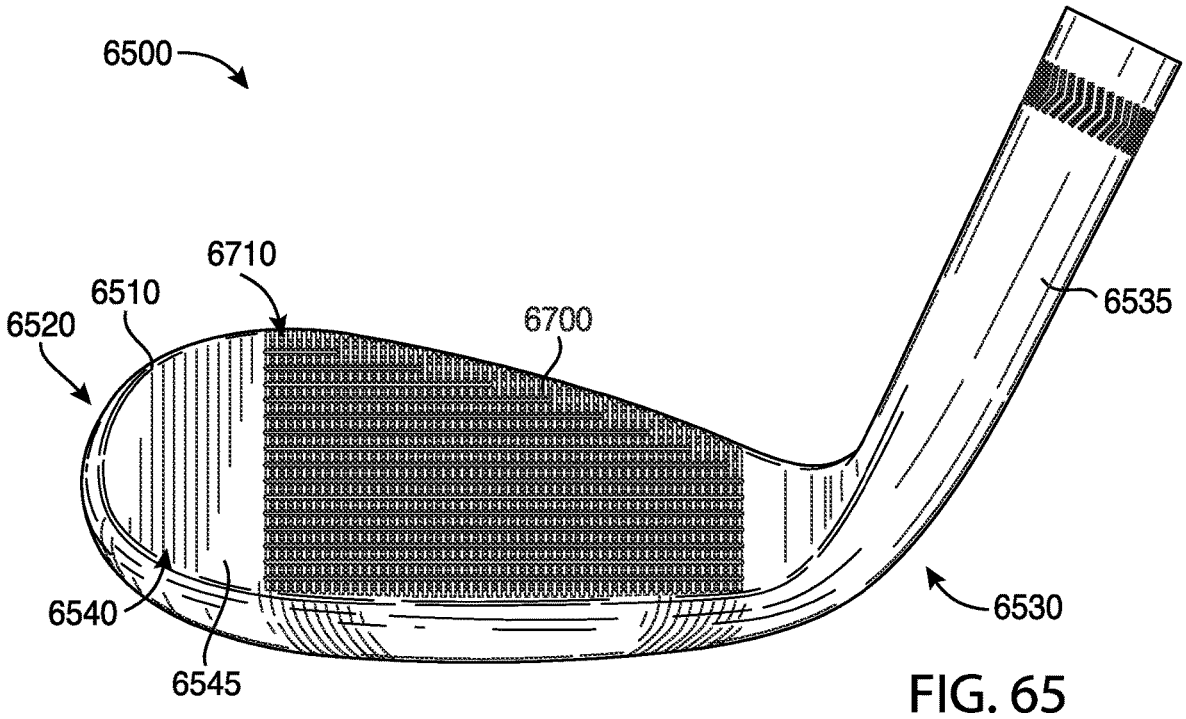
FIGS. 65 and 66 depict a front view and a top view, respectively, a golf club head according to an embodiment of the apparatus, methods, and articles of manufacture described herein.
Figure 66:
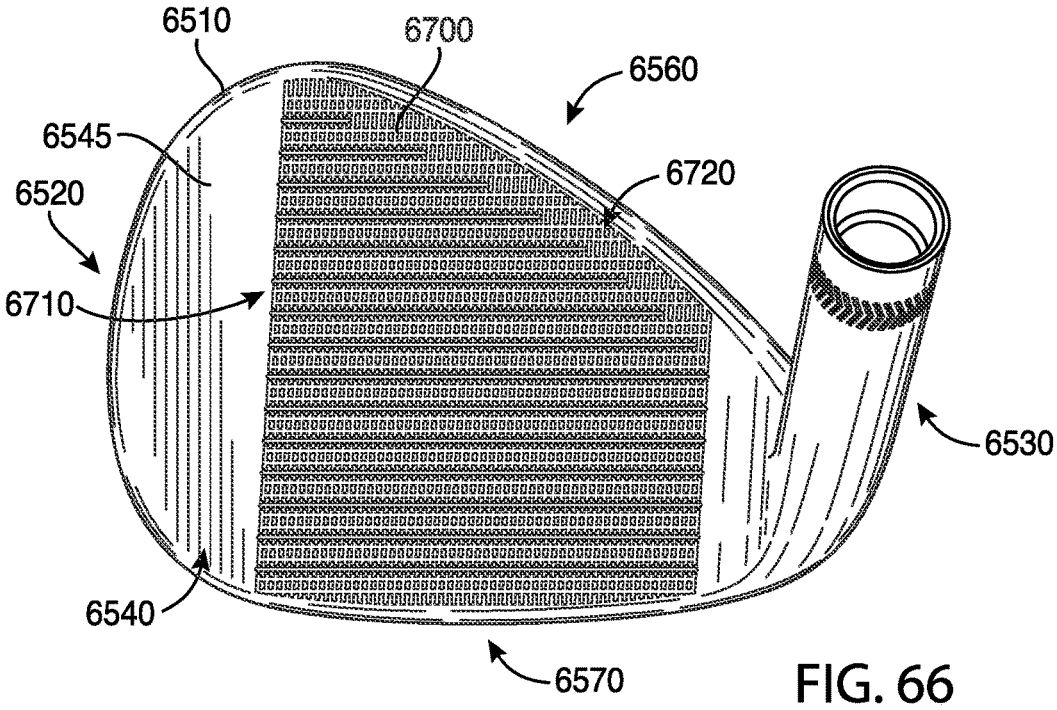

In the example as shown in FIG. 62, a face portion 6200 may include a back surface 6210 with one or more channels, generally shown as 6220, extending laterally across the back surface 6210 (e.g., extending between the top portion 1580 and the sole portion 1590 of FIG. 15). In another example as depicted in FIG. 63, a face portion 6300 may include a back surface 6310 with one or more channels, generally shown as 6320, extending diagonally across the back surface 6310. Alternatively, a face portion may include a combination of channels extending in different directions across a back surface of the face portion (e.g., extending longitudinally, laterally, and/or diagonally). Turning to FIG. 64, for yet another example, a face portion 6400 may include a back surface 6410 with one or more channels, generally shown as 6420, 6430, and 6440, extending in different directions across the back surface 6410. In particular, the face portion 6400 may include a plurality of channels 6420 extending longitudinally across the back surface 6410, a plurality of channels 6430 extending laterally across the back surface 6410, and a plurality of channels 6440 extending diagonally across the back surface 6410. The apparatus, methods, and articles of manufacture are not limited in this regard.

In the example of FIGS. 65-70, a golf club head 6500 may include a body portion 6510. For example, the body portion 6510 may be partially or entirely made of a steel-based material (e.g., 17-4 PH stainless steel, Nitronic® 50 stainless steel, or other types of stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 6510 may be partially or entirely made of non-metal material (e.g., composite, plastic, etc.). The apparatus, methods, and articles of manufacture are not limited in this regard.

The body portion 6510 may include a toe portion 6520, a heel portion 6530, a front portion 6540, a back portion 6550, a top portion 6560, and a sole portion 6570. The toe portion 6520 and the heel portion 6530 may be on opposite ends of the body portion 6510. The heel portion 6530 may include a hosel portion 6535 configured to receive a shaft (an example shaft shown in FIG. 14) with a grip (an example grip shown in FIG. 14) on one end and the golf club head 6500 on the opposite end of the shaft to form a golf club.

In one example, the body portion 6510 may be a hollow body including an interior cavity extending between the front portion 6540 and the back portion 6550. Further, the interior cavity may extend between the top portion 6560 and the sole portion 6570. The interior cavity may be partially or entirely filled as described herein. The interior cavity may be partially or entirely filled with an elastomer polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity may be filled with a TPE material to absorb shock, isolate vibration, and/or dampen noise when the golf club head 6500 strikes a golf ball. The apparatus, methods, and articles of manufacture described herein are not limited in this regard.

The front portion 6540 may include a face portion 6545 (e.g., a strike face) to engage a golf ball (not shown). In particular, the face portion 6545 may include an impact area 6700 and one or more grooves 6710 (e.g., generally shown as 6712, 6714, 6716, and 6718 in FIG. 68). The impact area 6700 may be used to strike a golf ball. The grooves 6710 may extend lengthwise between the toe portion 6520 and the heel portion 6530. The grooves 6710 may be associated with a groove width ($W_{groove}$) and a groove depth ($D_{groove}$). While the figures may depict a particular number of grooves, the apparatus, methods, and articles of manufacture described herein may include more or less grooves. The face portion 6545 may be an integral portion of the body portion 6510. Alternatively, the face portion 6545 may be a separate piece or an insert coupled to the body portion 6510 via various manufacturing methods and/or processes (e.g., a bonding process, a welding process, a brazing process, a mechanical locking method, any combination thereof, or other suitable types of manufacturing methods and/or processes). The face portion 6545 may be associated with a loft plane that defines the loft angle of the golf club head 6500. The loft angle may vary based on the type of golf club (e.g., a long iron, a middle iron, a short iron, a wedge, etc.). In one example, the loft angle may be between five degrees and seventy-five degrees. In another example, the loft angle may be between twenty degrees and sixty degrees. The apparatus, methods, and articles of manufacture described herein are not limited in this regard.

Further, the face portion 6545 may include a plurality of markings 6720. In particular, the plurality of markings 6720 may include a first set of markings 6810 (e.g., a plurality of first markings generally shown as 6812, 6814, 6816 and 6818) and a second set of markings 6820 (e.g., a plurality of second markings generally shown as 6822, 6824, 6826 and 6828). The first set of markings 6810 may extend lengthwise between the toe portion 6520 and the heel portion 6530 (e.g., along a dotted line). According to the example shown in FIG. 67, the markings of the first set of markings 6810 may be substantially parallel to each other. According to one example, the first set of markings 6810 may be oriented relative to the grooves 6710 at any angle such as at an angle in the range of about 0° to about 45°. According to the example shown in FIG. 67, the first set of markings 6810 may be substantially parallel to the grooves 6710.

Figure 67:
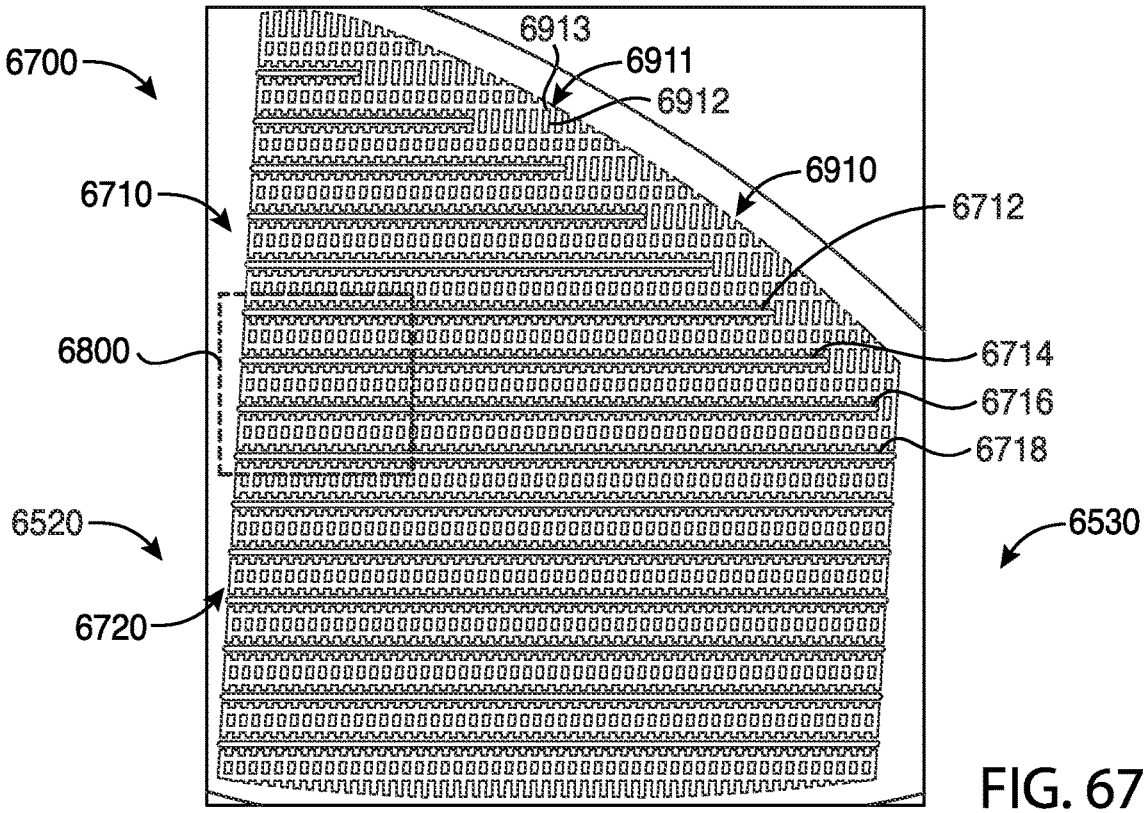
FIG. 67 depicts an enlarged view of an impact area of the example golf club head of FIG. 65.
Figure 68:
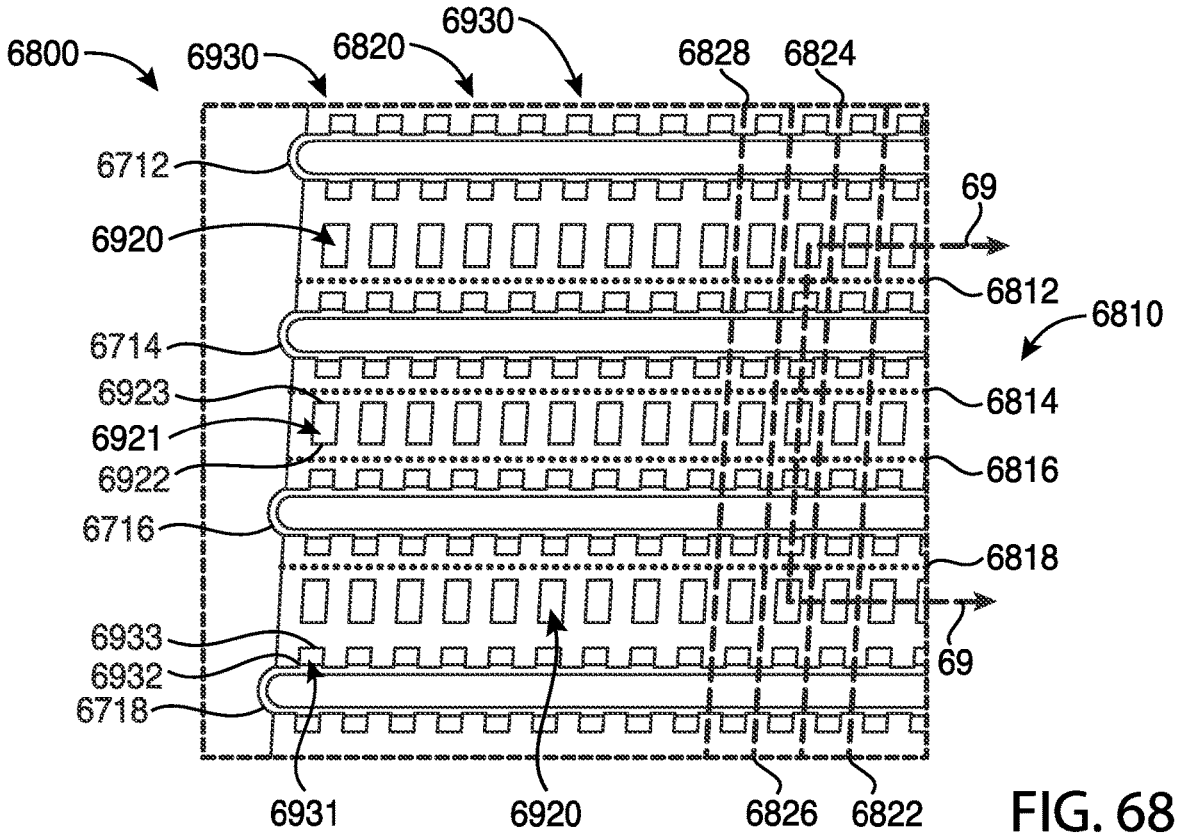
FIG. 68 depicts an enlarged view of area 6800 of FIG. 67.
Figure 69:
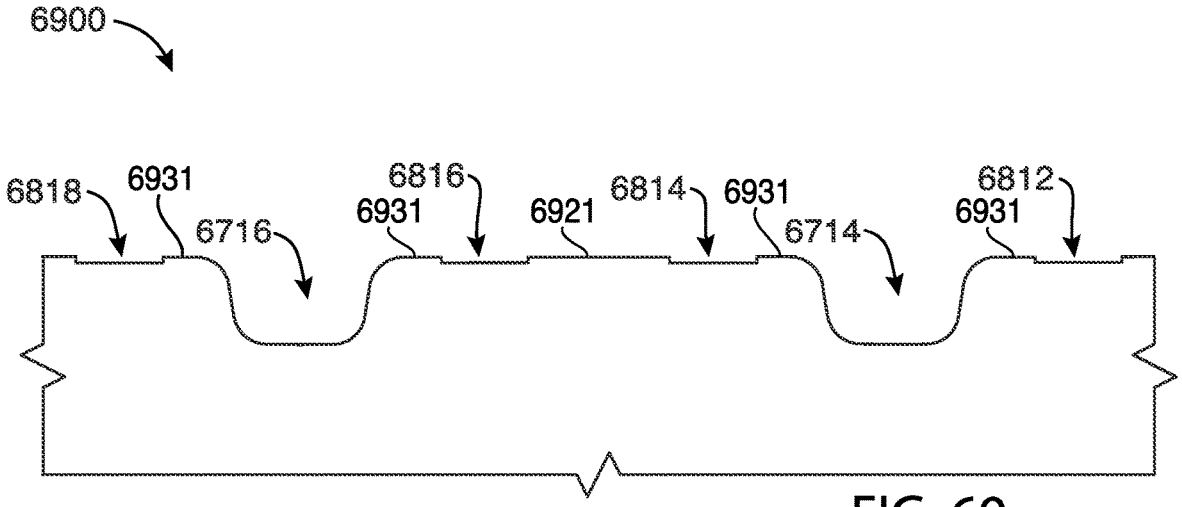
FIG. 69 depicts a cross-sectional view of the example golf club head of FIG. 65 along line 69-69 of FIG. 68.
Figure 70:
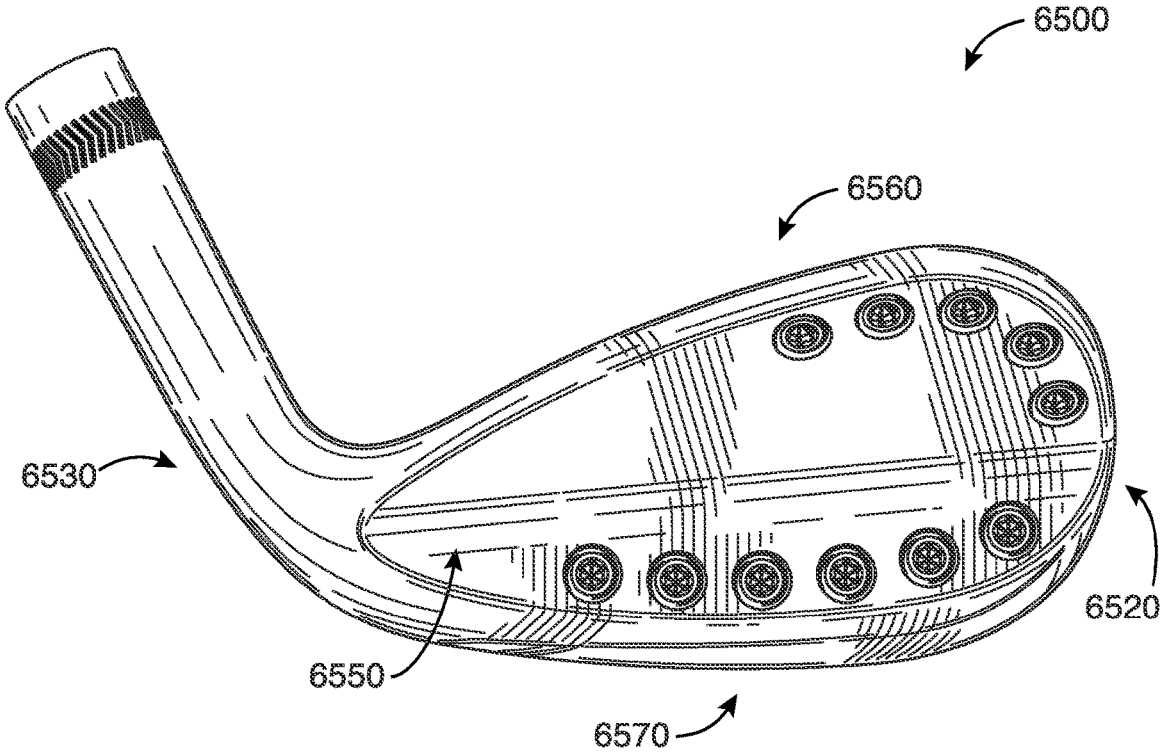
FIG. 70 depicts a rear view of the example golf club head of FIG. 65.

In contrast, according to the example shown in FIG. 68, which shows an enlarged view of a portion 6800 of the impact area 6700, the second set of markings 6820 may extend lengthwise between the top portion 6560 and the sole portion 6570 (e.g., along a dashed line). The markings of the second set of markings 6820 may generally extend in a direction from the top portion 6560 to the sole portion 6570. Accordingly, the markings of the second set of markings 6820 may be extend in a direction that is transverse to the markings of the first set of markings 6810. According to one example, at least one marking of the first set of markings 6810 and at least one marking of the second set of markings 6820 may intersect at an angle of between about 45° to 90°. According to the example shown in FIG. 68, the markings of the second set of markings 6820 may be substantially parallel to each other. However, the second set of markings 6820 may be substantially perpendicular to the first set of markings 6810 and the grooves 6710. Each marking of the second set of markings 6820 may intersect at least one marking of the first set of markings 6810 and at least one of the grooves 6710. As illustrated in FIG. 68, for example, each of the second markings 6822, 6824, 6826, and 6828 may intersect one or more first markings including 6812, 6814, 6816 and 6818 and one or more grooves including 6712, 6714, 6716 and 6718. As a result, the first and second sets of markings 6810 and 6820, respectively, may form a grid-like pattern or a checker-like pattern on the impact area 6700. According to one example, the markings may include certain shapes that are regularly or irregularly arranged in an array extending from the toe portion 6520 to the heel portion 6530 and from the top portion 6560 to the sole portion 6570. For example, as shown in the cross-sectional portion 6900 of the impact area 6700, each marking may be a rectangular recess such that a plurality of rectangular recesses are arranged in an array on the face portion 6545. As shown in FIGS. 67 and 68, the first and second sets of markings 6810 and 6820 may define a first set of rectangular projections 6910, a second set of rectangular projections 6920, and a third set of rectangular projections 6930. Each set of rectangular projections 6910, 6920, and 6930 may include one or more projections. Further, each projection may vary in size and shape. In one example, as shown in FIG. 67, the first set of rectangular projections 6910 may be located on at least a portion of the face portion between each of the plurality of grooves (e.g., 6712, 6714, 6716, and 6718) and the top portion 6560. Also, as shown in the example of FIGS. 67 and 68, the second set of rectangular projections 6920 may be located between adjacent grooves (e.g., 6712, 6714, 6716, and 6718), may be spaced apart from adjacent grooves (e.g., 6712, 6714, 6716, and 6718), and may be horizontally adjacent to another rectangular projection of the second set of rectangular projections 6920. Further, as shown in the example of FIGS. 67 and 68, each rectangular projection of the third set of rectangular projections 6930 may be adjacent to a corresponding groove (e.g., 6712, 6714, 6716, or 6718) such that each groove is surrounded by a plurality of rectangular projections of the third set of rectangular projections 6930, and may be horizontally adjacent along a corresponding groove to another rectangular projection of the third set of rectangular projections 6930. Also, as shown in FIGS. 67 and 68, each rectangular projection of the second set of rectangular projections 6920 may be vertically adjacent to a rectangular projection of the first set of rectangular projections 6910 or to a rectangular projection of the third set of rectangular projections 6930. Each rectangular projection of the first set of rectangular projections 6910, the second set of rectangular projections 6920, and the third set of rectangular projections 6930 may have a length extending in a direction from the top portion 6560 to the sole portion 6570 and a width extending in a direction from the toe portion 6520 to the heel portion 6530. For example, as shown in FIG. 67, a rectangular projection 6911 of the first set of rectangular projections 6910 has a length 6912 and a width 6913, and as shown in FIG. 68, a rectangular projection 6921 of the second set of rectangular projections 6920 has a length 6922 and a width 6923, and a rectangular projection 6931 of the third set of rectangular projections 6930 has a length 6932 and a width 6933. In one example, as shown in FIGS. 67-69, the length 6912 of each rectangular projection 6911 of the first set of rectangular projections 6910 may be greater than the length 6922 of each rectangular projection 6921 of the second set of rectangular projections 6920. Also, as shown in the example of FIGS. 67-69, the length 6922 of each rectangular projection 6921 of the second set of rectangular projections 6920 may be greater than the length 6932 of each rectangular projection 6931 of the third set of rectangular projections 6930. As shown in FIGS. 67 and 68, the widths 6913, 6923, and 6933 of the rectangular projections of the first set of rectangular projections 6910, the second set of rectangular projections 6920, and the third set of rectangular projections 6930, respectively, may be the same or substantially the same considering manufacturing and measurement tolerances. As shown in FIG. 69, the heights of the rectangular projections of the first set of rectangular projections 6910, the second set of rectangular projections 6920, and the third set of rectangular projections 6930 may be the same or substantially the same considering manufacturing and measurement tolerances. As shown in FIG. 69, the depth of each groove e.g., 6712, 6714, 6716, and 6718) may be greater than the heights of the rectangular projections of the first set of rectangular projections 6910, the second set of rectangular projections 6920, and the third set of rectangular projections 6930. While the above examples may describe and the figures may depict a particular number of sets of rectangular projections, the apparatus, methods, and articles of manufacture described herein may include more or less sets of rectangular projections. According to one example, the recesses defining the first markings may be arranged in a direction from the toe portion 6520 to the heel portion 6530, and the recesses defining the second markings may be arranged in a direction from the top portion 6560 to the sole portion 6570. According to one example, the recesses defining the first markings and the second markings may be arranged diagonally on the face portion 6545. According to one example, the recesses defining the first markings and the second markings may be arranged in any configuration on the face portion 6545. While the figures may depict the plurality of markings 6720 forming a pattern on the impact area 6700, the plurality of markings may extend to cover the entire surface of the face portion 6545. Further, the plurality of markings 6720 may extend diagonally or in other directions on the face portion 6545. For example, a first set of markings may extend from the top portion of the toe portion 6520 to the bottom portion of the heel portion 6530, while a second set of markings may extend from the top portion of the heel portion 6530 to the bottom portion of the toe portion 6520. The apparatus, methods, and articles of manufacture are not limited in this regard.

The plurality of markings 6720 may be associated with a marking width ($W_{marking}$) and a marking depth ($D_{marking}$). The groove width ($W_{groove}$) may be greater than the marking width ($W_{marking}$) (i.e., $W_{groove}>W_{marking}$), and the groove depth ($D_{groove}$) may be greater than the marking depth ($D_{marking}$) (i.e., $D_{groove}>D_{marking}$). In one example, the marking width may be about 0.020 inches, and the marking depth may be about 0.001 inches. The apparatus, methods, and articles of manufacture are not limited in this regard.

The golf club head 6500 may be manufactured via various manufacturing methods and/or processes (e.g., a casting process, a forging process, a milling process, a cutting process, a grinding process, a welding process, a combination thereof, etc.). The golf club head 6500 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees)(°, 48°, 52°, 56°, 60°, etc.). Although FIGS. 65-70 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

Figure 71:
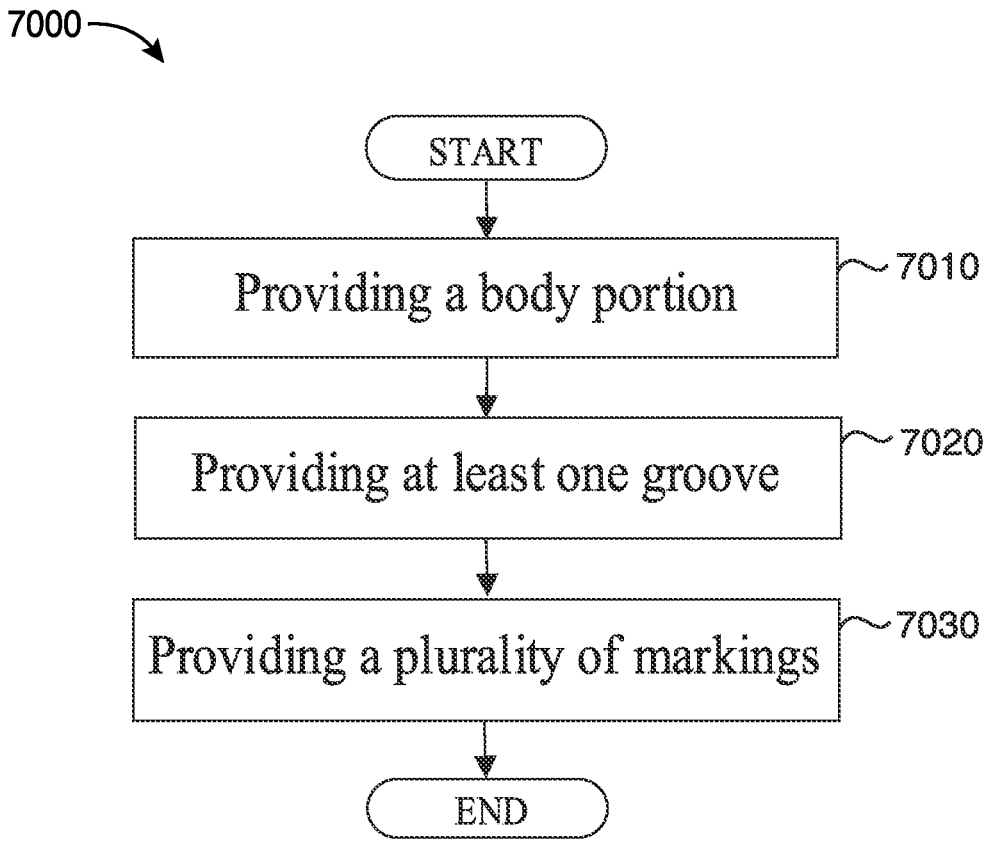
FIG. 71 depicts one manner in which the example golf club heads described herein may be manufactured.

FIG. 71 depicts one manner in which the example golf club head described herein may be manufactured. In the example of FIG. 71, the process 7100 may begin with providing a providing the body portion 6510 (FIG. 65) (block 7110). The body portion 6510 may include a toe portion 6520, a heel portion 6530, a top portion 6560, a sole portion 6570, and a face portion 6545 to engage a golf ball.

The process 7100 may form at least one groove 6710 in an impact area 6700 of the face portion 6545 (block 7120). The groove(s) 6710 may be associated with a groove width ($W_{groove}$) and a groove depth ($D_{groove}$). The groove(s) 6710 may extend lengthwise between the toe portion 6520 and the heel portion 6530.

The process 7100 may form a plurality of markings 6720 in the impact area 6700 of the face portion 6545 (block 7130). The plurality of markings 6720 may include a first set of markings 6810 and a second set of markings 6820. In particular, the first set of markings 6810 may extend lengthwise between the toe portion 6520 and the heel portion 6530. The first set of markings 6810 may be substantially parallel to the groove(s) 6710. In contrast, the second set of markings 6820 may extend lengthwise between the top portion 6560 and the sole portion 6570. The second set of markings 6820 may be substantially perpendicular to the groove(s) 6710 and the first set of markings 6810. Accordingly, each marking of the second set of markings 6820 may intersect with at least one groove 6710 and one marking of the first set of markings 6810. Further, the plurality of markings 6720 may be associated with a marking width ($W_{marking}$) and a marking depth ($D_{marking}$). The groove width ($W_{groove}$) may be greater than the marking width ($W_{marking}$) (i.e., $W_{groove}>W_{marking}$), and the groove depth ($D_{groove}$) may be greater than the marking depth ($D_{marking}$) (i.e., $D_{groove}>D_{marking}$).

The plurality of markings may affect frictional characteristics of the face portion 6545, which may affect ball spin and flight characteristics. For example, a plurality of markings may increase the friction of the face portion 6545 to increase the spin on a golf ball when the golf ball engages the face portion 6545 during impact. In another example, the plurality of markings may have certain configurations so as to affect the spin direction of a golf ball when the golf ball engages the face portion 6545 during impact. In yet another example, the plurality of markings may have certain configurations so as to reduce the spin of a golf ball when engaging the face portion 6545. Accordingly, the plurality of markings may be configured to provide a certain spin and flight characteristics for a golf ball. Further, the plurality of markings may be configured for an individual based on the stroke characteristics of the individual to improve the performance of the individual when using the golf club.

The example process 7100 is merely provided and described in conjunction with other figures as an example of one way to manufacture the golf club head 6500. While a particular order of actions is illustrated in FIG. 71, these actions may be performed in other temporal sequences. For example, two or more actions depicted in FIG. 71 may be performed sequentially, concurrently, or simultaneously. In one example, blocks 7110 and 7120 may be performed simultaneously or concurrently. Although FIG. 71 depicts a particular number of blocks, the process may not perform one or more blocks. The apparatus, methods, and articles of manufacture described herein are not limited in this regard.

The body portion and/or the face portion of any of the golf club heads described herein may be partially or entirely made of a steel-based material (e.g., 17-4 PH stainless steel, Nitronic® 50 stainless steel, alloy steel 8620, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. The body portion and/or the face portion may be constructed with materials that are similar to any of the body portions and/or face portions described herein or in any of the incorporated by reference applications. The apparatus, methods, and articles of manufacture described herein are not limited in this regard.

In one example, the area of the front surface of the face portion of any of the golf club heads described herein may be greater than or equal to 330 $mm^2$ and less than or equal to 5000 $mm^2$. In another example, the area of the front surface of the face portion of any of the golf club heads described herein may be greater than or equal to 1000 $mm^2$ and less than or equal to 5300 $mm^2$. In yet another example, the area of the front surface of the face portion of any of the golf club heads described herein may be greater than or equal to 1500 $mm^2$ and less than or equal to 4800 $mm^2$. While the above examples may describe particular areas, the area of the front surface may greater than or less than those numbers. The apparatus, methods, and articles of manufacture described herein are not limited in this regard.

In one example, a filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties (e.g., one or more adhesive or epoxy materials). A material may also absorb shock, isolate vibration, and/or dampen noise when a golf club head as described herein strikes a golf ball. Further, a filler material may be an epoxy material that may be flexible or slightly flexible when cured. In another example, a filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, a filler material may include 3M™ Scotch-Weld™ DP100 Plus Clear adhesive. In another example, a filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, a filler material may be LOCTITE® materials manufactured by Henkel Corporation, Rocky Hill, Conn. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience, i.e., relatively high coefficient of restitution (COR). The apparatus, methods, and articles of manufacture described herein are not limited in this regard. A filler material not specifically described in detail herein may include one or more similar or different types of materials described herein and in any of the incorporated by reference applications. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference applications. The apparatus, methods, and articles of manufacture described herein are not limited in this regard.

Any of the golf club heads described herein may be manufactured by casting from metal such as steel. However, other techniques for manufacturing a golf club head as described herein may be used such as 3D printing, or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters (cm3 or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above described ranges. The apparatus, methods, and articles of manufacture described herein are not limited in this regard.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may describe an iron-type or a wedge-type golf club head, the apparatus, methods, and articles of manufacture described herein may be applicable to other types of golf club heads (e.g., a driver-type golf club head, a fairway wood-type golf club head, a hybrid-type golf club head, a putter-type golf club head, etc.). Further, although the above examples may describe steel-based material, the apparatus, methods, and articles of manufacture described herein may be applicable to other types of metal materials, non-metal materials, or both.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "a," "an," and/or "the" used in the context of describing various embodiments the present disclosure are to be construed to cover both the singular and the plural, unless otherwise indicated herein or clearly contradicted by context. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein. The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a front portion, a toe portion with a toe portion edge, a heel portion with a hosel portion, a back portion with a back wall portion, a top portion with a top portion edge, a sole portion with a sole portion edge, and an interior cavity;

a face portion coupled to the front portion to enclose the interior cavity;

a filler material in the interior cavity;

a first mass portion coupled to the body portion, the first mass portion being cylindrical and having a threaded outer portion;

a hosel mass portion located in the hosel portion; and a port on the body portion, the port being cylindrical and having a threaded inner portion, wherein the threaded outer portion of the first mass portion is configured to engage the threaded inner portion of the port to secure the first mass portion inside the port, wherein a distance between a portion of the first mass portion and the hosel portion is substantially greater than a distance between the portion of the first mass portion and the toe portion edge, wherein the first mass portion and the hosel mass portion comprise a material having a greater density than a density of a material of the body portion, wherein the first mass portion and the hosel mass portion have at least one different physical property, and wherein a distance between a portion of the first mass portion and the face portion is less than a distance between a portion of the filler material and the face portion.

2. A golf club head as defined in claim 1, wherein an outer surface of the first mass portion defines a portion of an outer surface of the body portion.

3. A golf club head as defined in claim 1, wherein the body portion comprises a first material having a first density, and wherein the filler material comprises a second material having a second density less than the first density.

4. A golf club head as defined in claim 1, wherein the body portion comprises a first material having a first density, wherein the filler material comprises a second material having a second density different from the first density, and wherein the first mass portion comprises a third material having a third density greater than the first density and greater than the second density.

5. A golf club head as defined in claim 1, wherein the body portion comprises a first material having a first density, wherein the filler material comprises a second material having a second density less than the first density, and wherein the first mass portion comprises a third material having a third density different from the first density and different from the second density.

6. A golf club head as defined in claim 1, wherein the body portion comprises a steel based material having a first density, wherein the filler material comprises a material having a second density less than the first density, and wherein the first mass portion comprises a tungsten based material having a third density greater than the first density and greater than the second density.

7. A golf club head as defined in claim 1, wherein at least a portion of the filler material is attached to the body portion.

8. A golf club head as defined in claim 1, wherein at least a portion of the port is below a horizontal midplane of the body portion.

9. A golf club comprising:

a golf club shaft having a first end and a second end;

a golf club grip attached to the first end of the golf club shaft;

a golf club head coupled to the second end of the golf club shaft, the golf club head having a body portion comprising a first material having a first density, the body portion having a front portion with a front opening, a toe portion with a toe portion edge, a heel portion with a hosel portion, a back portion with a back wall portion, a top portion with a top portion edge, a sole portion with a sole portion edge, and an interior cavity;

a face portion attached to the body portion to close the front opening of the front portion;

a filler material in the interior cavity, the filler material comprising a second material having a second density;

a first mass portion coupled to the body portion, the first mass portion comprising a third material having a third density;

a hosel mass portion coupled to the hosel portion between the first end of the golf club shaft and the sole portion edge of the body portion; and a port on the body portion configured to receive the first mass portion, wherein at least a portion of the first mass portion is below a horizontal midplane of the body portion, wherein the first density is greater than the second density;

wherein the third density is greater than the first density;

wherein a distance between a portion of the first mass portion and the hosel portion is substantially greater than a distance between the portion of the first mass portion and the toe portion edge, and wherein the first mass portion and the hosel mass portion have at least one different physical property.

10. A golf club as defined in claim 9, wherein an outer surface of the first mass portion defines a portion of an outer surface of the body portion.

11. A golf club as defined in claim 9, wherein a distance between a portion of the first mass portion and the face portion is less than a distance between a portion of the filler material and the face portion.

12. A golf club as defined in claim 9, wherein the third material comprises a tungsten based material.

13. A golf club as defined in claim 9, wherein the first mass portion is cylindrical and the hosel mass portion is cylindrical.

14. A golf club head comprising:

a body portion having a front portion, a toe portion with a toe portion edge, a heel portion with a hosel portion, a back portion with a back wall portion, a top portion with a top portion edge, a sole portion with a sole portion edge, and an interior cavity;

a face portion coupled to the front portion to enclose the interior cavity;

a filler material in the interior cavity;

a first mass portion coupled to the body portion, the first mass portion being cylindrical and having a threaded outer portion;

a hosel mass portion located in the hosel portion; and a port on the body portion, the port being cylindrical and having a threaded inner portion, wherein the threaded outer portion of the first mass portion is configured to engage the threaded inner portion of the port to secure the first mass portion inside the port, wherein a distance between a portion of the first mass portion and the hosel portion is substantially greater than a distance between the portion of the first mass portion and the toe portion edge, wherein the first mass portion and the hosel mass portion comprise a material having a greater density than a density of a material of the body portion, wherein the first mass portion and the hosel mass portion have at least one different physical property, wherein a distance between a portion of the first mass portion and the face portion is less than a distance between a portion of the filler material and the face portion, wherein an outer surface of the first mass portion defines a portion of an outer surface of the body portion, and wherein a weight of the first mass portion is greater than a weight of the hosel mass portion.

15. A golf club head as defined in claim 14, wherein the body portion comprises a first material having a first density, and wherein the filler material comprises a second material having a second density less than the first density.

16. A golf club head as defined in claim 14, wherein the body portion comprises a first material having a first density, wherein the filler material comprises a second material having a second density different from the first density, and wherein the first mass portion comprises a third material having a third density greater than the first density and greater than the second density.

17. A golf club head as defined in claim 14, wherein the body portion comprises a first material having a first density, wherein the filler material comprises a second material having a second density less than the first density, and wherein the first mass portion comprises a third material having a third density different from the first density and different from the second density.

18. A golf club head as defined in claim 14, wherein the body portion comprises a steel based material having a first density, wherein the filler material comprises a material having a second density less than the first density, and wherein the first mass portion comprises a tungsten based material having a third density greater than the first density and greater than the second density.

19. A golf club head as defined in claim 14, wherein at least a portion of the filler material is attached to the body portion.

20. A golf club head as defined in claim 14, wherein at least a portion of the port is below a horizontal midplane of the body portion.

* * * * *